US012404640B2

(12) United States Patent
Brownmiller et al.

(10) Patent No.: US 12,404,640 B2
(45) Date of Patent: Sep. 2, 2025

(54) CATWALK FLOORBEAM CONNECTION SYSTEM

(71) Applicant: Sukup Manufacturing Co., Sheffield, IA (US)

(72) Inventors: David Jay Brownmiller, Mason City, IA (US); Dustin Donahue Davis, Nora Springs, IA (US); Andrew Gene Sorensen, Clear Lake, IA (US)

(73) Assignee: SUKUP MANUFACTURING CO., Sheffield, IA (US)

( * ) Notice: Subject to any disclaimer, the term of this patent is extended or adjusted under 35 U.S.C. 154(b) by 1218 days.

(21) Appl. No.: 17/191,888

(22) Filed: Mar. 4, 2021

(65) Prior Publication Data

US 2021/0189742 A1 Jun. 24, 2021

Related U.S. Application Data

(63) Continuation of application No. 15/886,929, filed on Feb. 2, 2018, now Pat. No. 10,975,584.

(Continued)

(51) Int. Cl.

| | |
|---|---|
| ***E01D 15/133*** | (2006.01) |
| ***E04G 5/16*** | (2006.01) |
| ***E04G 7/02*** | (2006.01) |
| ***E04G 7/30*** | (2006.01) |
| *E04G 5/06* | (2006.01) |
| *E04G 5/14* | (2006.01) |

(52) U.S. Cl.

CPC ..... *E01D 15/133* (2013.01); *E04G 5/16* (2013.01); *E04G 7/02* (2013.01); *E04G 7/302* (2013.01); *E04G 5/06* (2013.01); *E04G 2005/068* (2013.01); *E04G 5/14* (2013.01)

(58) Field of Classification Search

CPC ..... E04G 5/06; E04G 5/16; E04G 2005/068; E04G 7/302; E01D 15/133; E04B 1/2612; E04B 2001/2644; E04B 2001/2676

See application file for complete search history.

(56) References Cited

U.S. PATENT DOCUMENTS 591,405 A * 10/1897 Jenkins ..... E04B 5/29 52/702
610,832 A * 9/1898 Robinson ..... E04B 5/29 52/702

(Continued)

*Primary Examiner* — Colleen M Chavchavadze
(74) *Attorney, Agent, or Firm* — Christopher A. Proskey; BrownWinick Law Firm

(57) ABSTRACT

A catwalk system having a pair of side trusses formed of a top cord and bottom cord connected by a plurality of vertical posts and diagonal posts. The bottom cords have a plurality of joints formed of a bottom plate, opposing side plates and wing plates that form a pocket. These pockets receive an end of floorbeams which are bolted to the side plates. The bottom plate also includes a wind brace section that receives an end of a diagonal wind brace therein. The fabricated side trusses are shipped to the job site where the catwalk is quickly and easily assembled by aligning a pair of side trusses in parallel space alignment and installing floorbeams in the pockets of opposing joints. To provide additional rigidity diagonal wind braces are installed in a zig-zag formation between diagonally opposite joints. This arrangement provides a quickly assembled catwalk that requires minimal assembly.

21 Claims, 78 Drawing Sheets

Related U.S. Application Data

(60) Provisional application No. 62/454,390, filed on Feb. 3, 2017.

(56) References Cited

U.S. PATENT DOCUMENTS 625,427 A * 5/1899 Stewart ..... F16B 9/05 29/897.3
770,050 A * 9/1904 Dreyer ..... F16B 7/0446 248/300
796,433 A * 8/1905 Kahn ..... F16B 9/05 248/300
858,838 A * 7/1907 Tuteur ..... E04B 1/2612 296/42
1,785,791 A * 12/1930 Ropp ..... E04B 1/2612 52/702
2,106,084 A * 1/1938 Coddington ..... E04C 3/08 52/655.1
3,537,221 A * 11/1970 Helfman ..... F16B 9/058 D25/61
4,897,979 A * 2/1990 Colonias ..... F16B 9/058 248/248
4,912,795 A * 4/1990 Johnson ..... E01D 6/00 52/645
4,964,253 A * 10/1990 Loeffler ..... E04B 7/063 52/643
4,982,548 A * 1/1991 Abbey ..... E04B 1/0007 52/289
5,253,465 A * 10/1993 Gilb ..... E04B 1/2612 52/643
7,568,253 B2 * 8/2009 de la Chevrotiere ..... E01D 6/00 14/14
7,913,472 B2 * 3/2011 Troth ..... E04B 7/063 52/696
8,443,569 B2 * 5/2013 Sias ..... E04B 7/063 52/696
8,667,633 B2 * 3/2014 De La Chevrotiere ... E01D 6/00 52/690
8,720,155 B1 * 5/2014 Robell ..... E04B 1/2612 52/489.1
10,179,992 B2 * 1/2019 Brekke ..... E04B 1/2612
2016/0264384 A1 * 9/2016 Roodenburg ..... B66C 23/365

* cited by examiner

CATWALK FLOORBEAM CONNECTION SYSTEM

CROSS REFERENCE TO RELATED APPLICATIONS

This application is a continuation of U.S. application Ser. No. 15/886,929 which was filed on Feb. 2, 2018, which claims priority to U.S. Provisional Application 62/454,390 which was filed on Feb. 3, 2017, the entirety of each is hereby incorporated fully by reference herein.

FIELD

This disclosure relates to catwalks. More specifically and without limitation, this disclosure relates to a catwalk floorbeam connection system used in agricultural applications, as well as other industrial applications.

OVERVIEW

Grain bins are massive structures used to store bulk flowable grain products such as corn, soybeans, wheat, rice, or any other grain products. Conventional grain bins are generally formed in a cylindrical shape with a corrugated sidewall covered by a peaked roof. Grain bins vary in height (ranging from twenty feet high to well over a hundred and fifty feet high), and vary in diameter (ranging from eighteen feet in diameter to well over a hundred and fifty feet in diameter). The storage capacity of modern grain bins can range anywhere from a few thousand bushels to well over a million bushels.

Many grain storage and transport facilities, such as commercial elevators, utilize a plurality of grain bins. These grain bins are often connected to one another by a catwalk system that supports grain handling equipment, such as a conveyor or grain carrying belt. These catwalk systems also provide a pathway for access, maintenance and inspection purposes.

There are a number of manufacturers of catwalk systems including: LeMar Industries, a subsidiary of CTB, Inc., having an address of 2070 NE 60th Ave., Des Moines, IA 50313; Brownie Systems, a division of Global Industries, Inc., having an address of MFS/York/Stormor, 2928 E. Hwy 30, Grand Island, NE 6880; and GSI Group, a brand of AGCO Corporation having an address of 4205 River Green Parkway, Duluth, GA 30096, among many others. While the prior art systems are effective in various ways, they suffer from many disadvantages.

Namely, the prior art catwalk systems are overly complicated to assemble in the field. Prior art catwalk systems are formed of a great number of parts that must be assembled in the sometimes less than optimal conditions in the field. Prior art catwalk systems require a great number of parts or pieces that must be installed correctly otherwise the resulting assembly will be defective. Prior art catwalk systems are overly time consuming to assemble in the field and require complex assembly steps and excessive labor. In addition, due to their complexity, prior art catwalk systems are susceptible to improper assembly. Even when these prior art catwalk systems are assembled they are less rigid and robust as may be desirable.

Therefore, for all the reasons stated above, and the reasons stated below, there is a need in the art for an improved catwalk floorbeam connection system for use in association with agricultural applications and other industrial applications.

Thus, it is a primary object of at least one embodiment to provide a catwalk floorbeam connection system that improves upon the state of the art.

Another object of at least one embodiment is to provide a catwalk floorbeam connection system that is easy to assemble.

Yet another object of at least one embodiment is to provide a catwalk floorbeam connection system that reduces the labor required to assemble.

Another object of at least one embodiment is to provide a catwalk floorbeam connection system that reduces assembly errors.

Yet another object of at least one embodiment is to provide a catwalk floorbeam connection system that speeds the assembly process over prior art systems.

Another object of at least one embodiment is to provide a catwalk floorbeam connection system that is less susceptible to improper assembly.

Yet another object of at least one embodiment is to provide a catwalk floorbeam connection system that is durable.

Another object of at least one embodiment is to provide a catwalk floorbeam connection system that has a long useful life.

Yet another object of at least one embodiment is to provide a catwalk floorbeam connection system that is rigid.

Another object of at least one embodiment is to provide a catwalk floorbeam connection system that can be used in a great number of applications.

Yet another object of at least one embodiment is to provide a catwalk floorbeam connection system that can be used with a wide variety of equipment.

Another object of at least one embodiment is to provide a catwalk floorbeam connection system that is relatively inexpensive.

Yet another object of at least one embodiment is to provide a catwalk floorbeam connection system that is easy to manufacture.

Another object of at least one embodiment is to provide a catwalk floorbeam connection system that has a robust design.

Yet another object of at least one embodiment is to provide a catwalk floorbeam connection system that is high quality.

Another object of at least one embodiment is to provide a catwalk floorbeam connection system that can be used with any grain bin.

Yet another object of at least one embodiment is to provide a catwalk floorbeam connection system that is dimensionally accurate.

Another object of at least one embodiment is to provide a catwalk floorbeam connection system that eliminates the need to weld in the field.

Yet another object of at least one embodiment is to provide a catwalk floorbeam connection system that has tight dimensional tolerances.

Another object of at least one embodiment is to provide a catwalk floorbeam connection system that allows catwalks to be shipped in a disassembled state and assembled on site.

Yet another object of at least one embodiment is to provide a catwalk floorbeam connection system that reduces shipping costs.

Another object of at least one embodiment is to provide a catwalk floorbeam connection system that provides a pocket that receives an end of the floorbeams therein.

These and other objects, features, or advantages of at least one embodiment will become apparent from the specification, figures and claims.

SUMMARY

A catwalk floorbeam connection system having a pair of side trusses formed of a top cord and bottom cord connected by a plurality of vertical posts and diagonal posts is presented. The bottom cords have a plurality of joints formed of a bottom plate, opposing side plates and wing plates that form a pocket. These pockets receive an end of floorbeams which are bolted to holes in the side plates. The bottom plate also includes a wind brace section that receives an end of a diagonal wind brace therein. The fabricated side trusses are shipped to the job site where the catwalk is quickly and easily assembled by aligning a pair of side trusses in parallel space alignment and installing floorbeams in the pockets of opposing joints. To provide additional rigidity diagonal wind braces are installed in a zig-zag formation between diagonally opposite joints. This arrangement provides a quickly assembled, high quality, rigid and durable catwalk that requires a minimum number of assembly steps.

DETAILED DESCRIPTION

Figure 1:
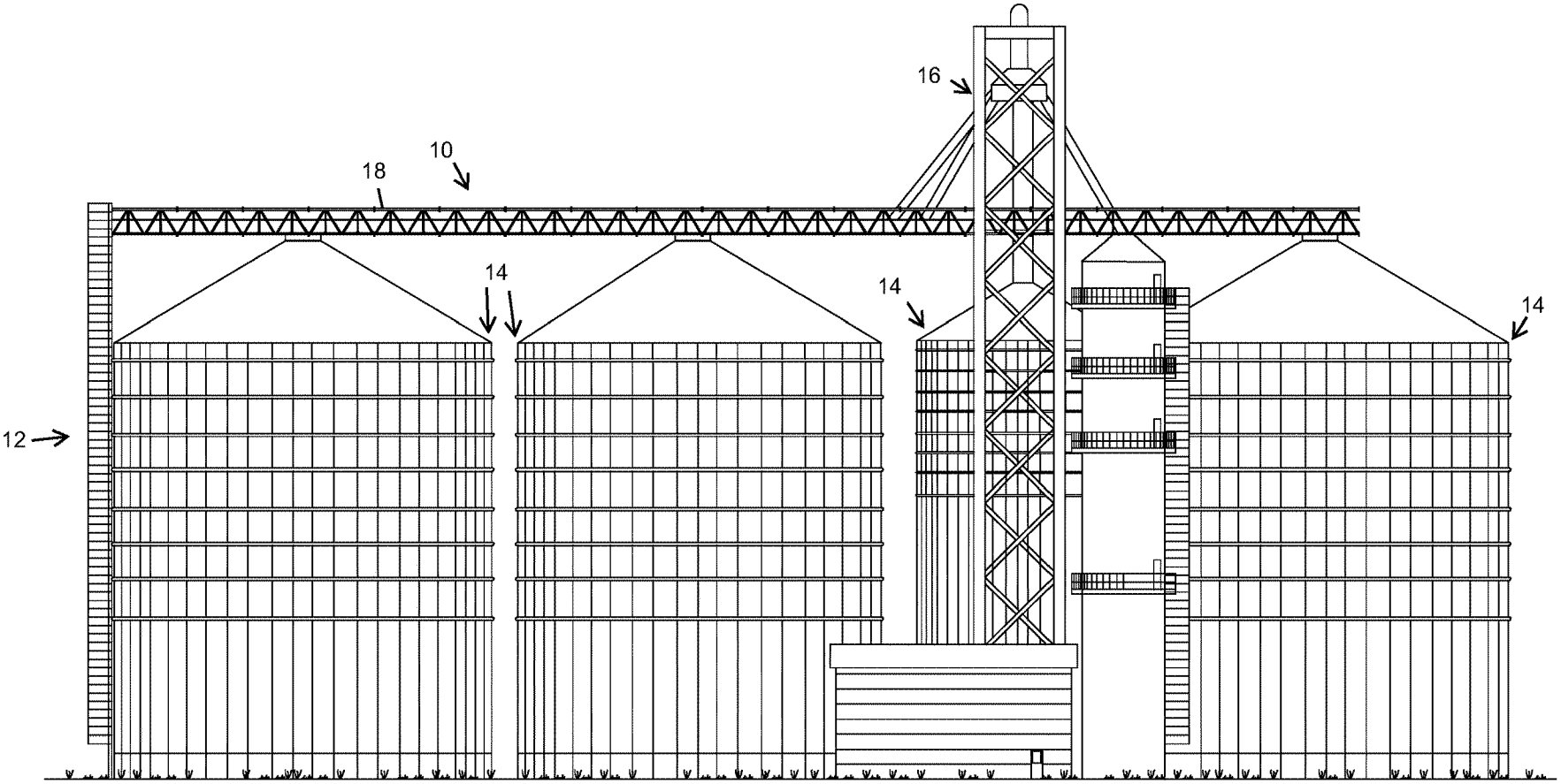
FIG. 1 is an elevation view of a grain storage facility having a plurality of grain bins connected by a catwalk system.
Figure 2:
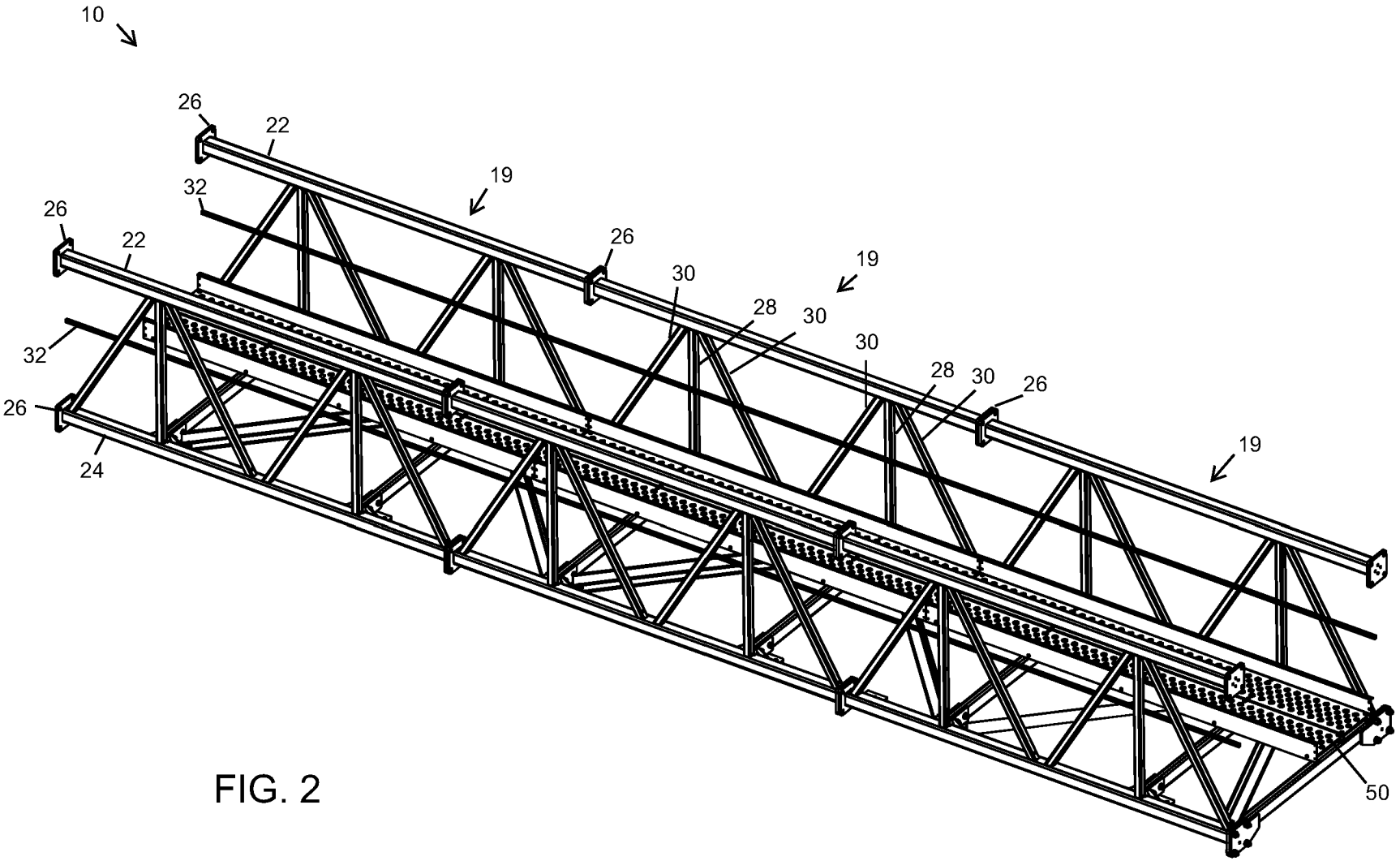
FIG. 2 is a perspective view of a section of assembled catwalk formed of three pairs of side trusses connected together.
Figure 3:
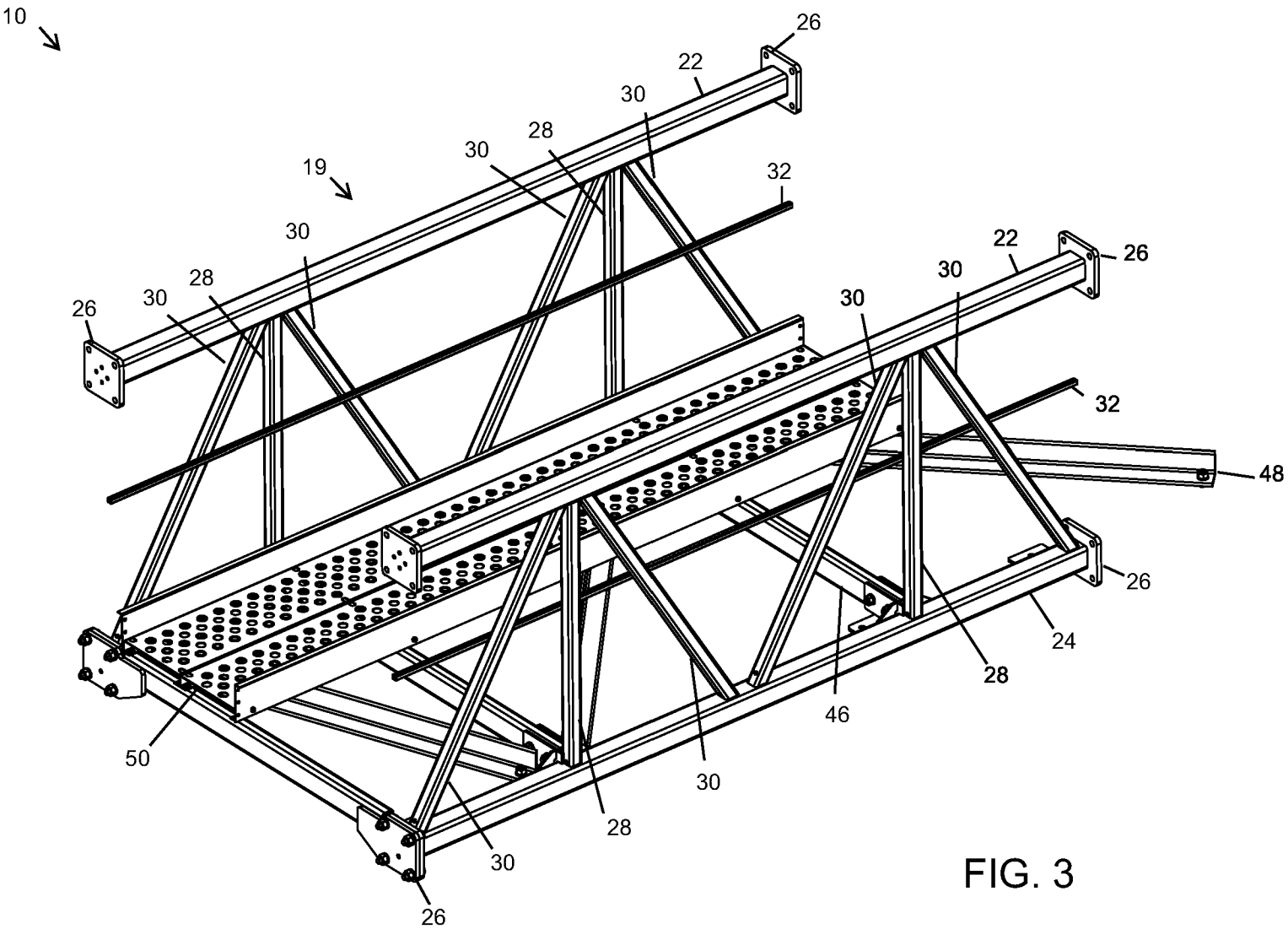
FIG. 3 is a perspective view of a section of assembled catwalk formed of a single pair of side trusses connected together.
Figure 4:
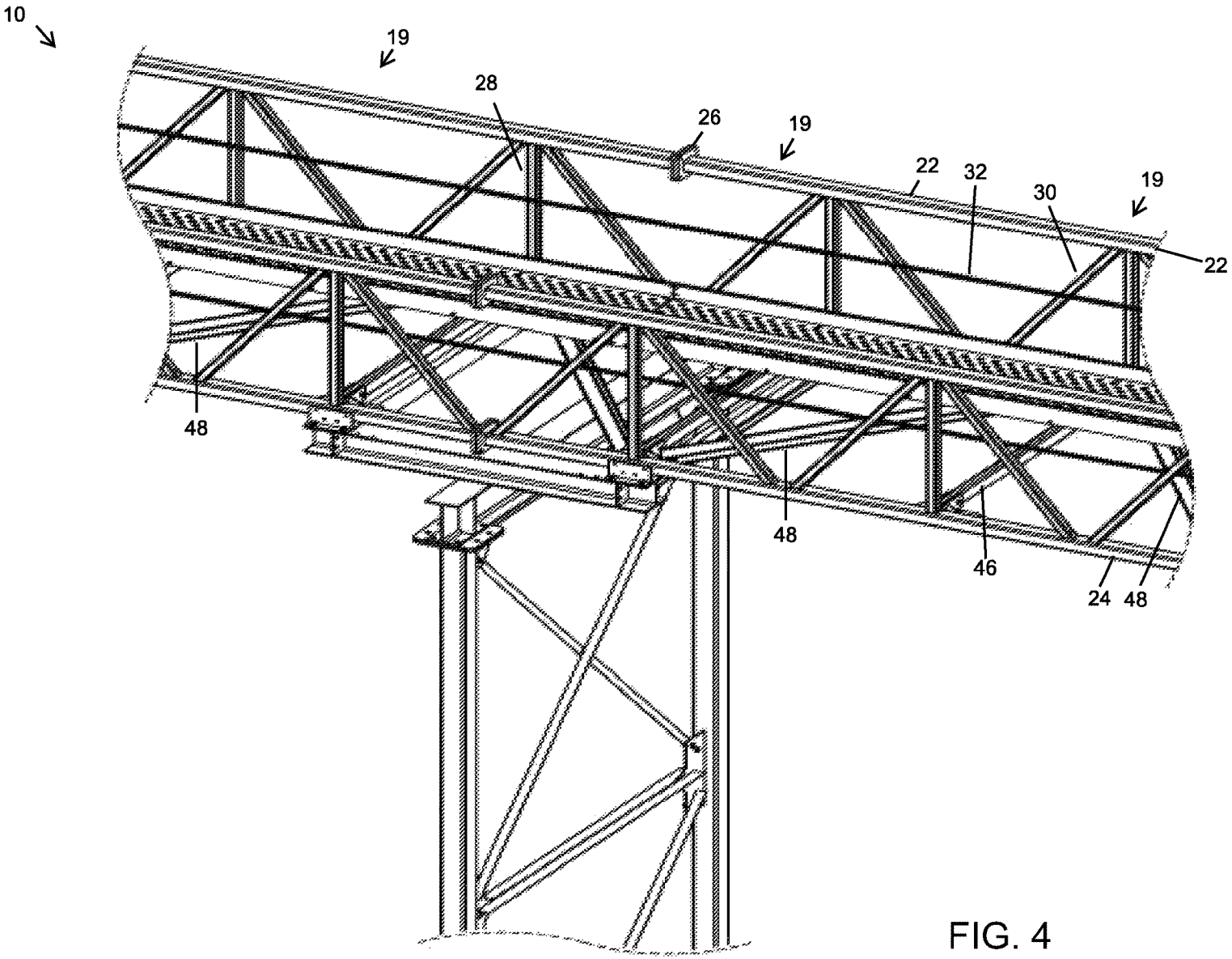
FIG. 4 is a perspective view of a section of assembled catwalk, the view showing the catwalk supported by a vertical support.
Figure 5:
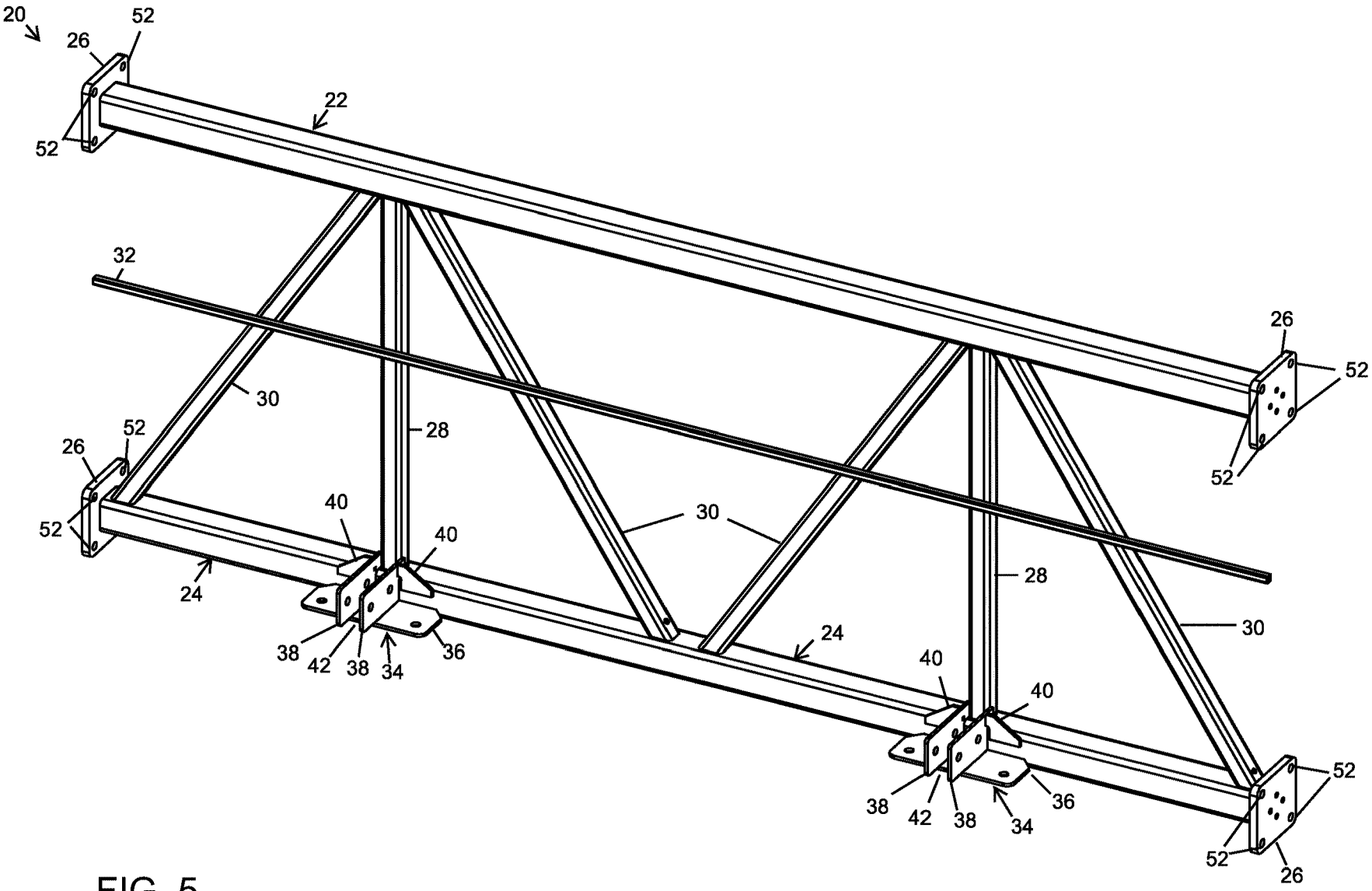
FIG. 5 is a perspective view of single side truss, the view showing a top cord and bottom cord connected together by a plurality of vertical posts and diagonal posts, the view also shows joints connected to the bottom cord that form pockets.
Figure 6:
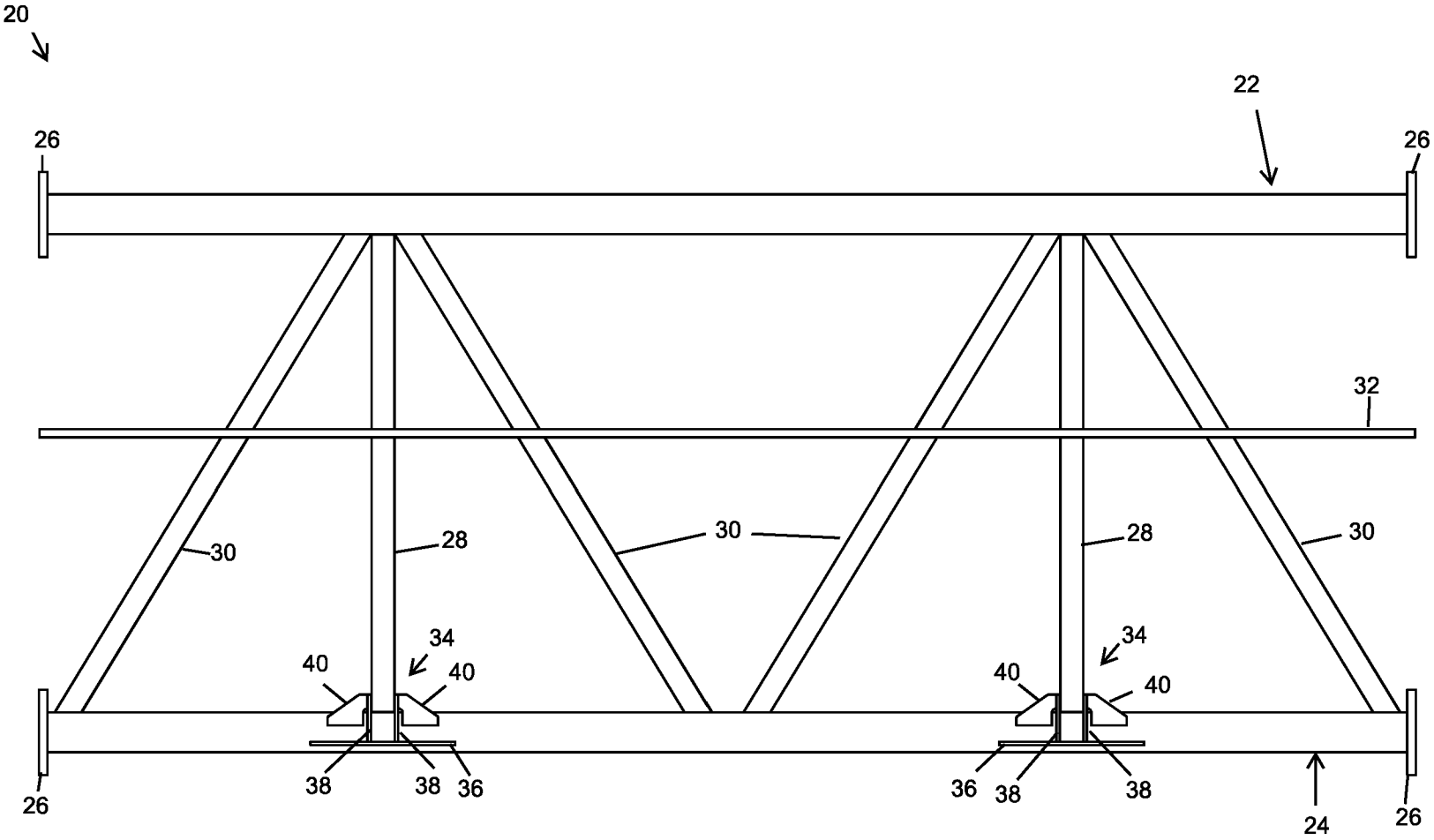
FIG. 6 is a side elevation view of single side truss, the view showing a top cord and bottom cord connected together by a plurality of vertical posts and diagonal posts, the view also shows joints connected to the bottom cord that form pockets.

In the following detailed description of the embodiments, reference is made to the accompanying drawings which form a part hereof, and in which is shown by way of illustration specific embodiments in which the disclosure may be practiced. The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure. It will be understood by those skilled in the art that various changes in form and details may be made without departing from the principles and scope of the invention. It is intended to cover various modifications and similar arrangements and procedures, and the scope of the appended claims therefore should be accorded the broadest interpretation so as to encompass all such modifications and similar arrangements and procedures. For instance, although aspects and features may be illustrated in or described with reference to certain figures or embodiments, it will be appreciated that features from one figure or embodiment may be combined with features of another figure or embodiment even though the combination is not explicitly shown or explicitly described as a combination. In the depicted embodiments, like reference numbers refer to like elements throughout the various drawings.

It should be understood that any advantages and/or improvements discussed herein may not be provided by some various disclosed embodiments, or implementations thereof. The contemplated embodiments are not so limited and should not be interpreted as being restricted to embodiments which provide such advantages or improvements. Similarly, it should be understood that various embodiments may not address all or any objects of the disclosure or objects of the invention that may be described herein. The contemplated embodiments are not so limited and should not be interpreted as being restricted to embodiments which address such objects of the disclosure or invention. Furthermore, although some disclosed embodiments may be described relative to specific materials, embodiments are not limited to the specific materials or apparatuses but only to their specific characteristics and capabilities and other materials and apparatuses can be substituted as is well understood by those skilled in the art in view of the present disclosure.

It is to be understood that the terms such as "left, right, top, bottom, front, back, side, height, length, width, upper, lower, interior, exterior, inner, outer, and the like as may be used herein, merely describe points of reference and do not limit the present invention to any particular orientation or configuration.

As used herein, the term "or" includes one or more of the associated listed items, such that "A or B" means "either A or B". As used herein, the term "and" includes all combinations of one or more of the associated listed items, such that "A and B" means "A as well as B." The use of "and/or" includes all combinations of one or more of the associated listed items, such that "A and/or B" includes "A but not B," "B but not A," and "A as well as B," unless it is clearly indicated that only a single item, subgroup of items, or all items are present. The use of "etc." is defined as "et cetera" and indicates the inclusion of all other elements belonging to the same group of the preceding items, in any "and/or" combination(s).

As used herein, the singular forms "a," "an," and "the" are intended to include both the singular and plural forms, unless the language explicitly indicates otherwise. Indefinite articles like "a" and "an" introduce or refer to any modified term, both previously-introduced and not, while definite articles like "the" refer to a same previously-introduced term; as such, it is understood that "a" or "an" modify items that are permitted to be previously-introduced or new, while definite articles modify an item that is the same as immediately previously presented. It will be further understood that the terms "comprises," "comprising," "includes," and/or "including," when used herein, specify the presence of stated features, characteristics, steps, operations, elements, and/or components, but do not themselves preclude the presence or addition of one or more other features, characteristics, steps, operations, elements, components, and/or groups thereof.

It will be understood that when an element is referred to as being "connected," "coupled," "mated," "attached," "fixed," etc. to another element, it can be directly connected to the other element, and/or intervening elements may be present. In contrast, when an element is referred to as being "directly connected," "directly coupled," "directly engaged" etc. to another element, there are no intervening elements present. Other words used to describe the relationship between elements should be interpreted in a like fashion (e.g., "between" versus "directly between," "adjacent" versus "directly adjacent," "engaged" versus "directly engaged," etc.). Similarly, a term such as "operatively", such as when used as "operatively connected" or "operatively engaged" is to be interpreted as connected or engaged, respectively, in any manner that facilitates operation, which may include being directly connected, indirectly connected, electronically connected, wirelessly connected or connected by any other manner, method or means that facilitates desired operation. Similarly, a term such as "communicatively connected" includes all variations of information exchange and routing between two electronic devices, including intermediary devices, networks, etc., connected wirelessly or not. Similarly, "connected" or other similar language particularly for electronic components is intended to mean connected by any means, either directly or indirectly, wired and/or wirelessly, such that electricity and/or information may be transmitted between the components.

It will be understood that, although the ordinal terms "first," "second," etc. may be used herein to describe various elements, these elements should not be limited to any order by these terms unless specifically stated as such. These terms are used only to distinguish one element from another; where there are "second" or higher ordinals, there merely must be a number of elements, without necessarily any difference or other relationship. For example, a first element could be termed a second element, and, similarly, a second element could be termed a first element, without departing from the scope of example embodiments or methods.

Similarly, the structures and operations discussed herein may occur out of the order described and/or noted in the figures. For example, two operations and/or figures shown in succession may in fact be executed concurrently or may sometimes be executed in the reverse order, depending upon the functionality/acts involved. Similarly, individual operations within example methods described below may be executed repetitively, individually, or sequentially, to provide looping or other series of operations aside from single operations described below. It should be presumed that any embodiment or method having features and functionality described below, in any workable combination, falls within the scope of example embodiments.

While the arrangement shows and the description herein describes use of the catwalk system presented primarily in association with grain bins, the system is not so limited. Instead, it is contemplated that the catwalk system presented herein may be used in any setting or application where a catwalk is used or is useful.

With reference to FIG. 1, a catwalk connection system 10 (catwalk system 10 or system 10) is shown in use with an exemplary grain storage facility 12. Grain storage facility 12 includes a plurality of grain bins 14, and a leg 16, among other components. Grain bins 14 are configured to store bulk amounts of grain. Grain bins 14 are connected together at the peak of their roofs by catwalk system 10. Catwalk system 10 supports a grain handling device 18 (not shown in detail) such as a belt or conveyor that carries grain to each grain bin 14. Leg 16 is configured to carry grain upward which is deposited on the grain handling device 18 supported by catwalk system 10.

Pocket Connection:

With reference to FIGS. 2-24, a catwalk system 10 is shown with a pocket connection. In this arrangement shown, catwalk system 10 is formed of a plurality of sections 19 that are connected together in end-to-end alignment to form an elongated catwalk. Catwalk system 10 includes side trusses 20 which are formed of a top cord 22, a bottom cord 24, end plates 26, vertical posts 28, diagonal posts 30, a midrail tube 32, and joints 34. Joints 34 are formed of a bottom plate 36, opposing side plates 38, and wing plates 40 that form a pocket 42. Joints 34 receive an end 44 of floorbeams 46 in pockets 42 and diagonal wind braces 48 connect diagonally positioned joints 34. A walkway 50 extends across the floorbeams 46 and diagonal wind braces 48, as is further described herein.

Side Trusses: Side trusses 20 are formed of any suitable size, shape and design and are configured to form the side of catwalk system 10 and provide the needed structural strength and rigidity to system 10. In the arrangement shown, as one example, each side truss 20 is formed of a top cord 22 and a bottom cord 24, wherein the top cord 22 and a bottom cord 24 include end plates 26 thereon at their outward ends. While two cords (top cord 22 and bottom cord 24) are shown being used in side truss 20, any other number of cords are hereby contemplated for use such as one, three, four, five, six, seven, eight, nine or ten or more.

In the arrangement shown, opposing top cord 22 and bottom cord 24 are connected to one another by a plurality of connecting posts, which are shown, as example, as vertical posts 28 and diagonal posts 30 that extend between top cord 22 and bottom cord 24. While the term vertical post 30 as used herein includes the word "vertical", the term vertical post 30 is intended to be construed as any support member that extends between top cord 22 and bottom cord 24 in the vertical plane, in a perpendicular manner or at any angle. Bottom cord 24 also includes a plurality of joints 34 which are used to connect opposing side trusses 20 using a plurality of floorbeams 46 and diagonal wind braces 48. Side trusses 20 also include a midrail tube 32, among other components.

Top Cord & Bottom Cord: Top cord 22 and a bottom cord 24 are formed of any suitable size, shape and design and are configured to provide the needed strength and rigidity to side trusses 20. In the arrangement shown, as one example, top cord 22 and a bottom cord 24 are positioned in approximate parallel spaced alignment to one another and extend a length between opposing ends that include end plates 26. In the arrangement shown, top cord 22 and bottom cord 24 are formed of hollow square or rectangular tubing of approximately equal length and size, however any other shaped structural member is hereby contemplated for use as top cord 22 and bottom cord 24 such as an I-beam, a wide flange beam, a 90 degree angle bar, a Z-bar, a C-channel, an L-bar, a cylindrical pipe, a solid bar, a solid rod, or the like or any combination thereof. The ends of top cord 22 and bottom cord 24 include one or more end plates 26.

End Plates: End plates 26 are formed of any suitable size, shape and design and are configured to provide a mechanism by which adjacent side trusses 20 are connected to one another. In the arrangement shown, as one example, end plates 26 are generally planar members that when viewed from the side, or along the length of top cord 22 and bottom cord 24, are generally square or rectangular in shape, however any other shape is hereby contemplated for use. In the arrangement shown, end plates 26 enclose the ends of top cord 22 and bottom cord 24 and in doing so wholly or partially seal the ends of top cord 22 and bottom cord 24 thereby preventing water and debris from entering the ends of top cord 22 and bottom cord 24, which can cause damage over time. As such, by closing or sealing the ends of top cord 22 and bottom cord 24 this may improve the longevity of top cord 22 and bottom cord 24. In one arrangement, when viewed from the front side or back side, such as the view shown in FIG. 6, the outward facing surfaces of end plates 26 form a flat plane that is configured to engage an end plate 26 of an adjacent side truss 20.

In the arrangement shown, when square end plates 26 are used, they include at least one hole 52 positioned inward a distance from some or all of the corners. During the assembly process, the holes 52 in end plates 26 are configured to be aligned with the holes 52 of end plates 26 of adjacent side trusses 20. Once aligned a conventional bolt 54 is passed through the aligned holes 52 and tightened in place thereby connecting adjacent side trusses 20 to one another while the outward facing surfaces of adjacent end plates 26 are in planar engagement with one another.

While end plates 26 are shown as being used to connect adjacent side trusses 20, any other system, device, manner or method of connecting two components together is hereby contemplated for use in place of end plates 26. In addition, end plates 26 may be used to connect any other member to side trusses 20.

Vertical Posts: Vertical posts 28 are formed of any suitable size, shape and design and are configured to extend between and connect top cord 22 and bottom cord 24 and provide structural strength and rigidity to side trusses 20. In the arrangement shown, as one example, vertical posts 28 are formed of hollow square or rectangular tubing, however any other shaped structural member is hereby contemplated for use as vertical posts 28 such as an I-beam, a wide flange beam, a 90 degree angle bar, a Z-bar, a C-channel, an L-bar, a cylindrical pipe, a solid bar, a solid rod, or the like or any combination thereof. In the arrangement shown, the hollow square or rectangular tubing used for vertical posts 28 is slightly smaller than that used for top cord 22 and bottom cord 24. In addition, while vertical posts 28 are shown extending perpendicularly between top cord 22 and bottom cord 24, such as in FIG. 6, vertical posts 28 are not so limited and are contemplated to extend at an angle between top cord 22 and bottom cord 24.

In the arrangement shown, as one example, vertical posts 28 extend in approximate perpendicular alignment to the length of top cord 22 and bottom cord 24, however any other angular arrangement is hereby contemplated for use. In the arrangement shown, the upper end of vertical posts 28 connect to the bottom side of top cord 22 and the lower end of vertical posts 28 connect to the upper surface 55 of bottom cord 24. Joints 34 are connected to the lower end of vertical posts 28.

In the arrangement shown, two vertical posts 28 are included in each side truss 20. In this arrangement, each vertical post 28 is spaced inward a distance from the ends of top cord 22 and bottom cord 24 and the vertical posts 28 are spaced a distance from one another. The use of any other number of vertical posts 28 is hereby contemplated for each side truss 20 such as one, three, four, five, six, seven, eight, nine, ten or more, as is any other spacing of the vertical posts 28, from being positioned at the ends of top cord 22 and bottom cord 24, the middle of top cord 22 and bottom cord 24, or any other position.

Diagonal Posts: Diagonal posts 30 are formed of any suitable size, shape and design and are configured to extend between and connect to top cord 22 and bottom cord 24 and provide structural strength and rigidity to side trusses 20. In the arrangement shown, as one example, diagonal posts 30 are formed of hollow square or rectangular tubing, however any other shaped structural member is hereby contemplated for use as diagonal posts 30 such as an I-beam, a wide flange beam, a 90 degree angle bar, a Z-bar, a C-channel, an L-bar, a cylindrical pipe, a solid bar, a solid rod, or the like or any combination thereof. In the arrangement shown, the hollow square or rectangular tubing used for diagonal posts 30 is slightly smaller than that used for top cord 22 and bottom cord 24. In the arrangement shown, as one example, the hollow square or rectangular tubing used for vertical posts 28 and diagonal posts 30 is the same size and shape, however, in other arrangements, the shape and/or size of vertical posts 28 and diagonal posts 30 are different.

In the arrangement shown, diagonal posts 30 extend in angled alignment to the length of top cord 22 and bottom cord 24. In this arrangement, the upper end of diagonal posts 30 connect to the bottom side of top cord 22. The lower end of diagonal posts 30 connect to the upper surface 55 of bottom cord 24.

In the arrangement shown, as one example, a diagonal post 30 is positioned on either side of each vertical post 28. In the arrangement shown, as one example, the opposing diagonal posts 30 angle inward toward the vertical post 28 as they extend upward. In this arrangement, the lower end of diagonal posts 30 connect to bottom cord 24 a distance away from where vertical post 28 connects to bottom cord 24, whereas the upper end of the diagonal posts 30 connect to top cord 22 at or near where the upper end of vertical post 28 connects to top cord 22. In the arrangement shown, as one example, the lower end of the outward most diagonal post 30 is positioned at or just inward a distance from the inward surface of the end plate 26 of the bottom cord 24. In the arrangement shown, as one example, the lower end of the inward most diagonal posts 30 connect to bottom cord 24 at or near one another and near the center of bottom cord 24. Any other number of diagonal posts 30 are hereby contemplated for use for each vertical post 28 such as one, three, four, five, six, seven, eight, nine, ten or more as is any other angular arrangement or placement.

As vertical posts 28 and diagonal posts 30 connect top cord 22 and bottom cord 24, vertical posts 28 and diagonal posts 30 may be referred to collectively as connecting posts. It is also hereby contemplated that additional cross connecting posts may extend laterally or between one or more vertical posts 28, between one or more diagonal posts 30 and/or between one or more vertical posts 28 and diagonal posts 30, and/or between any other components of the system 10. These cross connecting posts also fall under the broad definition of a connecting post.

In the arrangement shown, top cord 22 and bottom cord 24 are wider than vertical posts 28, and for that matter, diagonal posts 30 as well, and in this arrangement, vertical posts 28 and diagonal posts 30 are centrally positioned within top cord 22 and bottom cord 24. The recessed nature of the front and back surfaces of vertical posts 28, and diagonal posts 30, with respect to the front and back surfaces of top cord 22 and bottom cord 24 provide room for other components of the system 10, as is further described herein.

Midrail Tube: Midrail tube 32 is formed of any suitable size, shape and design and is configured to provide additional structural support to side truss 23 and/or provide a conduit or tube through which electrical or other components (such as wires or cables) may extend there through along the length of side truss 20. In other arrangements or in addition thereto, midrail tube 32 serves as a safety feature to help prevent falling through open areas on side truss 23. In the arrangement shown, as one example, midrail tube 32 is a hollow square or rectangular tube connected to the interior surface of vertical posts 28 and diagonal posts 30, however any other shaped tube is hereby contemplated for use, such as round or the like. In the arrangement shown, midrail tube 32 is positioned a distance between top cord 22 and bottom cord 24, however it is contemplated that midrail tube 32 may be placed at any other position, such as outside of vertical posts 28 and diagonal posts 30, or any other position. In addition, the use of any number of midrail tubes 32 is hereby contemplated for use, from none to as many as may be needed.

Joints: Joints 34 are formed of any suitable size, shape and design and are configured to facilitate connection of opposing side trusses 20 to one another in a fast and efficient manner while also being strong, durable and rigid. In the arrangement shown, as one example, joints 34 are formed of a bottom plate 36, a pair of side plates 38 and a pair of wing plates 40 that are cut out of a sheet or plate of desired material. In the arrangement shown, bottom plate 36, side plates 38 and wing plates 40 are welded together and are welded to bottom cord 24 and vertical post 28. However, in an alternative arrangement, joints 34 are formed by any other manner, method or means such as machining, stamping, pressing, forging or any other manufacturing process. In addition, while the arrangement of a bottom plate 36, a pair of side plates 38 and a pair of wing plates 40 is shown for use, any other configuration is hereby contemplated for use. In the arrangement shown, as one example, joints 34 form a pocket 42 that is sized and shaped to receive an end 44 of a floorbeam 46 therein. In one example, joints 34 are located at the inward surface 57 of bottom cord 24 and are aligned where a vertical post 28 connects to bottom cord 24. However in an alternative variation joints 34 may be located at any other position along bottom cord 24 or any other position along side truss 20.

Bottom Plate: Bottom plate 36 is formed of any suitable size, shape and design and is configured to connect to the inward surface 57 of bottom cord 24, to facilitate connection to the opposing side plates 38, and to define the bottom surface of pocket 42. In the arrangement shown, as one example, bottom plate 36 is generally planar in shape and when viewed from above or below is generally rectangular in shape, however any other shape is hereby contemplated for use.

In one arrangement, the inward corners 56 of bottom plate 36, adjacent the inward surface 57 of bottom cord 24, are cut or removed or chamfered. The outward corners of bottom plate 36 include a hole 58 positioned a distance therein that is configured to receive a fastener 54 therein that facilitates connection of a diagonal wind brace 48 to bottom plate 36.

In the arrangement shown, the inward edge of bottom plate 36 connects to the inward surface 57 of bottom cord 24 in a generally flat, flush and straight manner. In one arrangement, the inward edge of bottom plate 36 is welded to the inward surface 57 of bottom cord 24 on its upper surface 72 and/or its bottom surface 66 along its entire length or along a portion of its length.

In the arrangement shown, as one example, the inward edge of bottom plate 36 includes a relief 60. Relief 60 is any groove, notch or section of material that is removed from bottom plate 36 adjacent its inward edge that is placed against the inward surface 57 of bottom cord 24. In the arrangement shown, relief 60 is positioned between side plates 38 and facilitates drainage of moisture that finds its way between side plates 38 and bottom plate 36. In this way, relief 60 extends the life of joint 34 by preventing the buildup of moisture that can over time rust the joint 34 and lead to premature failure.

In the arrangement shown, as one example, bottom plate 36 also includes a plurality of locating slots 62. Locating slots 62 are configured to receive locating ears 64 that extend outward from the bottom edge of side plates 38. Locating slots 62, provide for precise alignment of side plates 38 and ensure that when side plates 38 are installed on bottom plate 36 the side plates 38 are positioned at the precise distance away from one another to receive the end 44 of floorbeams 46 within close and tight tolerances. The use of locating slots 62 in bottom plate 36 and the associated ears 64 in side plates 38 also provides increased strength and rigidity to the connection between bottom plate 36 and side plates 38. In addition, by having the ear 64 of side plate 38 extend into the locating slot 62 of bottom plate 36 this facilities convenient welding or tack welding of the side plate 38 to bottom plate 36 to hold the two components together prior to other manufacturing steps.

Figure 7:
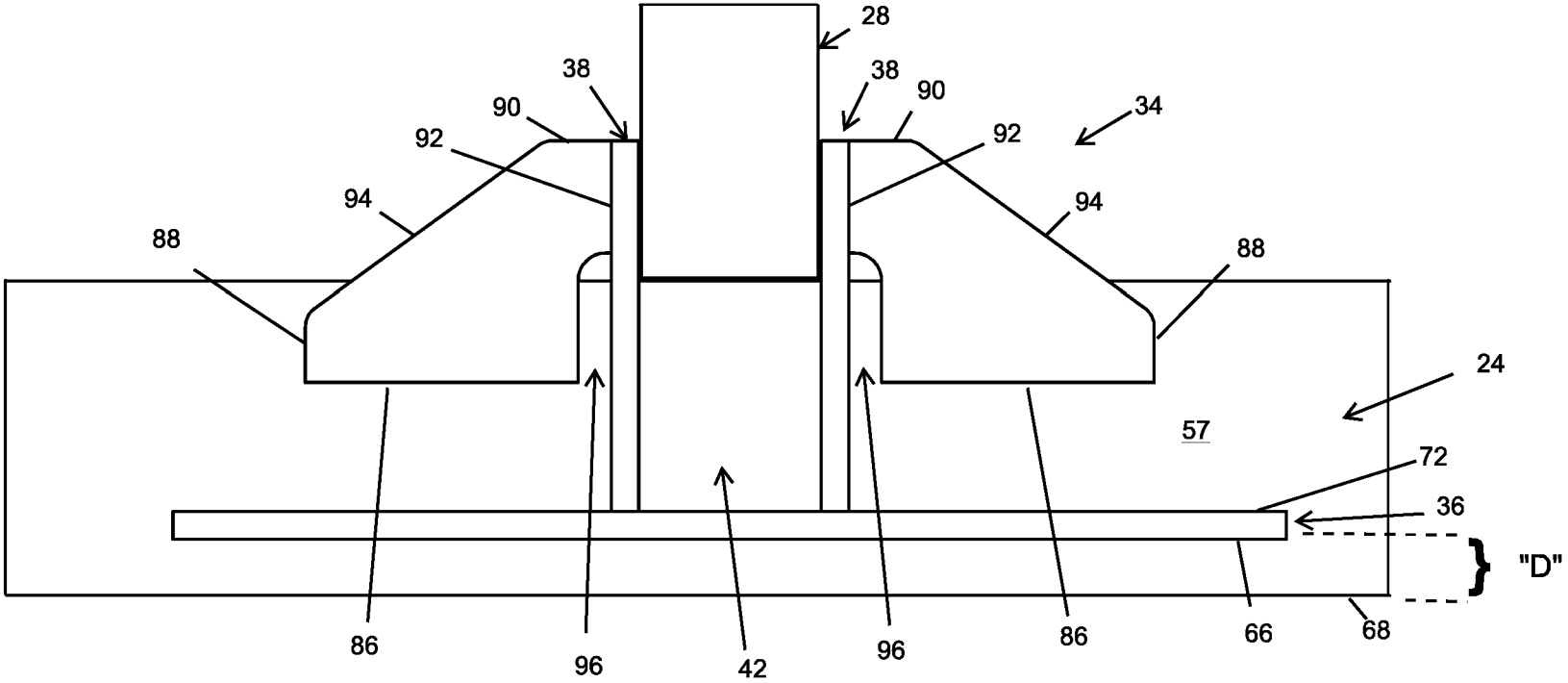
FIG. 7 is a close-up side elevation view of a joint connected to the bottom cord, the view showing the bottom plate connected to the bottom cord, a pair of side plates connected to the bottom plate, bottom cord and vertical post; the view showing a pair of wing plates connected to the bottom cord and a side plate.
Figure 8:
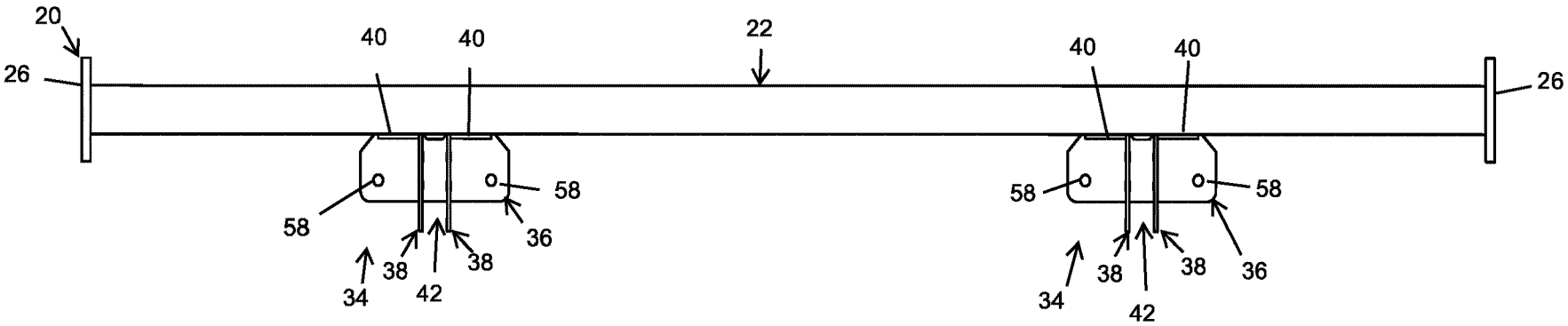
FIG. 8 is a top elevation view of single side truss, the view showing a pair of joints connected to the bottom cord that form pockets.
Figure 15:
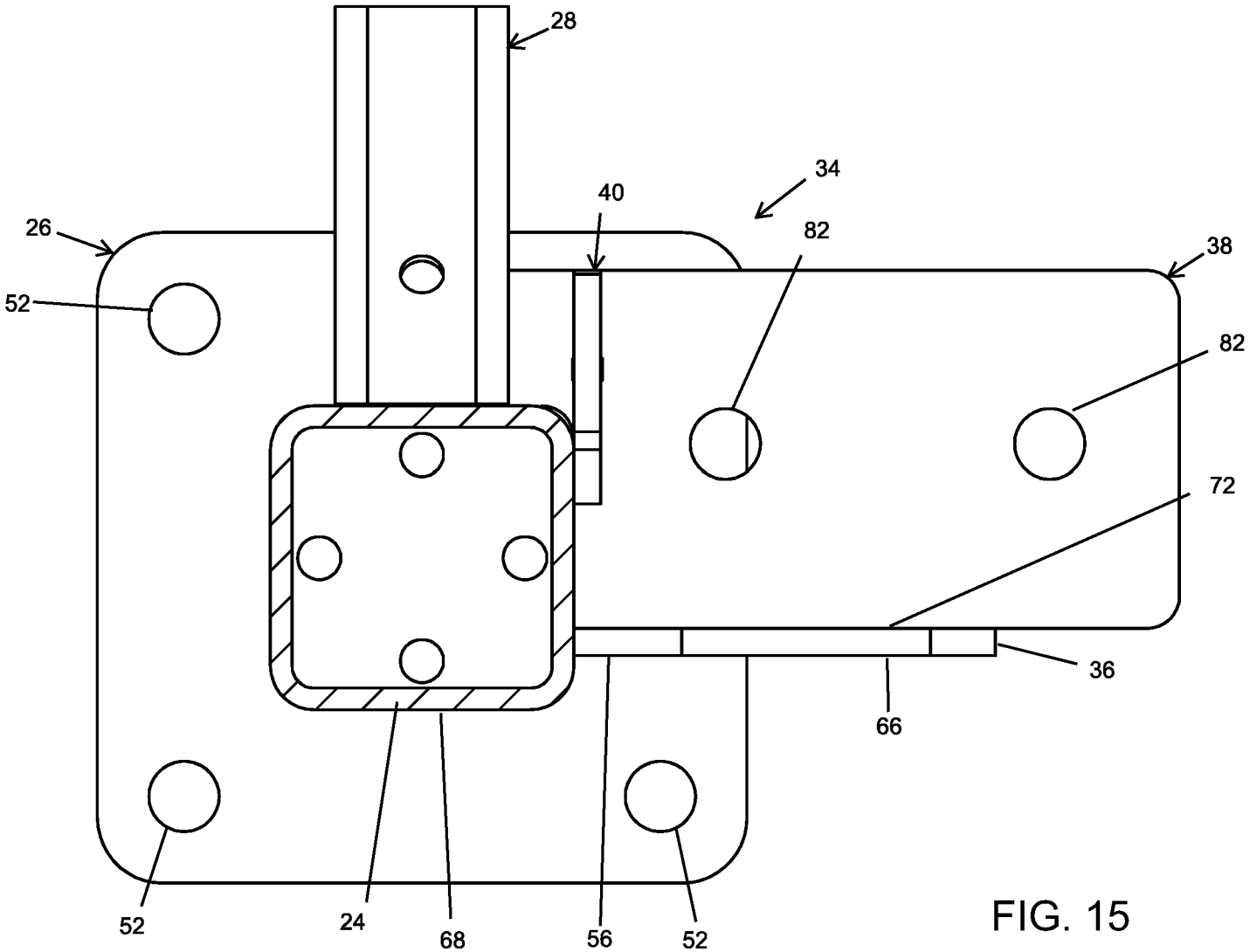
FIG. 15 is a close up side cut-away elevation view of a joint connected to the bottom cord, the view showing the bottom plate connected to the bottom cord, a side plate connected to the bottom plate; the view showing an end plate and a diagonal post connected to the bottom cord.
Figure 16:
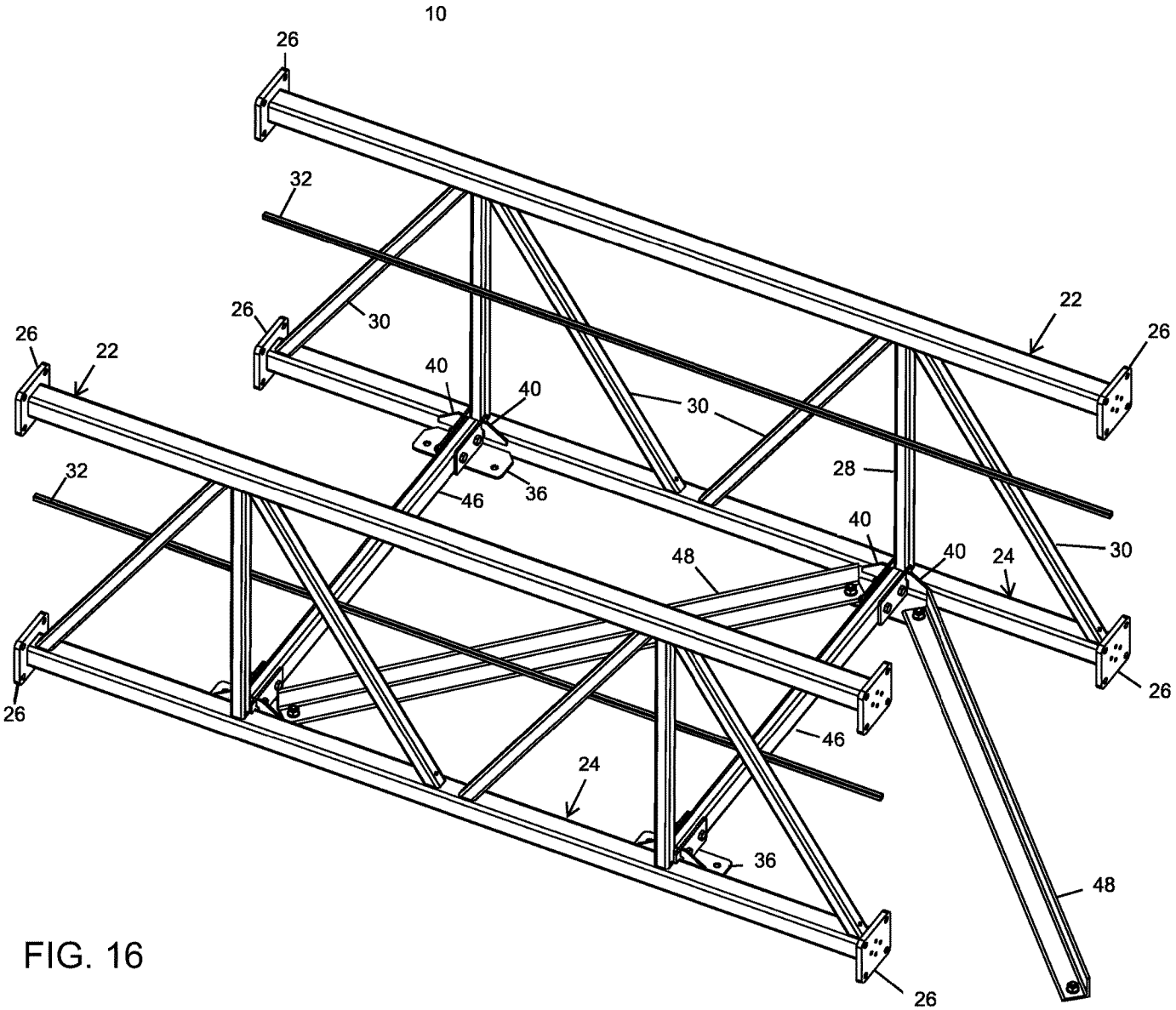
FIG. 16 is a perspective view of a section of assembled catwalk.
Figure 17:
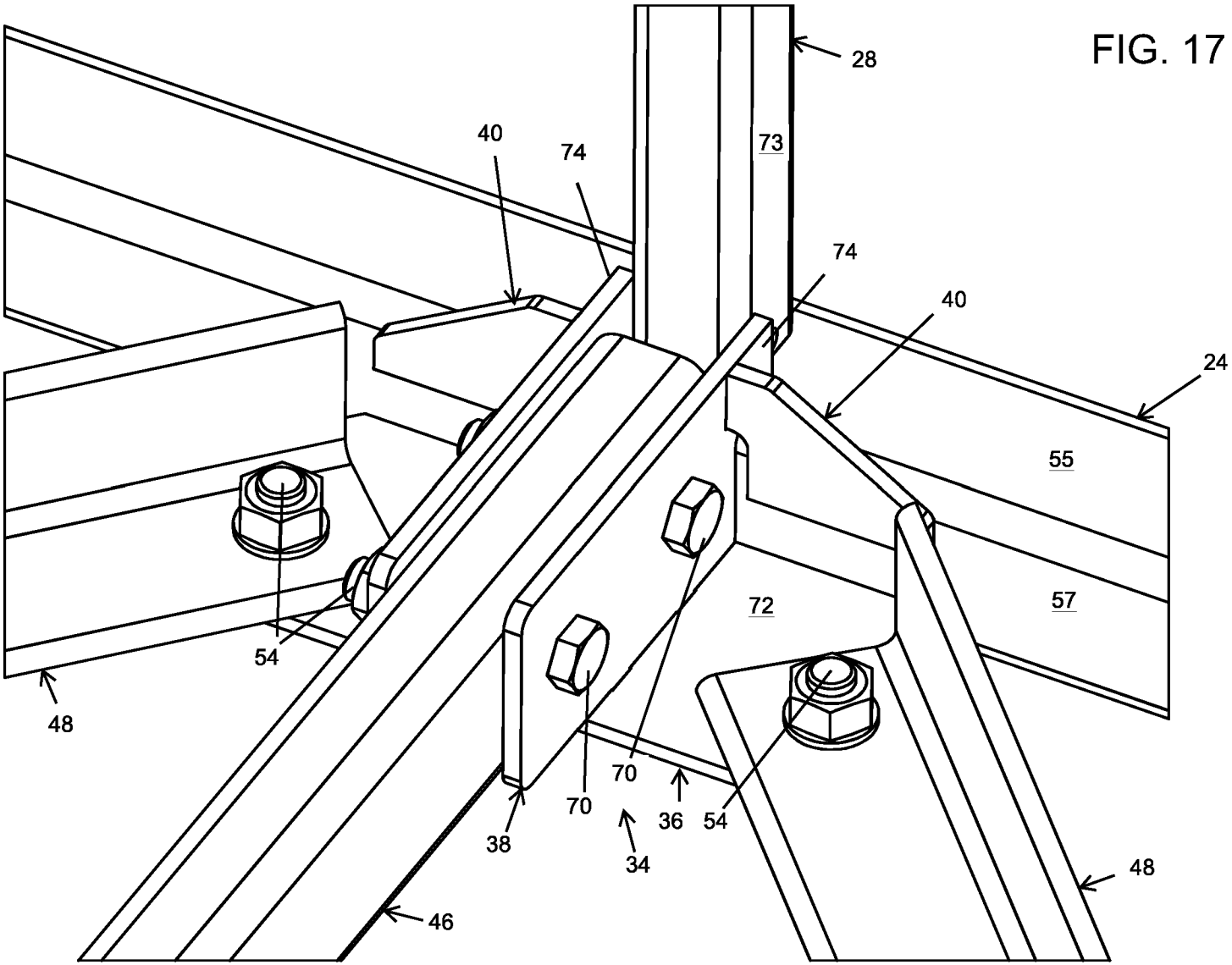
FIG. 17 is a close-up perspective view of a joint connected to a bottom cord, the view showing the bottom plate connected to the bottom cord and a pair of side plates connected to the bottom plate that form a pocket; the view showing a floorbeam in place within the pocket and a pair of diagonal wind braces bolted to the bottom plate.
Figure 18:
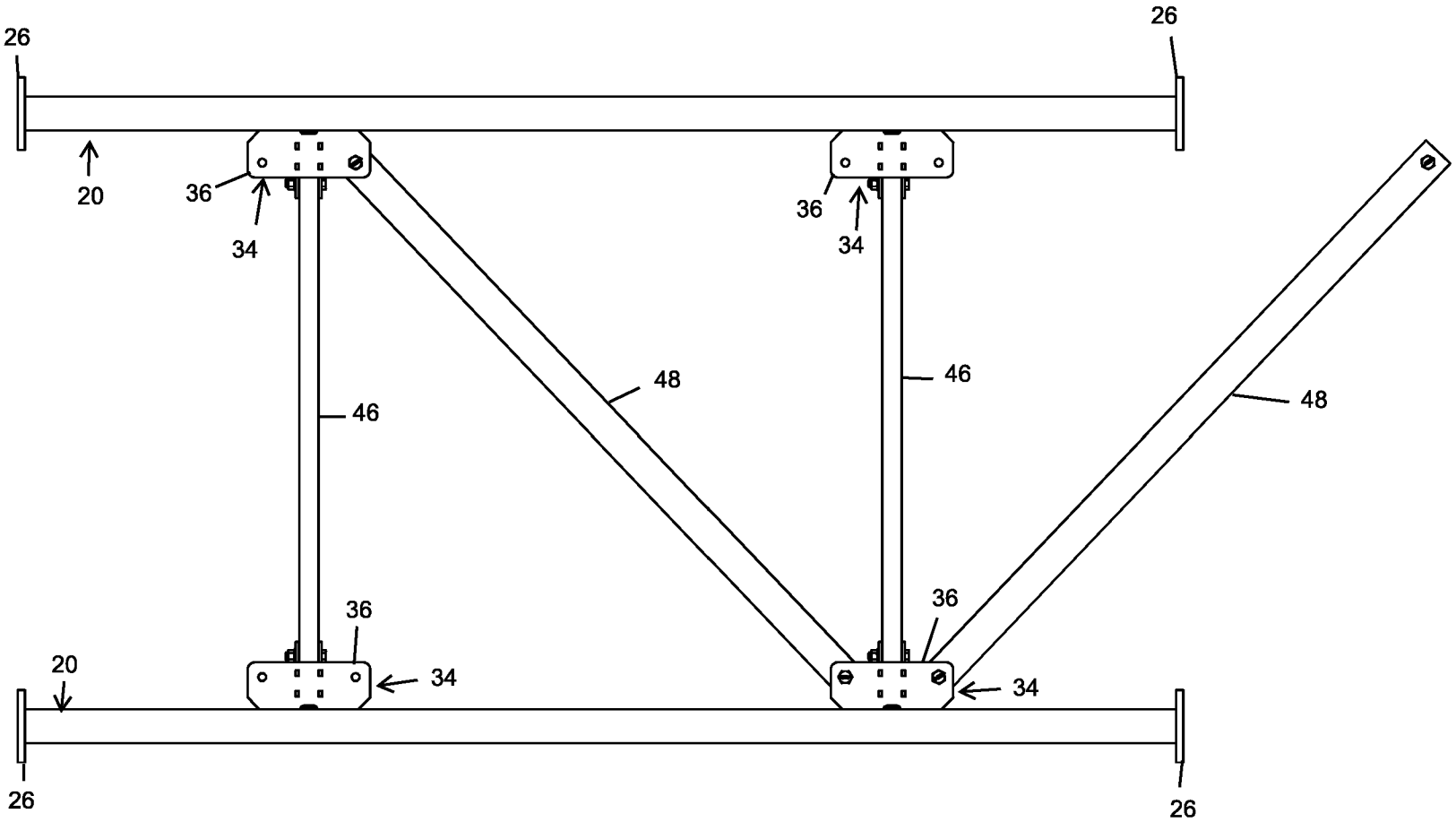
FIG. 18 is a bottom elevation view of a section of assembled catwalk.
Figure 19:
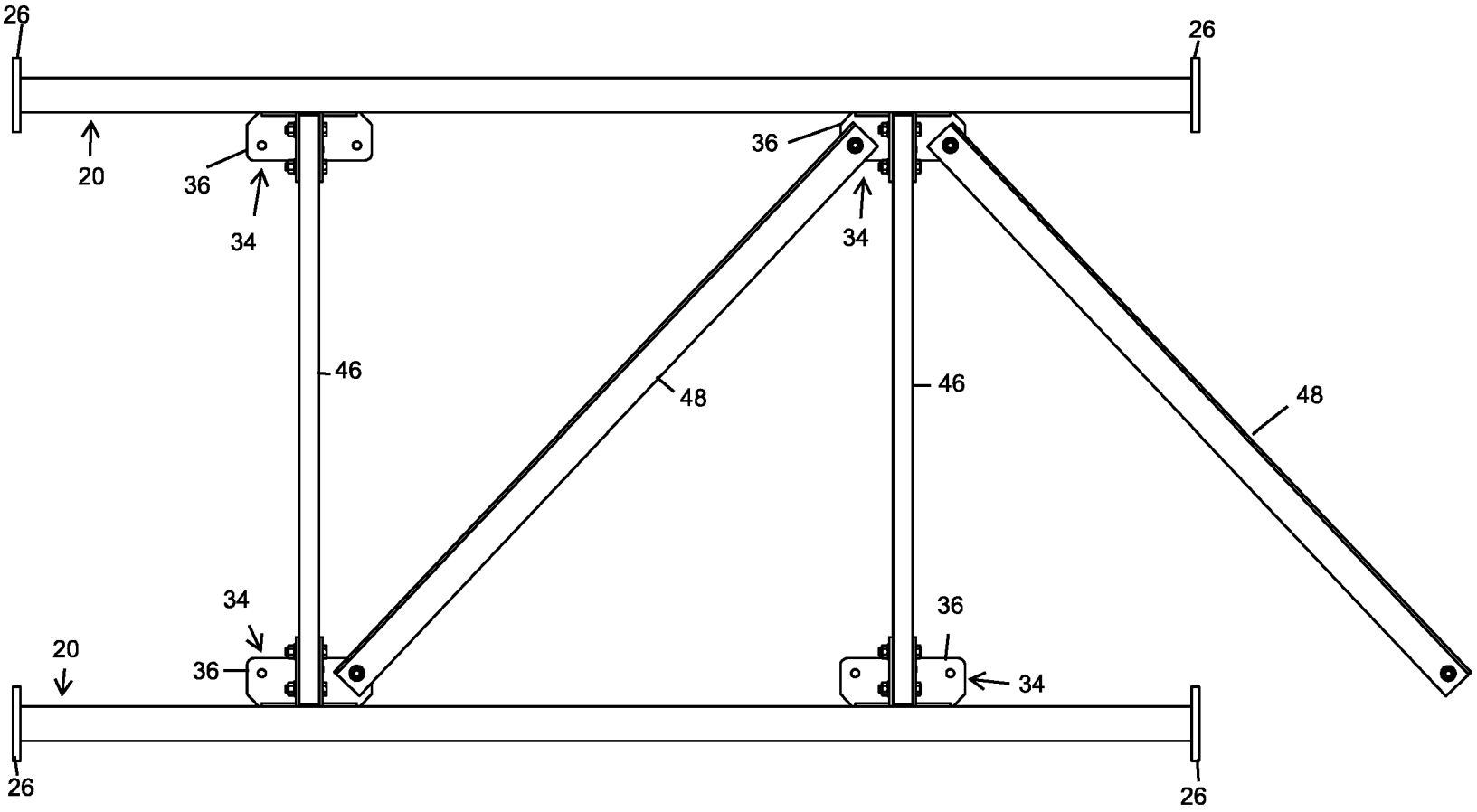
FIG. 19 is a top elevation view of a section of assembled catwalk.
Figure 20:
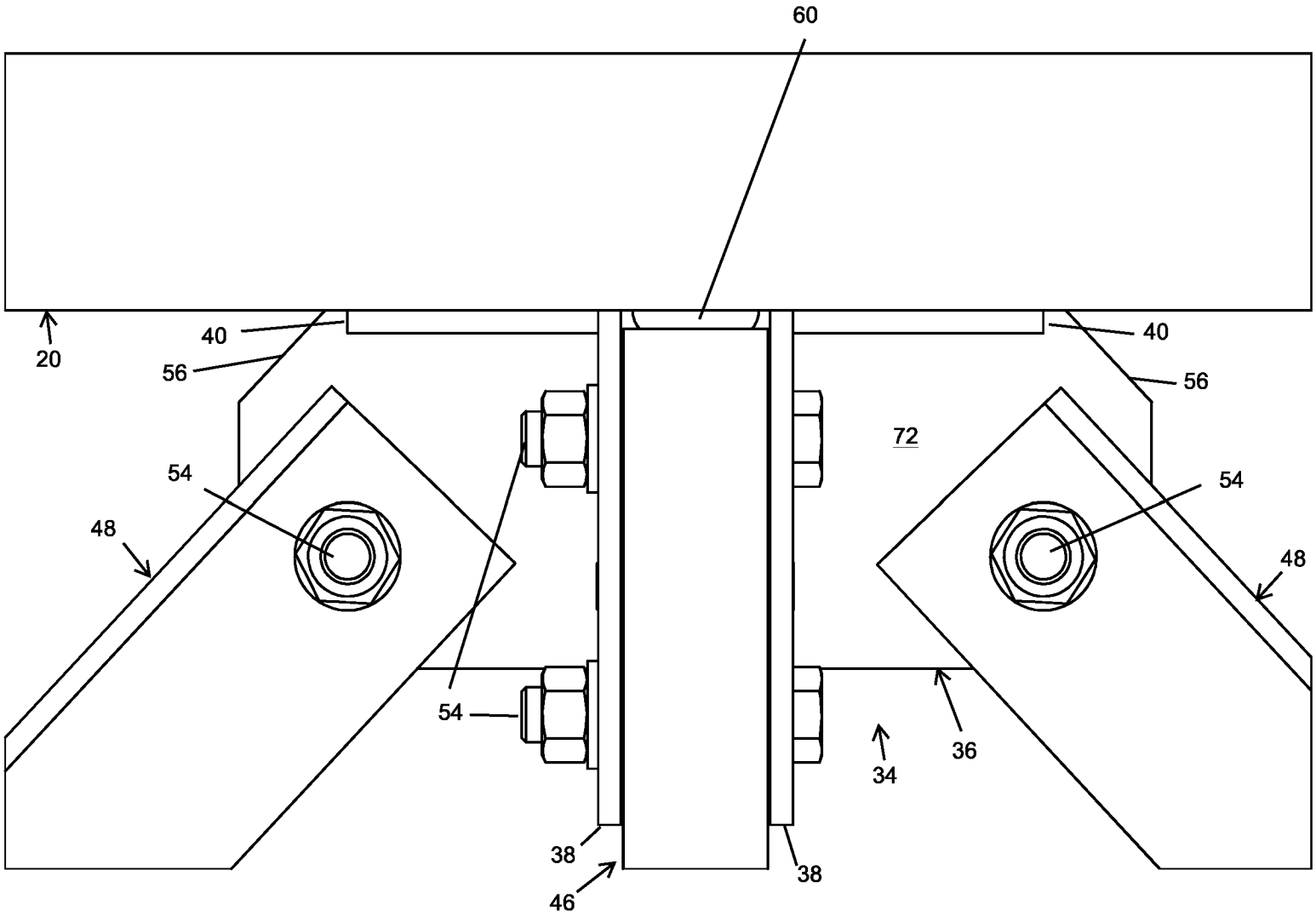
FIG. 20 is a close-up top elevation view of a joint connected to a bottom cord, the view showing the bottom plate connected to the bottom cord and a pair of side plates connected to the bottom plate that form a pocket; the view showing a floorbeam in place within the pocket and a pair of diagonal wind braces bolted to the bottom plate, the view also showing the relief in the pocket to facilitate drainage.
Figure 21:
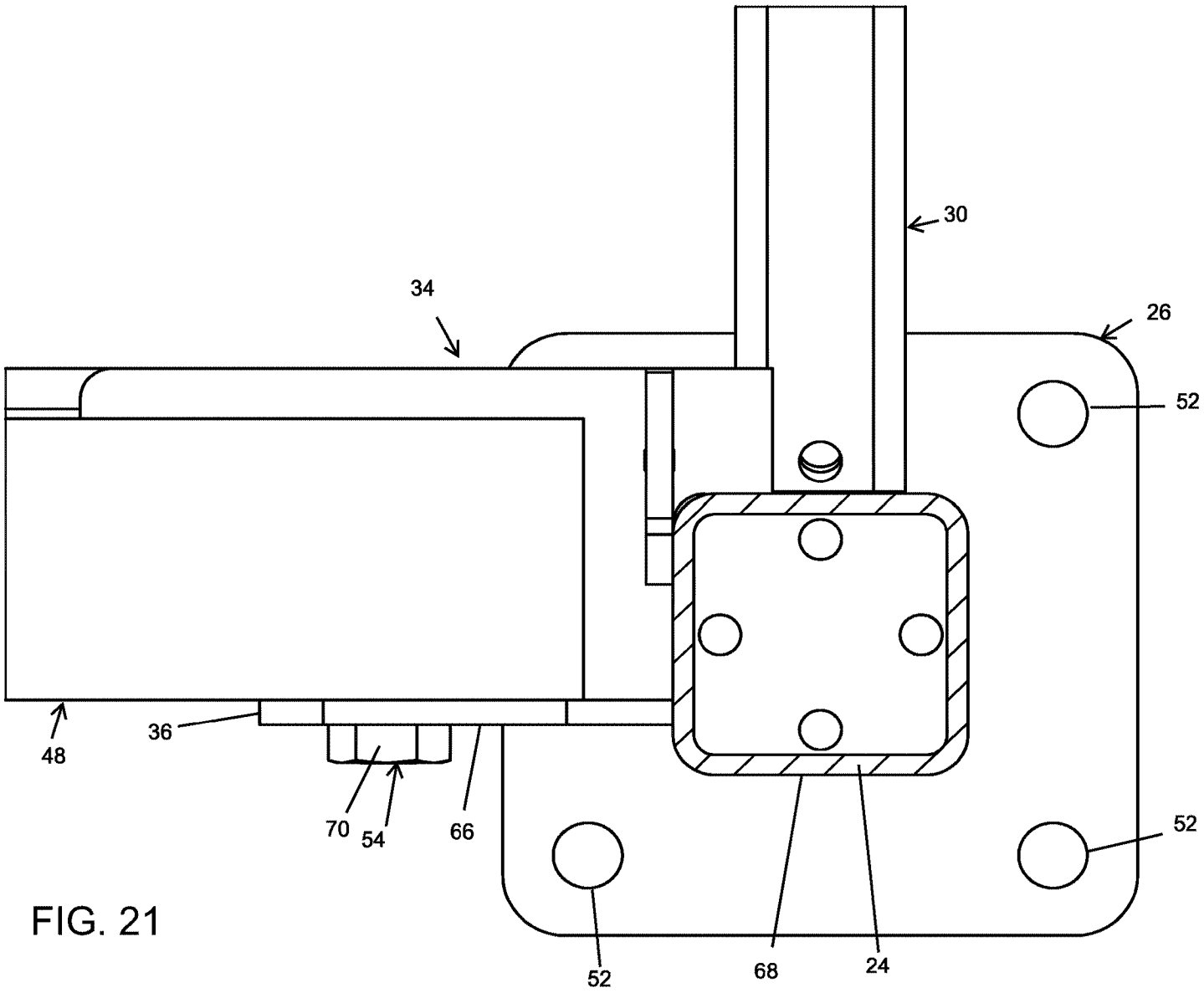
FIG. 21 is a close up side cut-away elevation view of a joint connected to the bottom cord, the view showing the bottom plate connected to the bottom cord, a side plate connected to the bottom plate; the view showing an end plate and a diagonal post connected to the bottom cord, the view showing a diagonal wind brace connected to the bottom plate.
Figure 22:
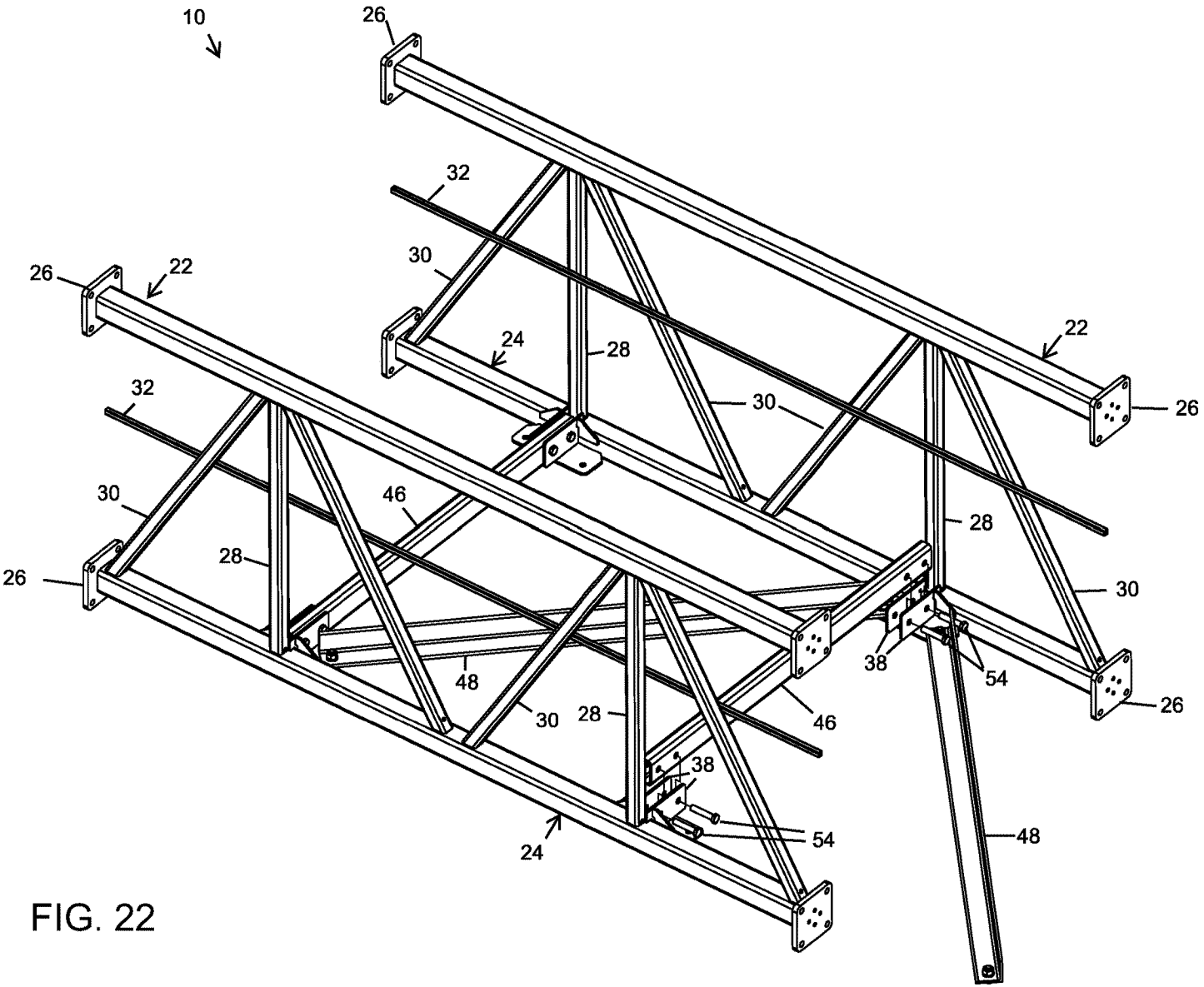
FIG. 22 is a perspective view of a section of assembled catwalk, the view showing a floorbeam aligned with and positioned just above a pair of pockets just prior to insertion into the opposing pockets of opposing joints; the view also showing bolts aligned with holes in the side plates of the joint, the bolts configured to affix the floorbeam to the side plates.
Figure 23:
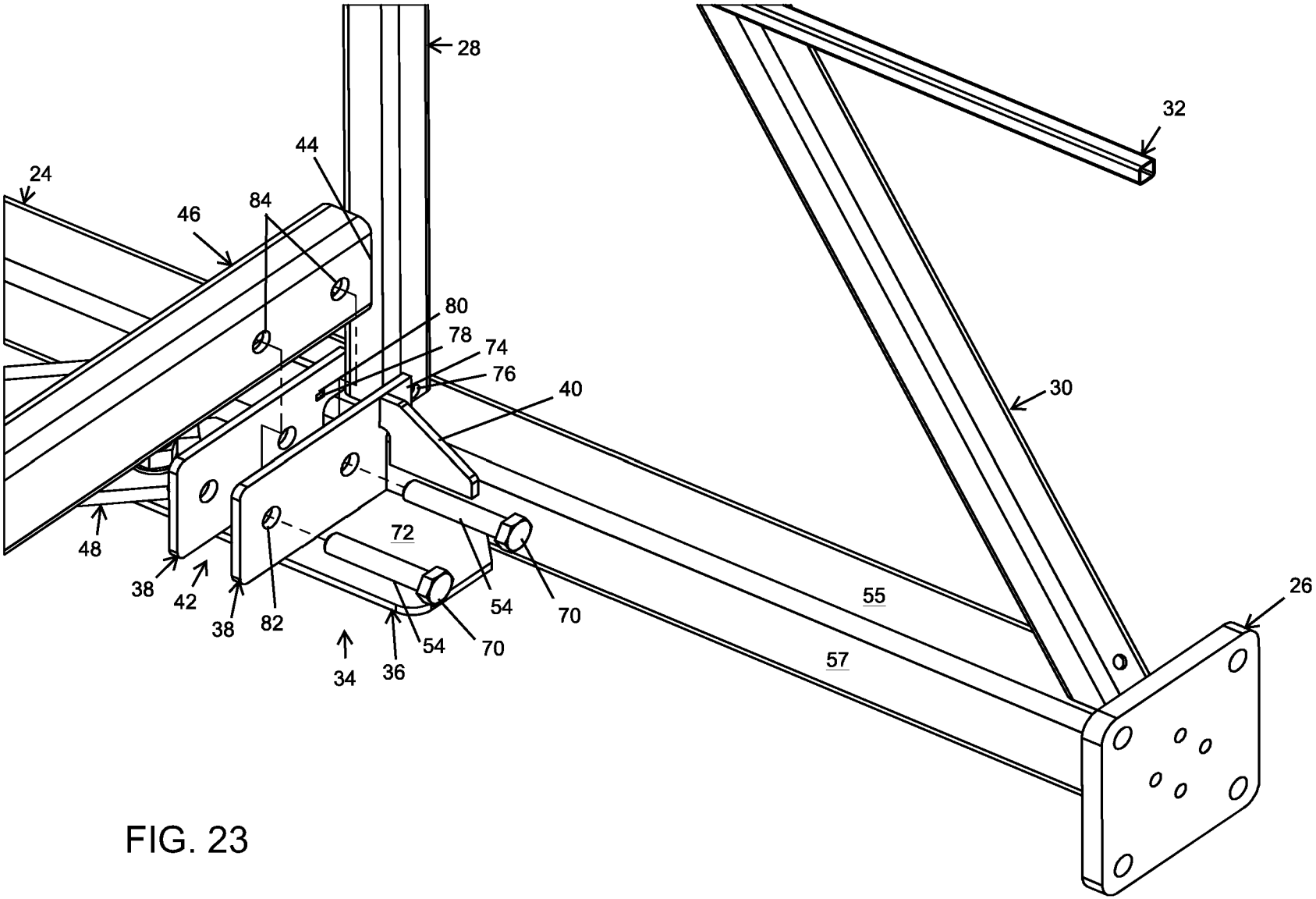
FIG. 23 is a close-up perspective view of a joint, the view showing a floorbeam aligned with and positioned just above a pocket just prior to insertion into the pocket of the joint; the view also showing bolts aligned with holes in the side plates of the joint, the bolts configured to affix the floorbeam to the side plates.
Figure 24:
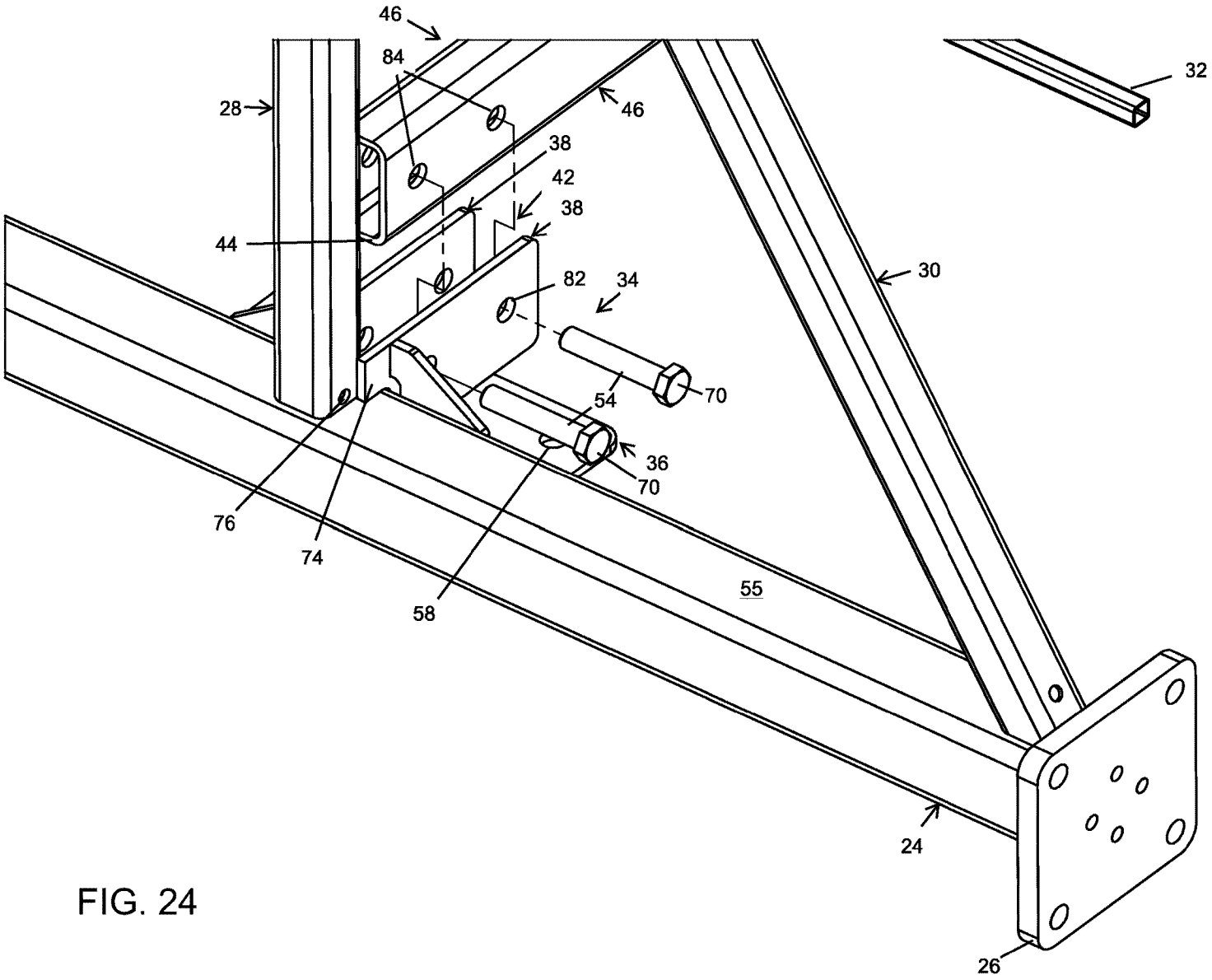
FIG. 24 is a close-up perspective view of a joint, the view showing a floorbeam aligned with and positioned just above a pocket just prior to insertion into the pocket of the joint; the view also showing bolts aligned with holes in the side plates of the joint, the bolts configured to affix the floorbeam to the side plates.
Figure 25:
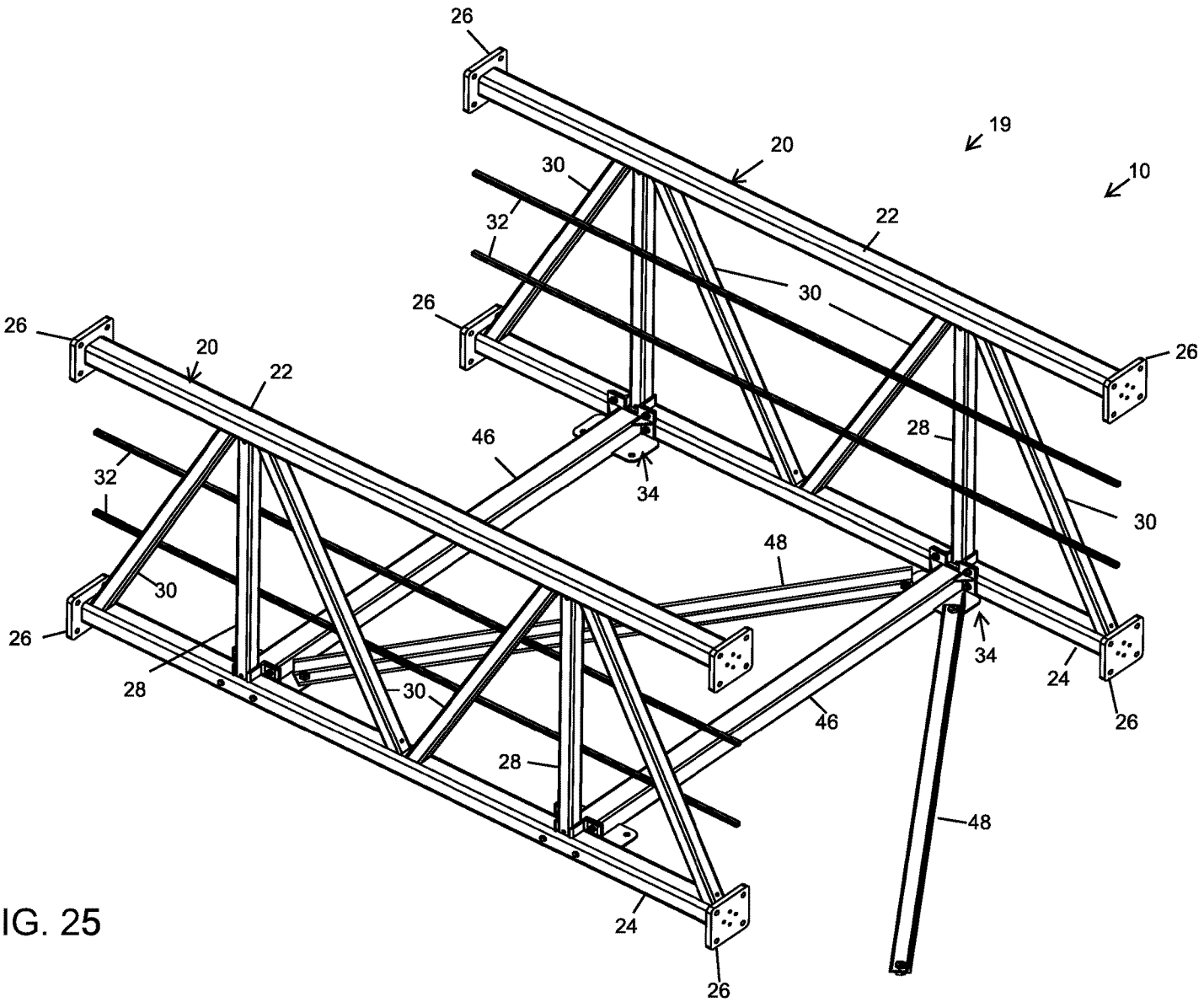
FIG. 25 is a perspective view of a section of assembled catwalk where the opposing side trusses are connected to one another using a side floorbeam connection system, the view showing a floorbeam aligned with and positioned just inward from vertical posts that extend between the bottom cord and top cord of a side truss.
Figure 26:
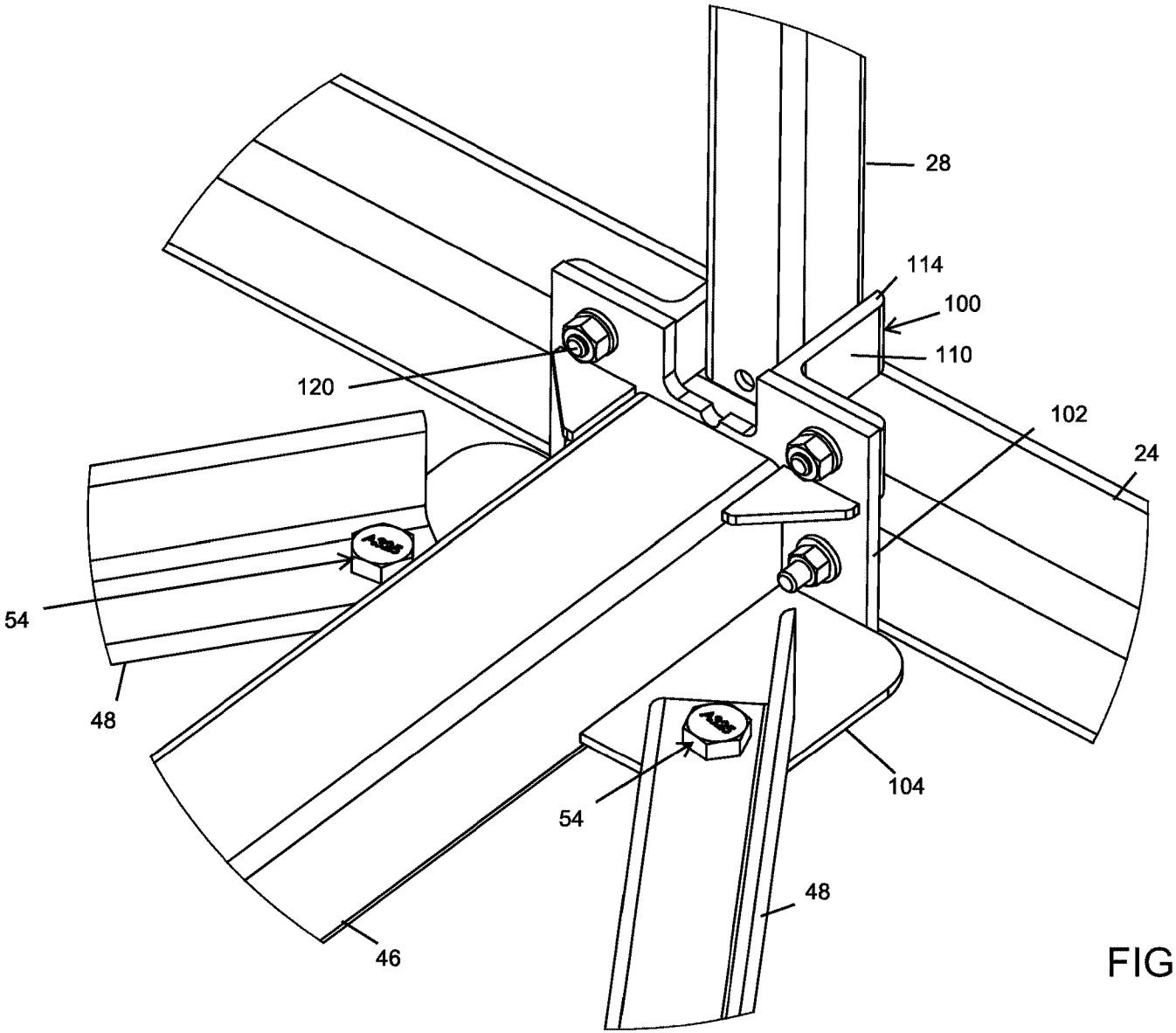
FIG. 26 is a close up perspective view of a side connection joint that connects floorbeams across opposing bottom cords of side trusses, the view showing a floorbeam having an end plate connected to the end of the floorbeam along with a pair of bottom plates and a pair of side supports; the view showing the end plate bolted to a pair of clip angles positioned outward of a vertical post; the view also showing the end plate bolted to the bottom cord of the side truss; the view showing diagonal wind braces connecting to bottom plates of the joints; the view showing side supports connected between the end of the floorbeam and the end plate.
Figure 27:
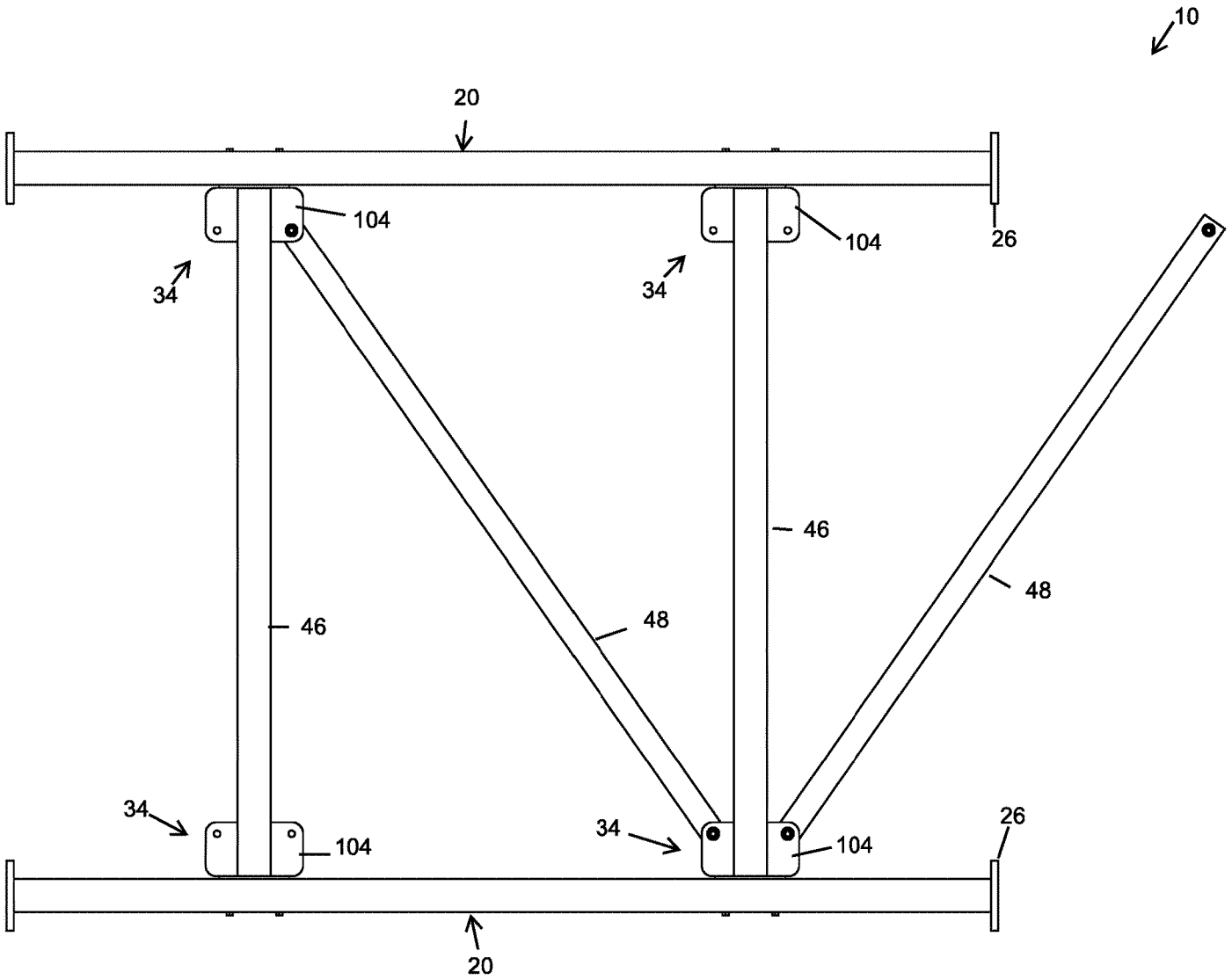
FIG. 27 is a bottom elevation view of a portion of a catwalk system having a side connection joint that connects floorbeams across opposing bottom cords of side trusses, the view showing a floorbeam having an end plate connected to the end of the floorbeam along with a pair of bottom plates; the view also showing the end plate bolted to the bottom cord of the side truss; the view showing diagonal wind braces connecting to bottom plates of the joints.
Figure 28:
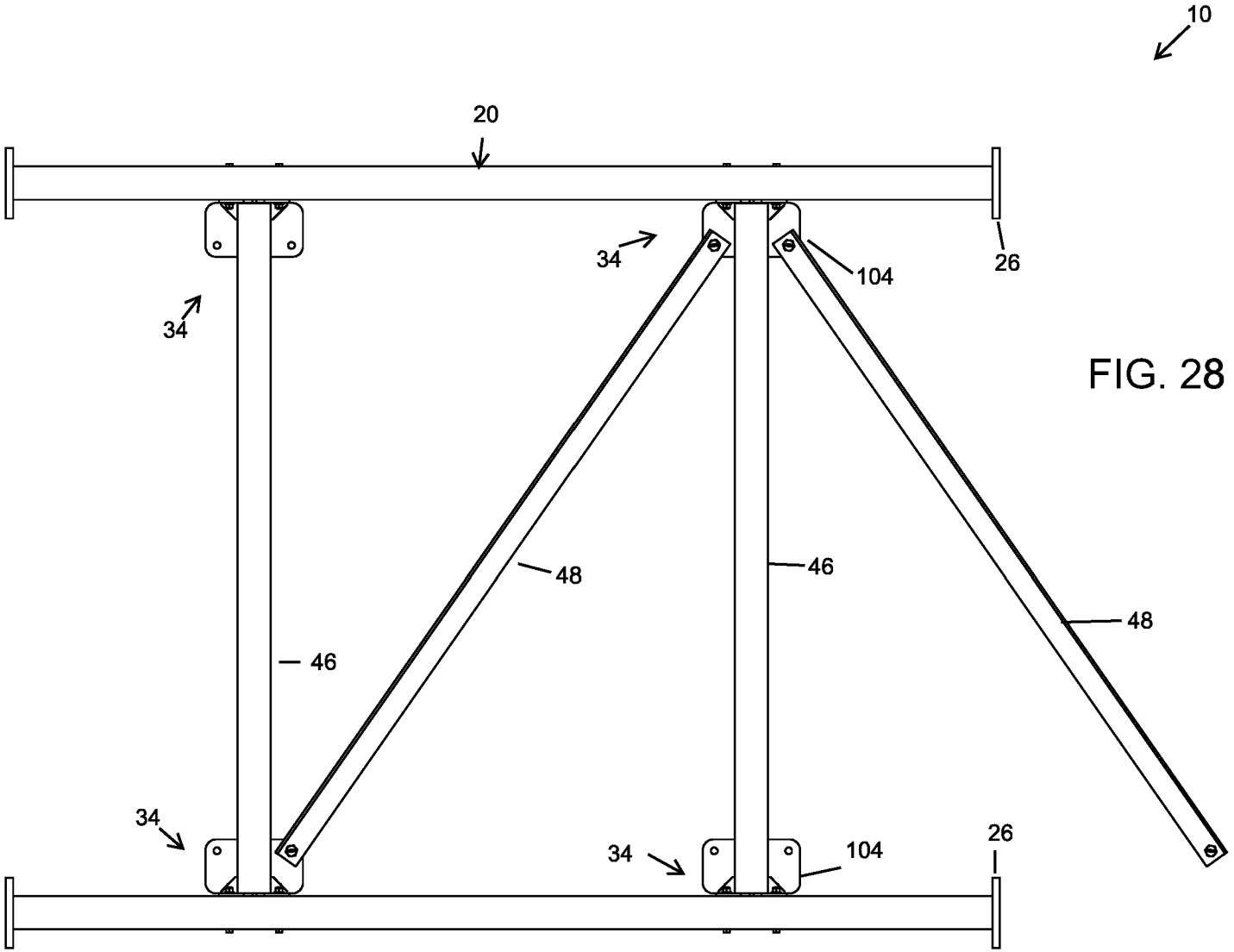
FIG. 28 is a top elevation view of a portion of a catwalk system having a side connection joint that connects floorbeams across opposing bottom cords of side trusses, the view showing a floorbeam having an end plate connected to the end of the floorbeam along with a pair of bottom plates; the view also showing the end plate bolted to the bottom cord of the side truss; the view showing diagonal wind braces connecting to bottom plates of the joints.
Figure 29:
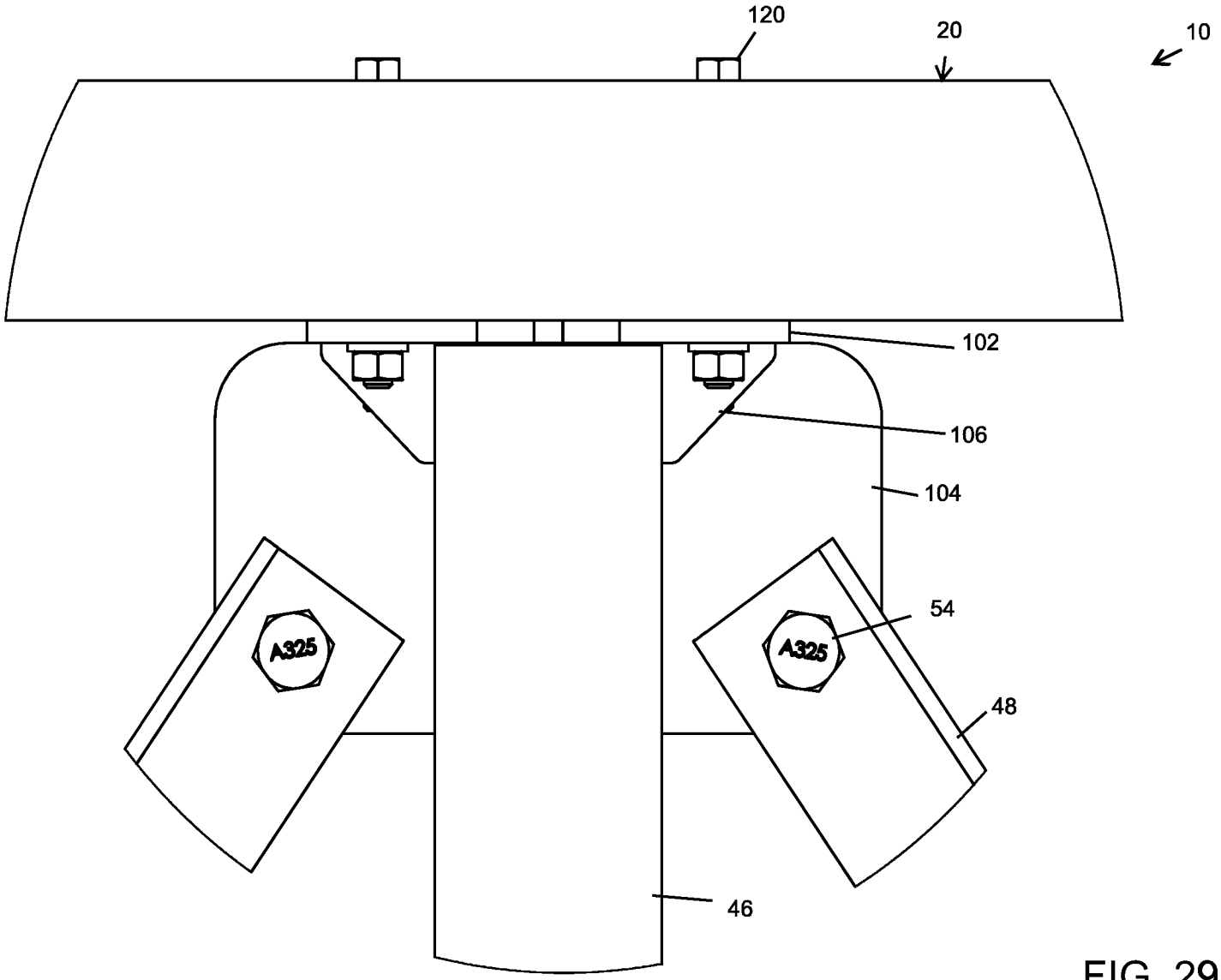
FIG. 29 is a close up top elevation view of a side connection joint that connects floorbeams across opposing bottom cords of side trusses, the view showing a floorbeam having an end plate connected to the end of the floorbeam along with a pair of bottom plates; the view also showing the end plate bolted to the bottom cord of the side truss; the view showing diagonal wind braces connecting to bottom plates of the joints; the view showing side supports connected between the end of the floorbeam and the end plate.
Figure 30:
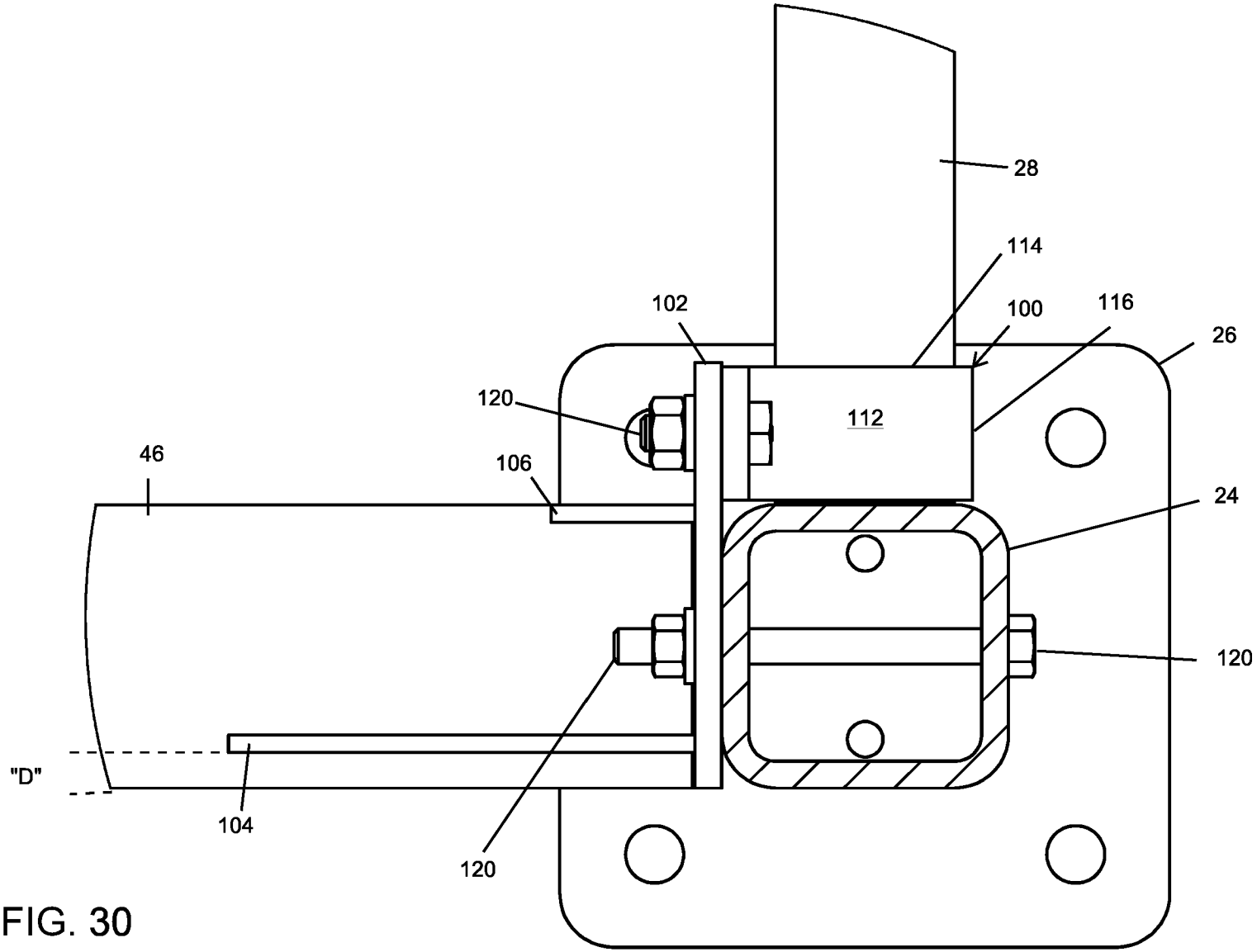
FIG. 30 is a close up side elevation view along the length of the catwalk, the view showing a side connection joint that connects floorbeams across opposing bottom cords of side trusses; the view showing a floorbeam having an end plate connected to the end of the floorbeam along with a bottom plate; the view also showing the end plate bolted to the bottom cord of the side truss; the view showing side supports connected between the end of the floorbeam and the end plate; the view showing a clip angle positioned at the intersection of the bottom cord and a vertical post; the view showing the end plate of the floorbeam bolted to the clip angle and through the bottom cord; the view showing the bottom surface of the bottom plate terminating a distance "D" above the lower surface of the floorbeam and the bottom cord to provide room for a fastener that connects diagonal wind brace to the bottom plate.
Figure 31:
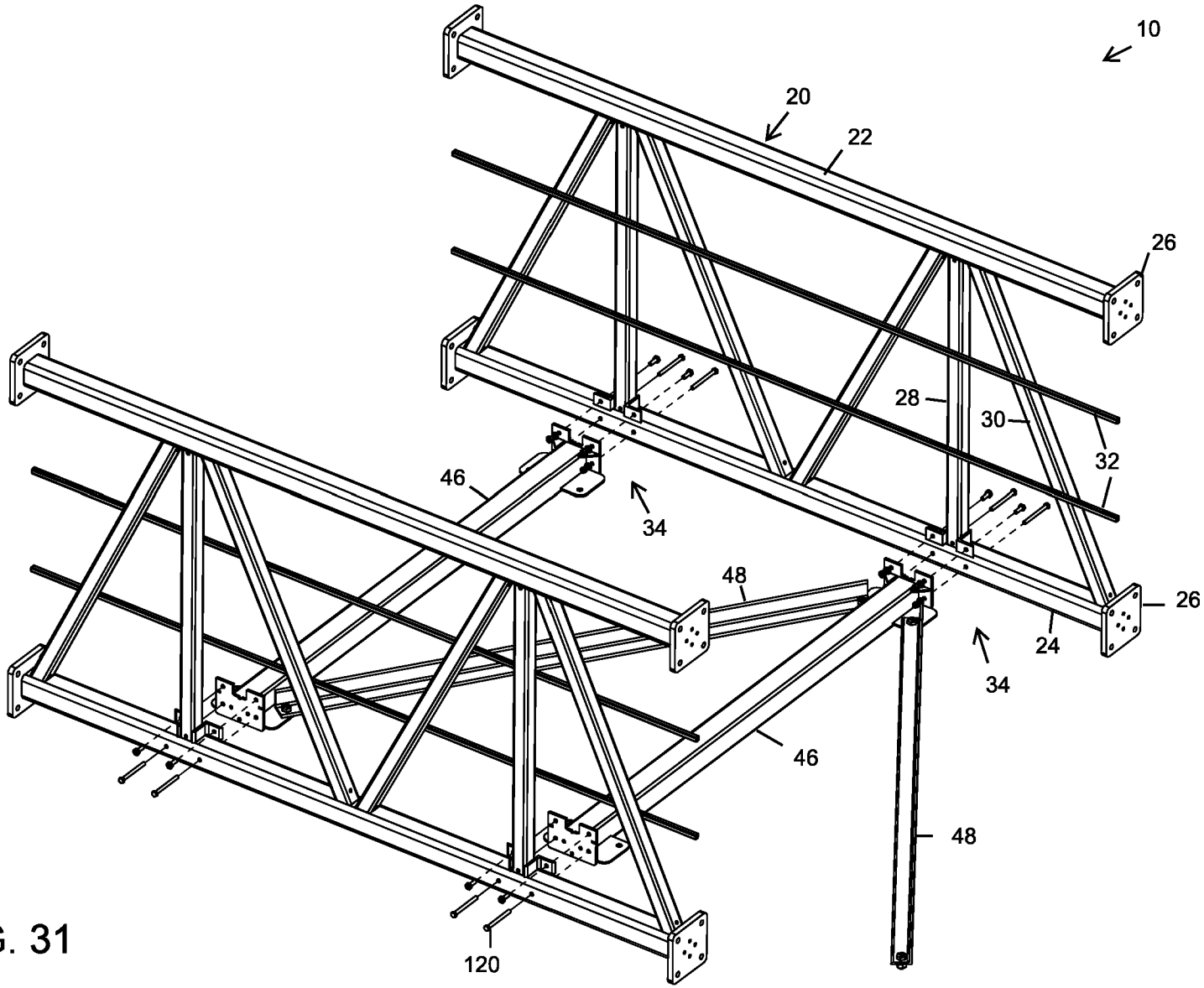
FIG. 31 is a perspective exploded view of a section of assembled catwalk where the opposing side trusses are connected to one another using a side floorbeam connection system, the view showing a floorbeam aligned with and positioned just inward from vertical posts that extend between the bottom cord and top cord of a side truss; the view showing the floorbeams in exploded form separated from the bottom cords of opposing side trusses.
Figure 32:
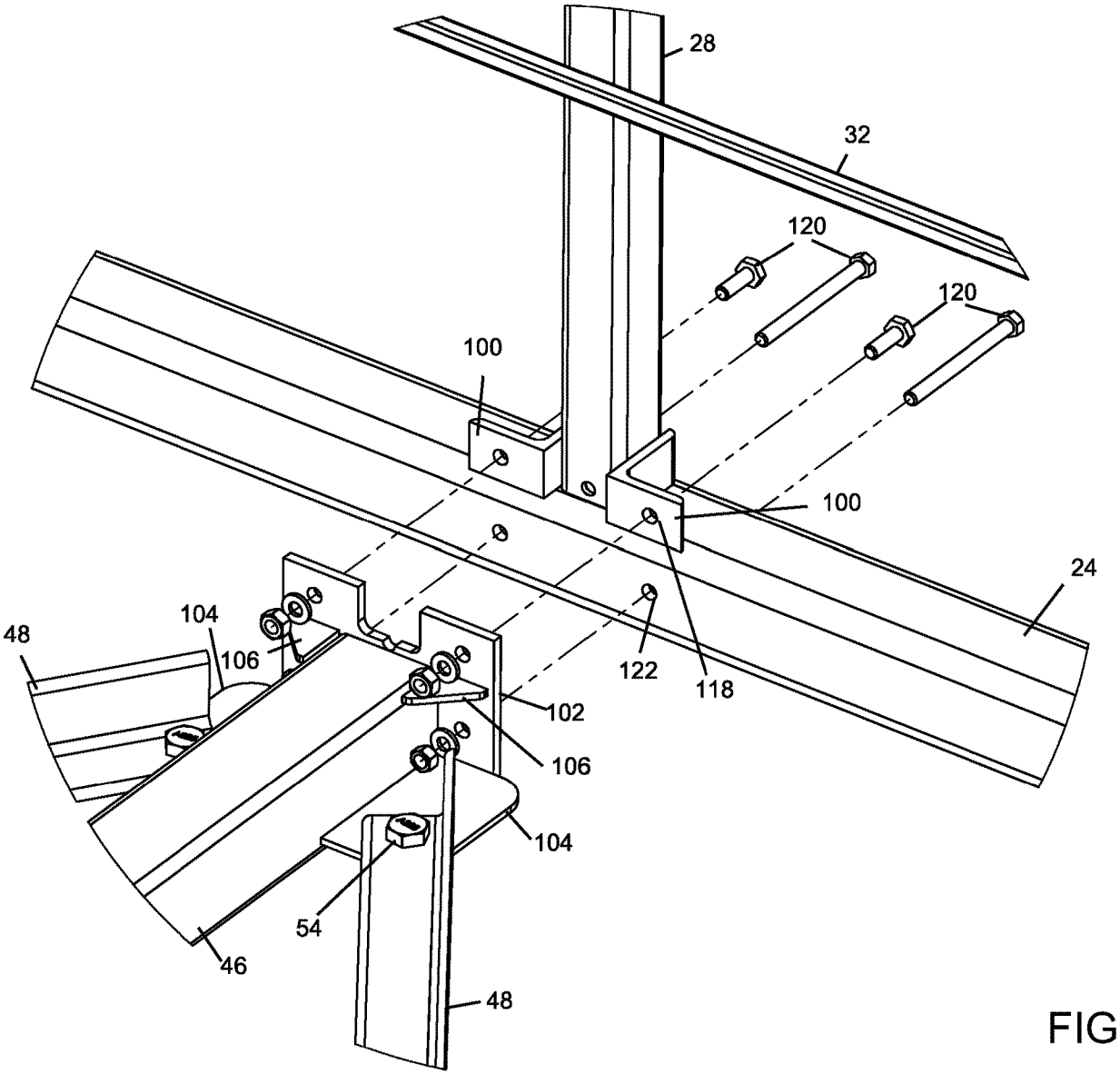
FIG. 32 is a close up perspective exploded view showing a side connection joint that connects floorbeams across opposing bottom cords of side trusses; the view showing a floorbeam having an end plate connected to the end of the floorbeam along with bottom plates and side supports; the view also showing the end plate about to be bolted to the bottom cord of the side truss; the view showing side supports connected between the end of the floorbeam and the end plate; the view showing a clip angle positioned at the intersection of the bottom cord and a vertical post; the view showing the end plate of the floorbeam about to be bolted to the clip angles and through the bottom cord.
Figure 33:
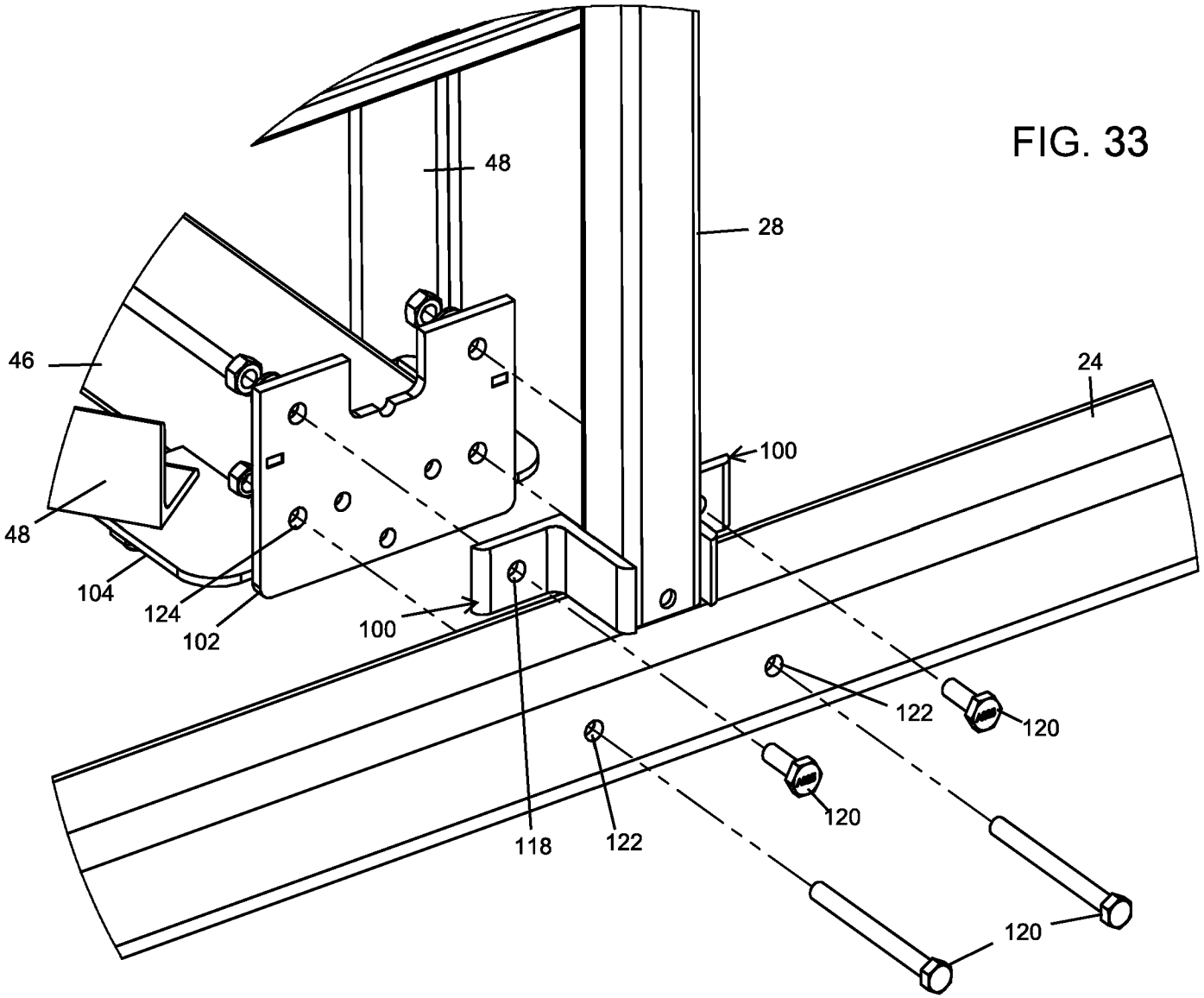
FIG. 33 is another perspective exploded view showing a side connection joint that connects floorbeams across opposing bottom cords of side trusses; the view showing a floorbeam having an end plate connected to the end of the floorbeam along with bottom plates; the view also showing the end plate about to be bolted to the bottom cord of the side truss; the view showing a pair of clip angles positioned at the intersection of the bottom cord and a vertical post; the view showing the end plate of the floorbeam about to be bolted to the clip angles and through the bottom cord.
Figure 34:
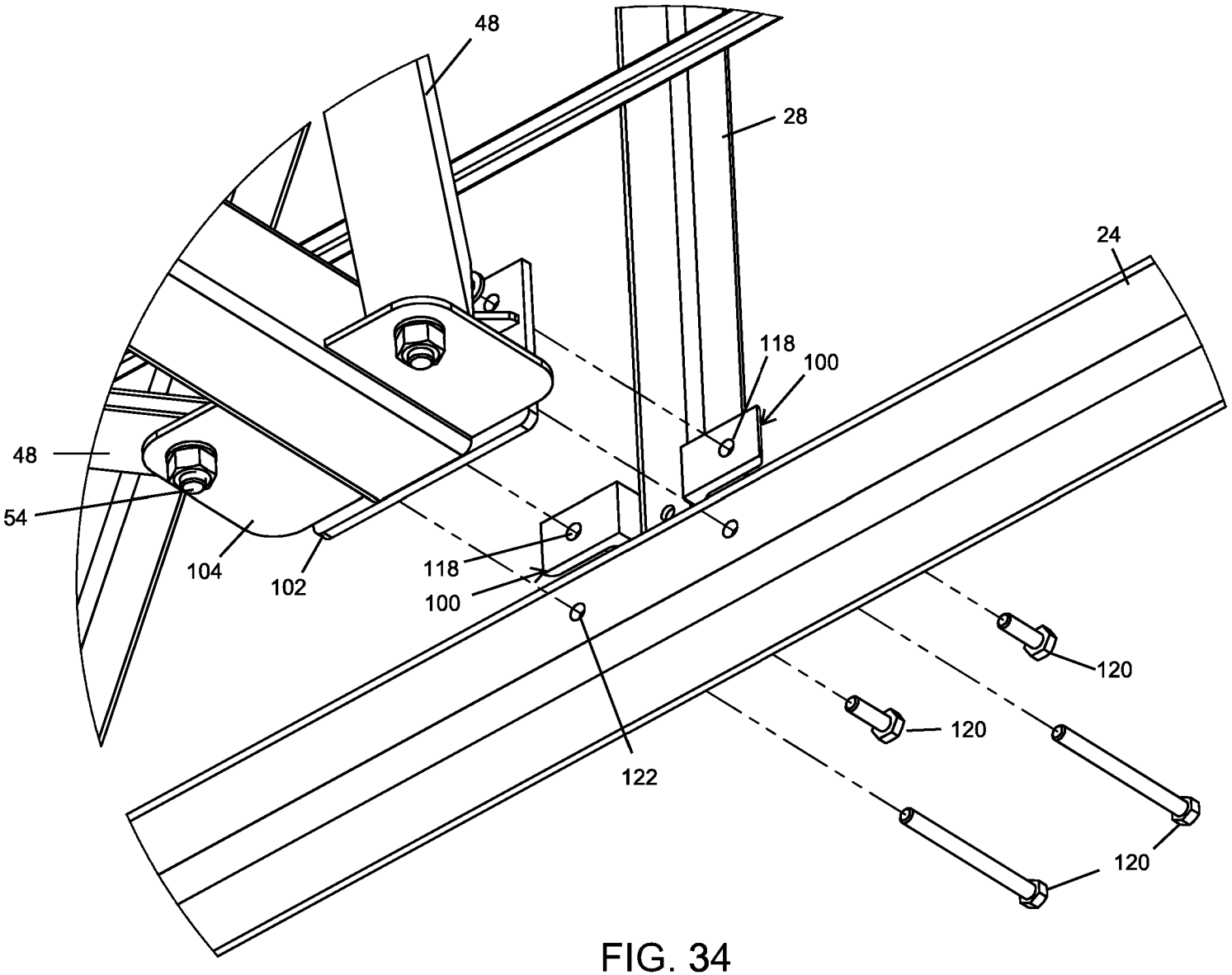
FIG. 34 is another perspective exploded view showing a side connection joint that connects floorbeams across opposing bottom cords of side trusses; the view showing a floorbeam having an end plate connected to the end of the floorbeam along with bottom plates; the view also showing the end plate about to be bolted to the bottom cord of the side truss; the view showing a pair of clip angles positioned at the intersection of the bottom cord and a vertical post; the view showing the end plate of the floorbeam about to be bolted to the clip angles and through the bottom cord.
Figure 35:
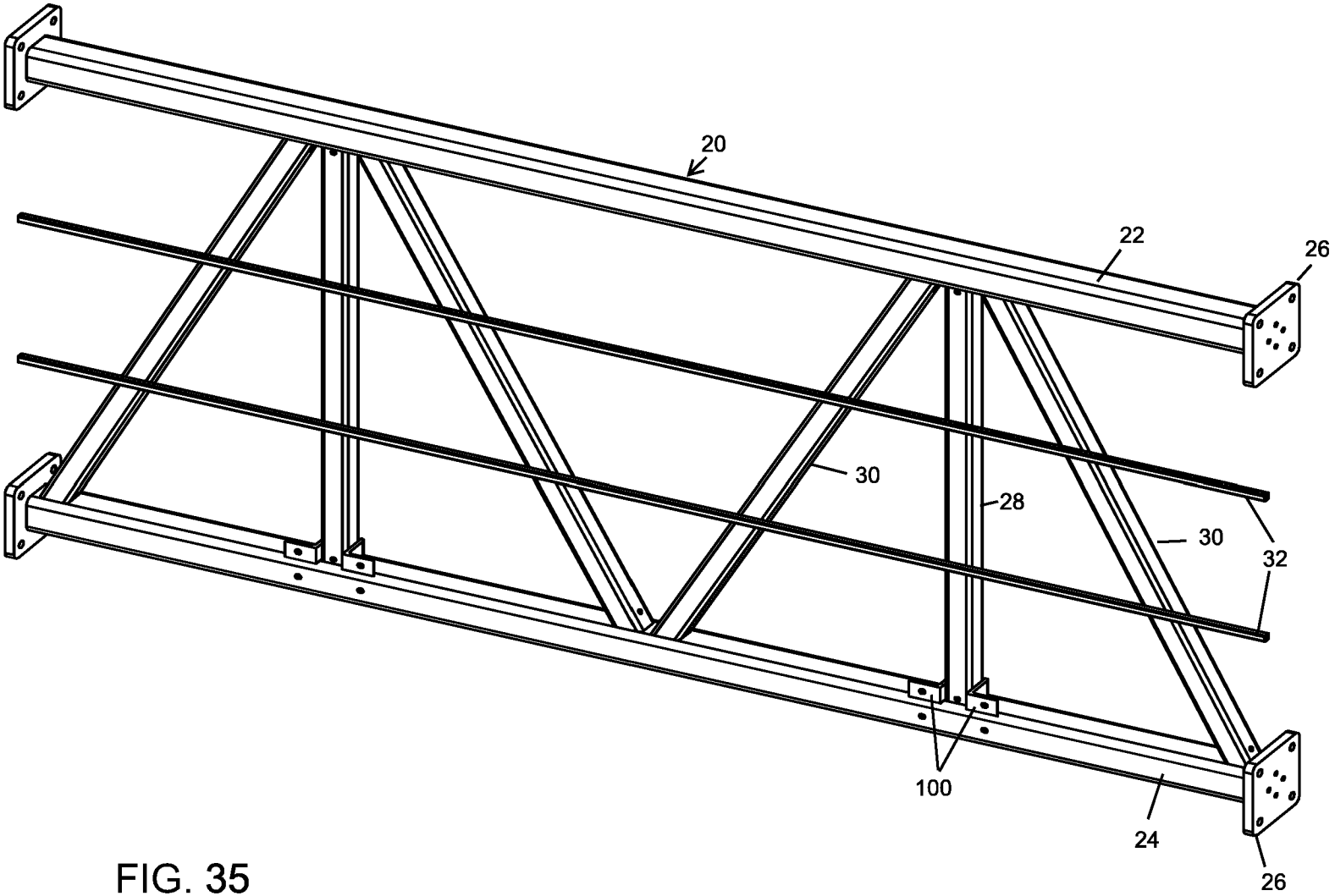
FIG. 35 is a perspective view of the interior surface of a side truss having a bottom cord and a top cord connected by a plurality of vertical posts and diagonal posts; the view also showing a side connection system that includes a pair of clip angles positioned at the lower end of the vertical posts.
Figure 36:
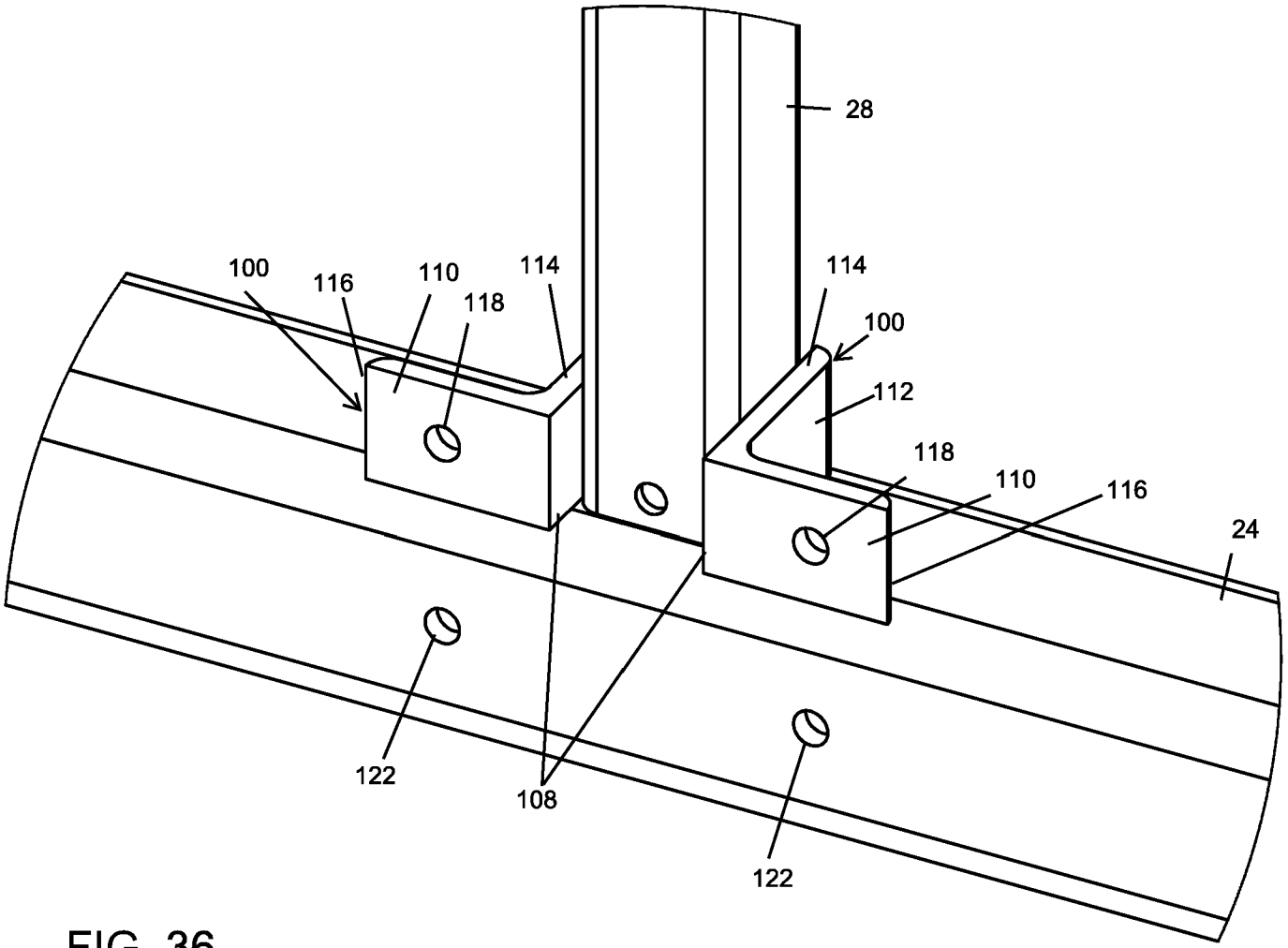
FIG. 36 is a close up perspective view of the interior surface of a side truss; the view showing a side connection system that includes a pair of clip angles positioned at the lower end of the vertical posts; the view showing holes in the clip angles as well as holes in the bottom cord that facilitate connection of the floorbeam to the side truss.
Figure 37:
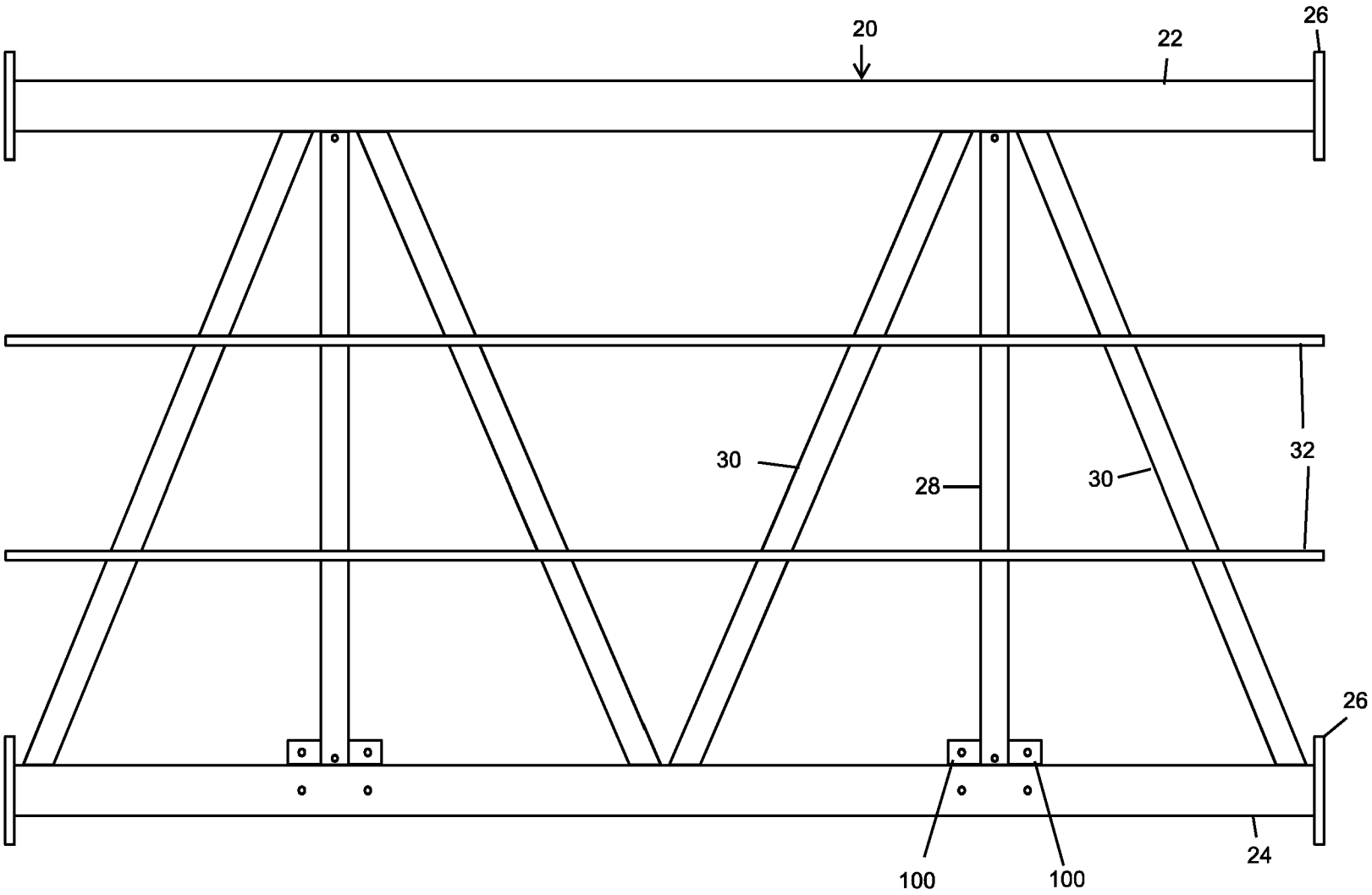
FIG. 37 is an elevation view of the interior surface of a side truss having a bottom cord and a top cord connected by a plurality of vertical posts and diagonal posts; the view also showing a side connection system that includes a pair of clip angles positioned at the lower end of the vertical posts.
Figure 38:
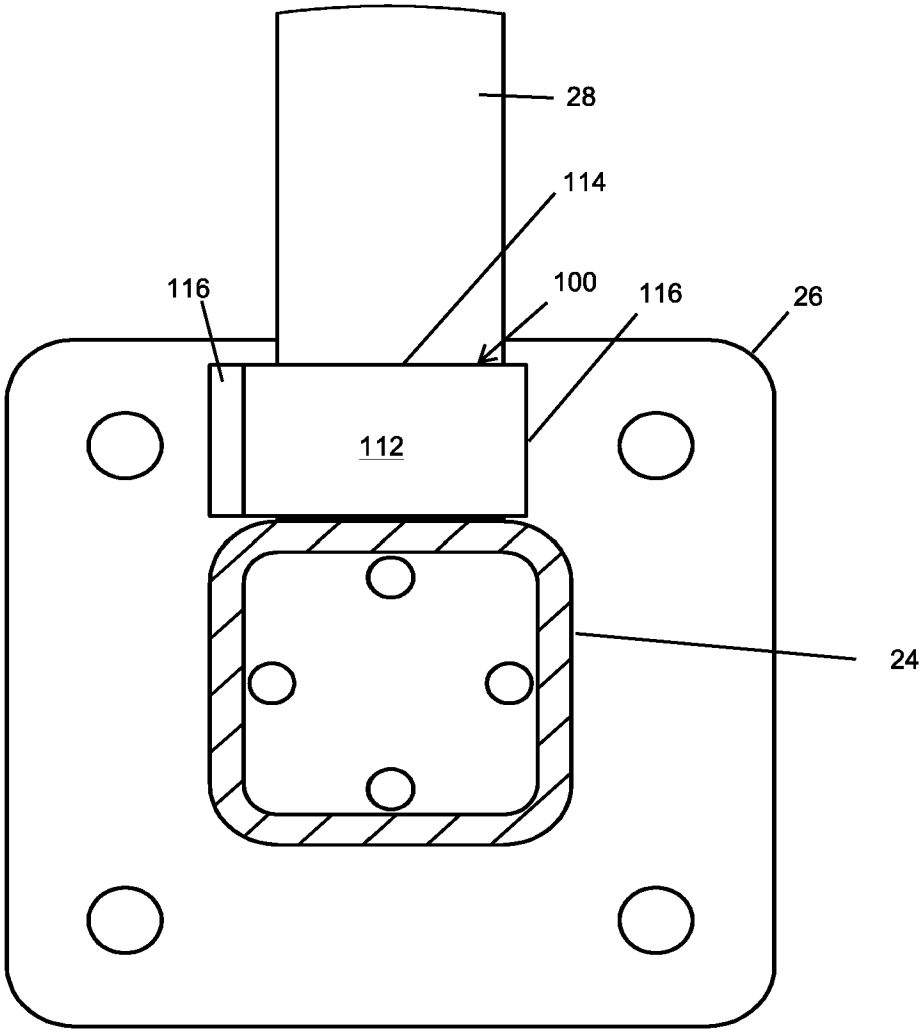
FIG. 38 is a close up elevation view along the length of the bottom cord, the view showing a side connection system that includes a pair of clip angles positioned at the lower end of the vertical posts; the view showing the interior surface of a side truss in alignment with the exterior facing surface of the clip angles so as to allow for flat engagement of an end plate.
Figure 39:
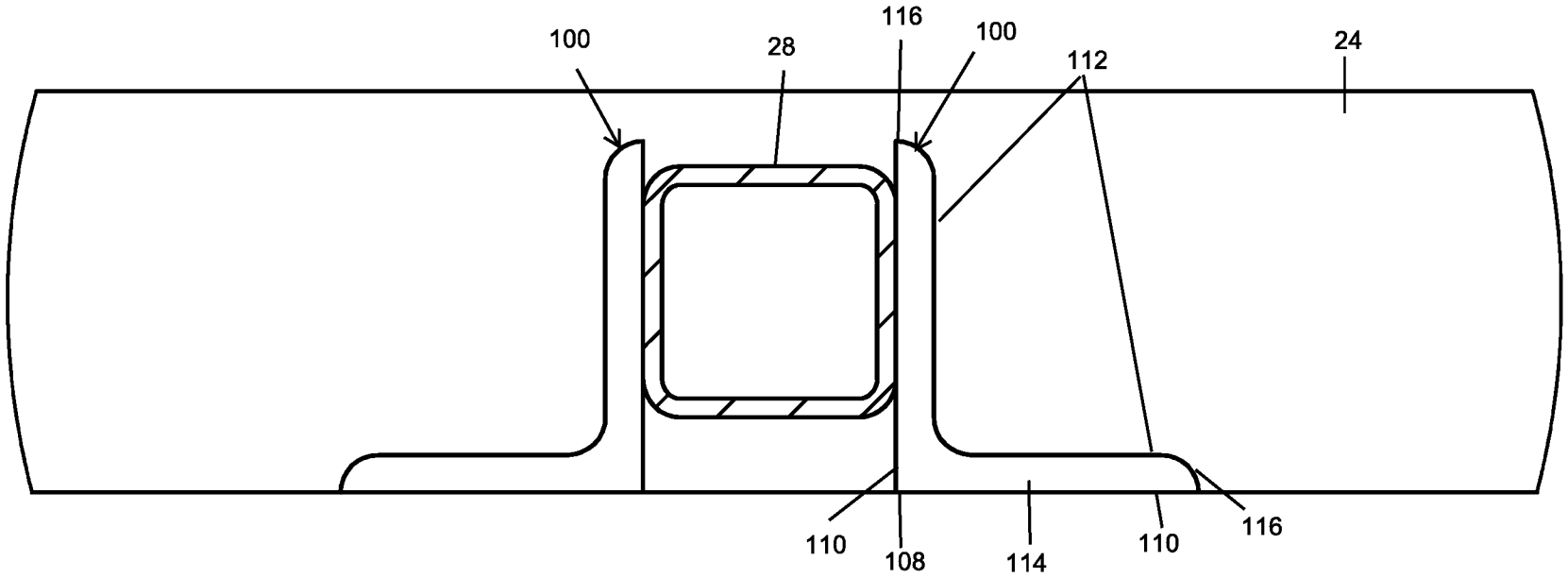
FIG. 39 is a close up top elevation view along the length of the center post, the view showing a side connection system that includes a pair of clip angles positioned at the lower end of the vertical post; the view showing the interior surface of a side truss in alignment with the exterior facing surface of the clip angles so as to allow for flat engagement of an end plate
Figure 40:
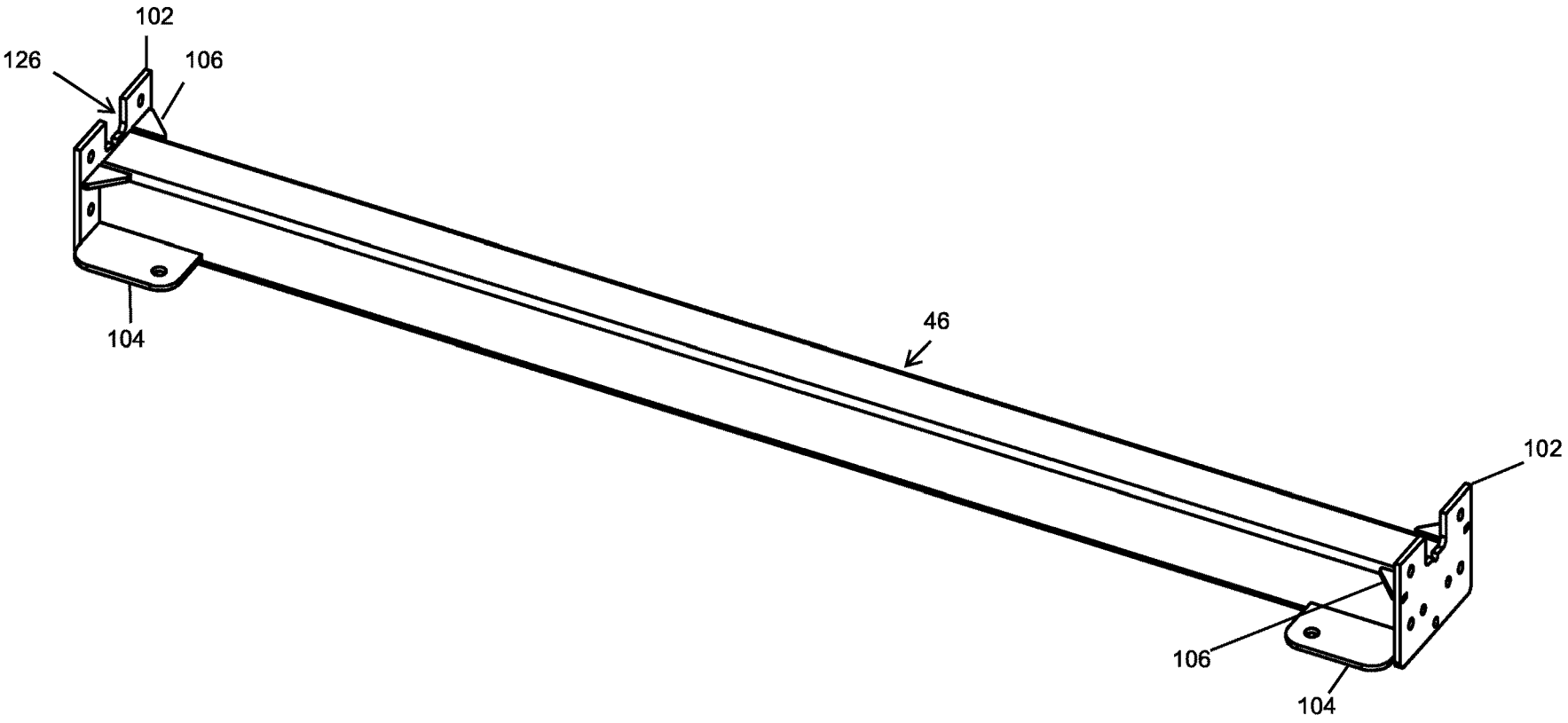
FIG. 40 is a perspective view of a floorbeam for use in the side connection system, the view showing the floorbeam formed of an elongated square or rectangular tube; the view showing an end plate connected to the ends of the floorbeam; the view showing a bottom plate and side support connected to and extending between the end plate and the end of the floorbeam.
Figure 41:
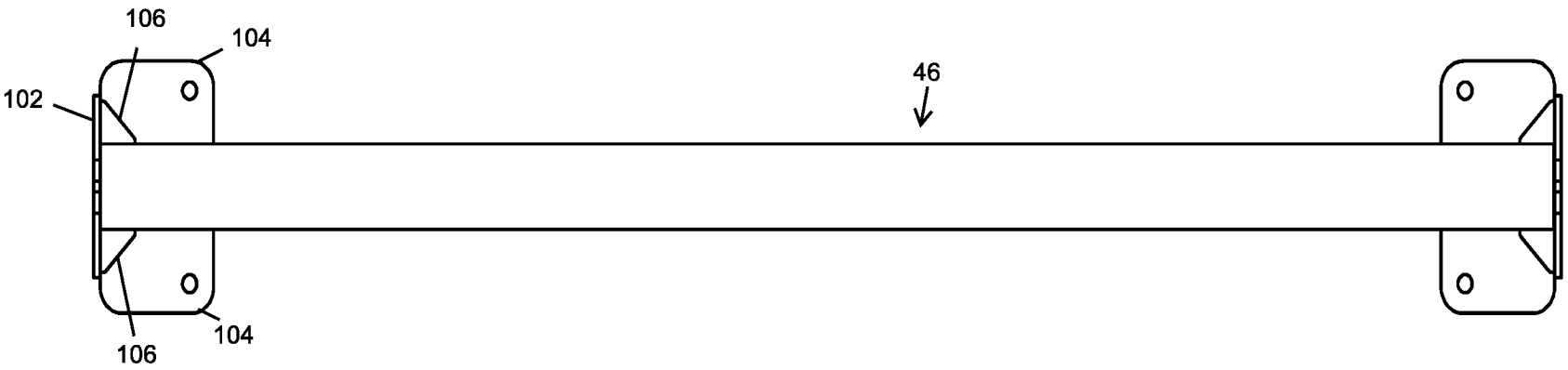
FIG. 41 is a top elevation view of the floor support shown in FIG. 40.
Figure 42:
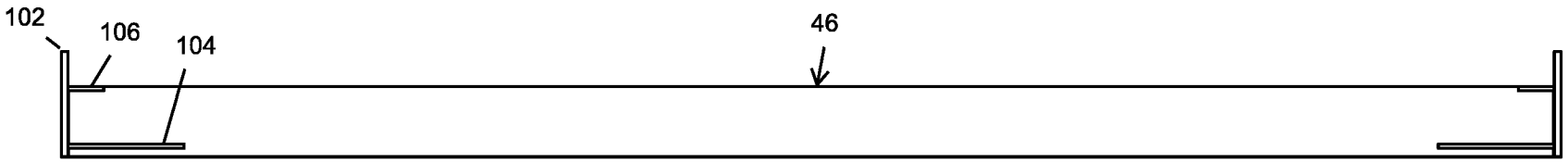
FIG. 42 is a side elevation view of the floor support shown in FIG. 41.
Figure 43:
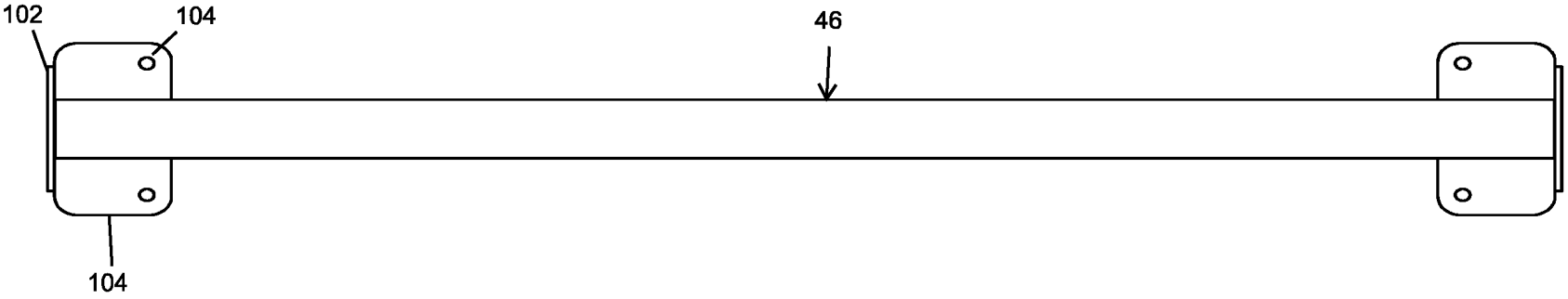
FIG. 43 is a bottom elevation view of the floor support shown in FIG. 42.
Figure 44:
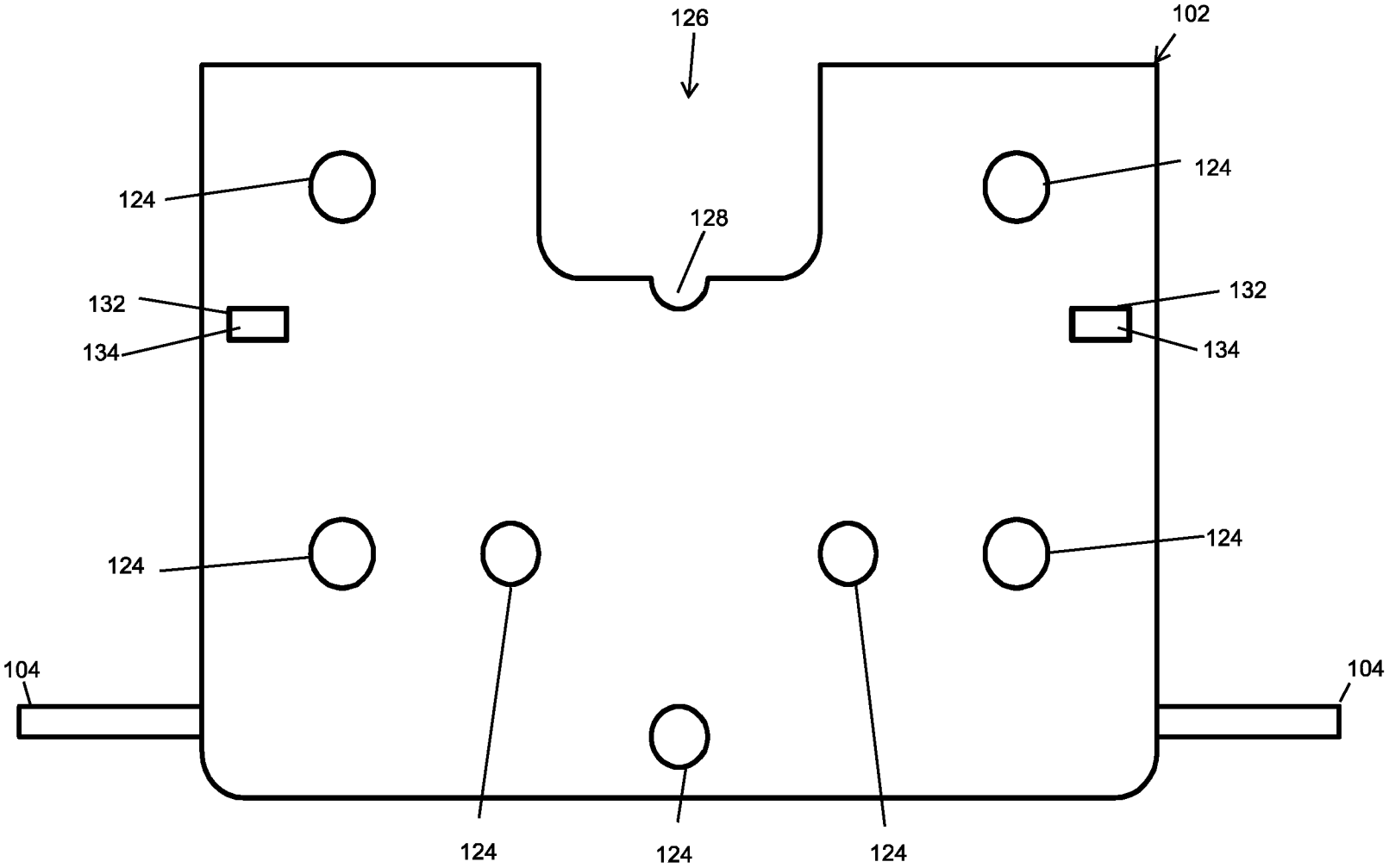
FIG. 44 is an elevation view of the end of the end plate of the floor support shown in FIG. 43; the view showing the recess and notch in the upper surface of the end plate the facilitates the drainage of water and debris.
Figure 45:
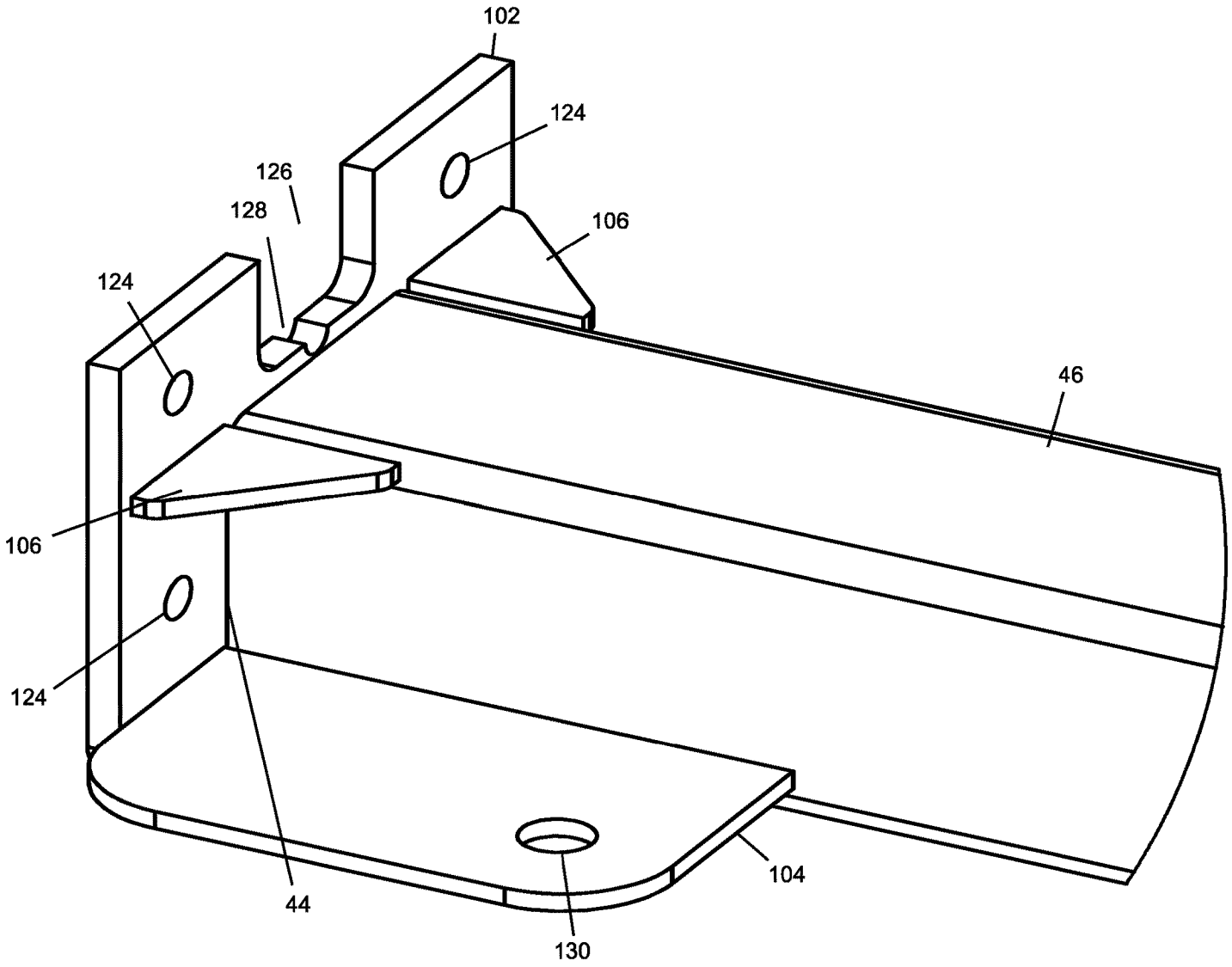
FIG. 45 is a perspective view of the end plate of the floor support shown in FIG. 44; the view showing the recess and notch in the upper surface of the end plate the facilitates the drainage of water and debris.
Figure 46:
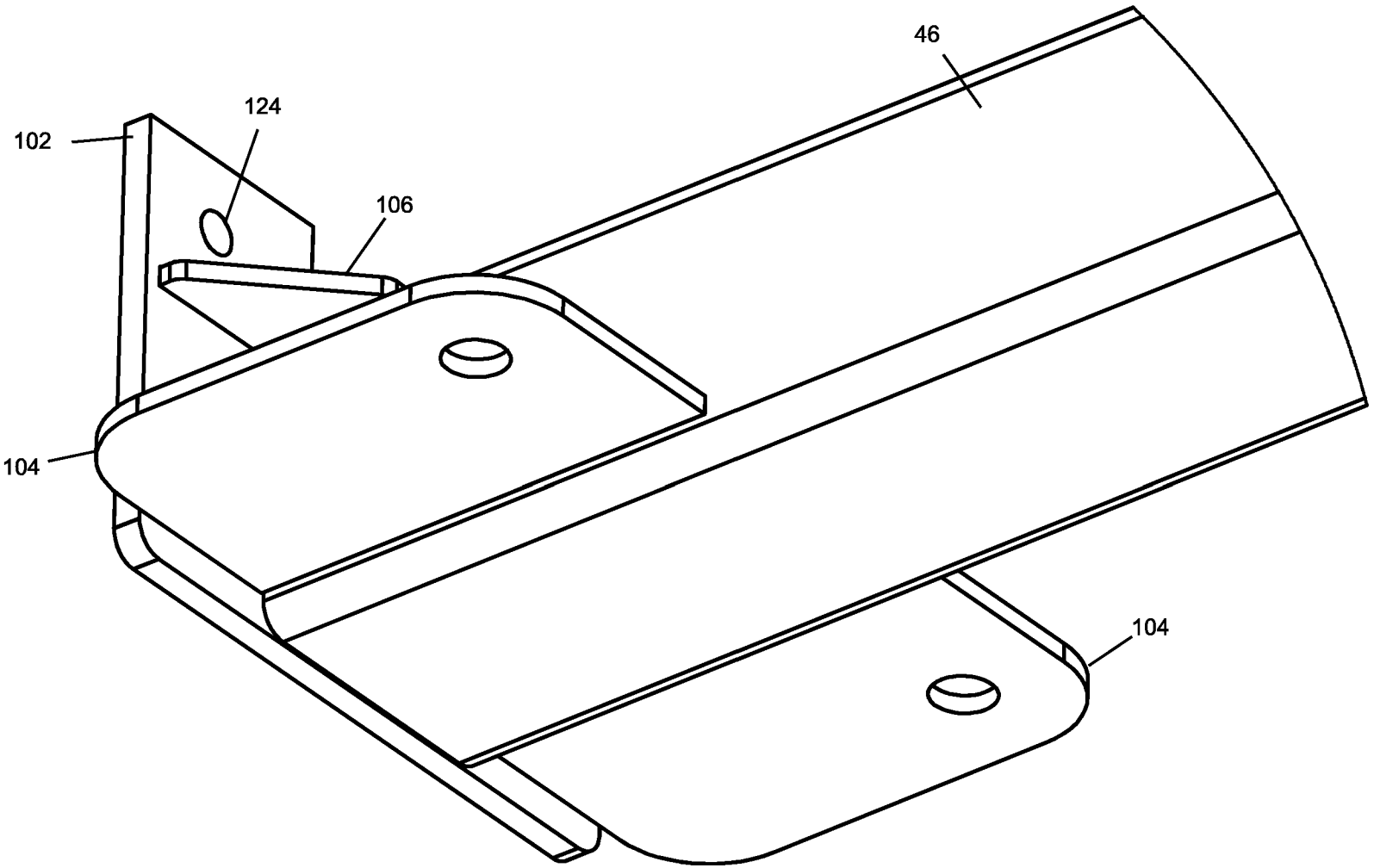
FIG. 46 is a perspective view of the end plate of the floor support shown in FIG. 45.
Figure 47:
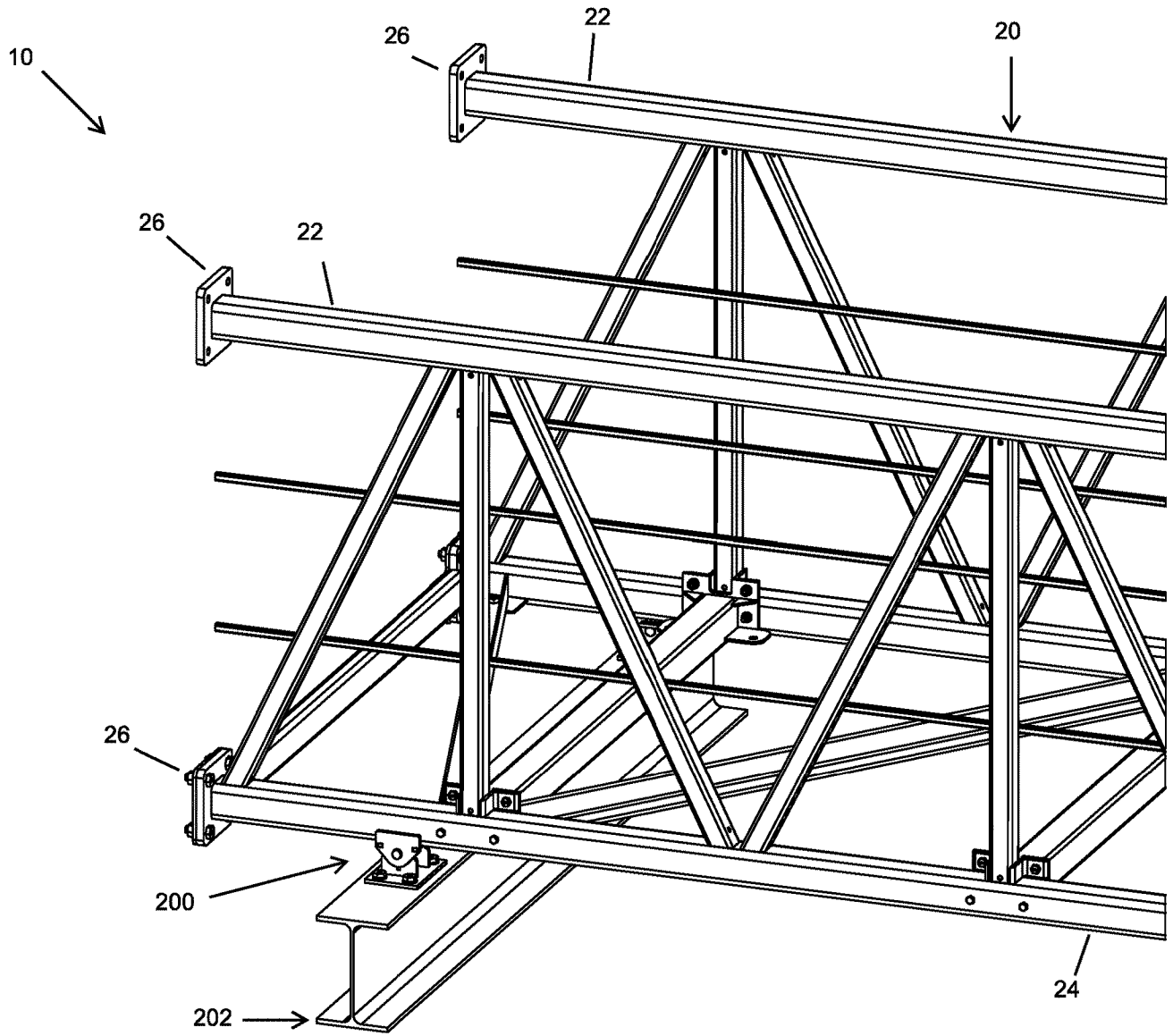
FIG. 47 is a top perspective view of a section of assembled catwalk where the opposing side trusses are connected to one another using a side floorbeam connection system, the view showing a floorbeam aligned with and positioned just inward from vertical posts that extend between the bottom cord and top cord of the side trusses; the view showing a support member, in the form of an I-beam, extending under the bottom cords of the side trusses; the view showing a rocker bearing attached to the upper surface of the support member; the view showing the rocker bearings formed of a bottom section and a top section that rotate with respect to one another; the view showing the bottom surface of the bottom section of the rocker bearings engaging the upper surface of the support member; the view showing the upper surface of the top section of the rocker bearings engaging the lower surface of the bottom cord of the side trusses.
Figure 48:
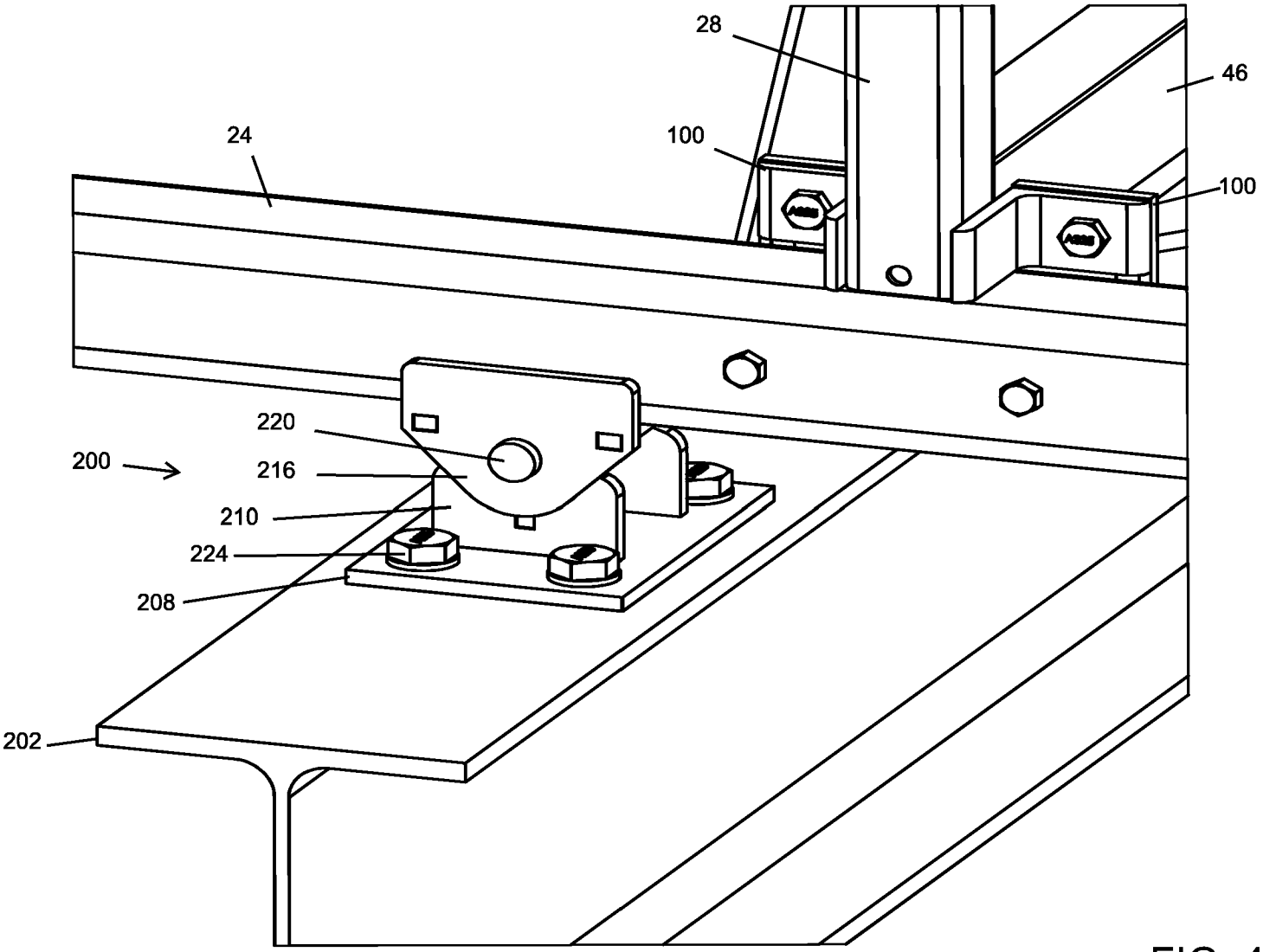
FIG. 48 is a close up top perspective view of the end of the support member and the forward positioned rocker bearing as shown in FIG. 47.
Figure 49:
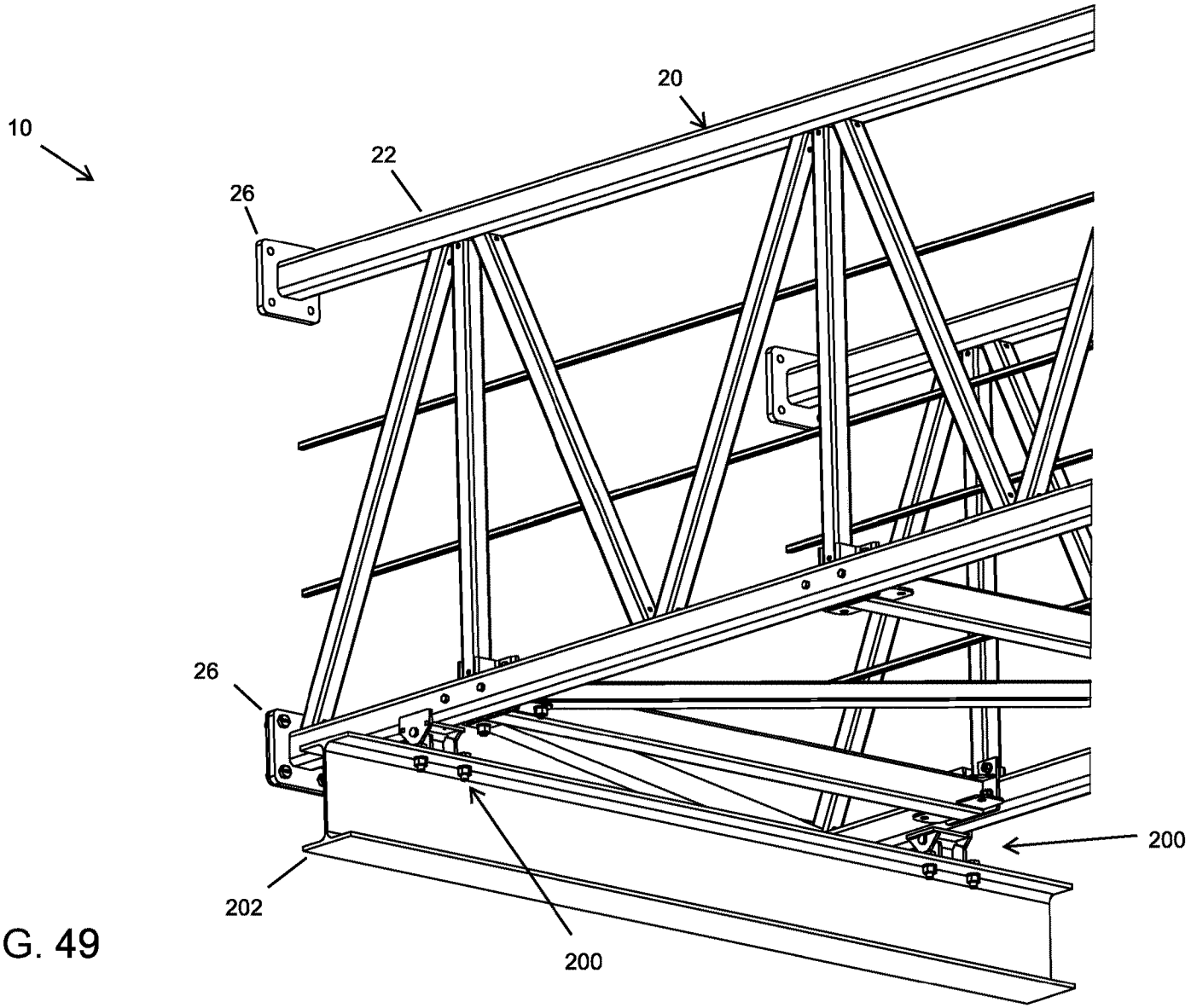
FIG. 49 is a bottom perspective view of the section of assembled catwalk and rocker bearing system and support member shown in FIG. 47.
Figure 50:
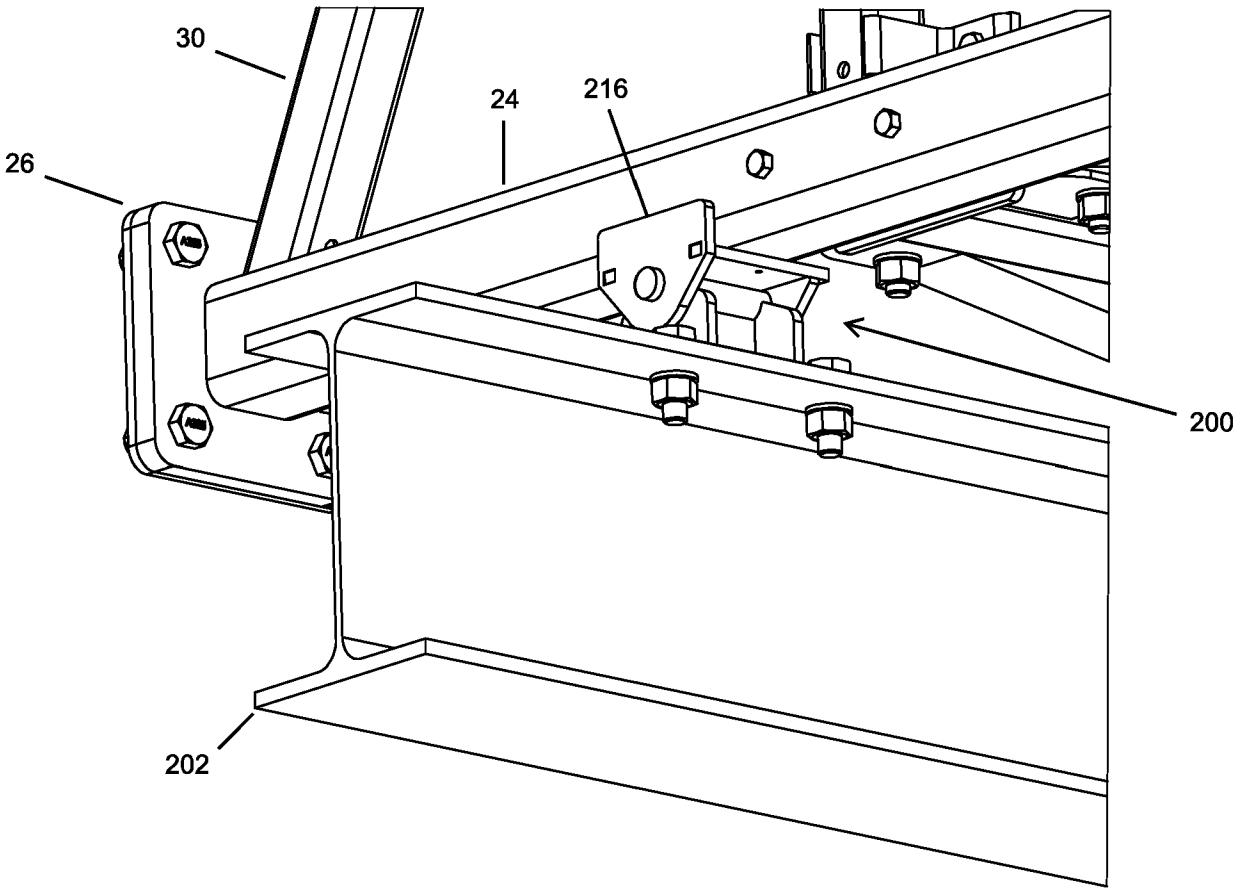
FIG. 50 is a close up bottom perspective view of the end of the support member and the forward positioned rocker bearing as shown in FIG. 49.
Figure 51:
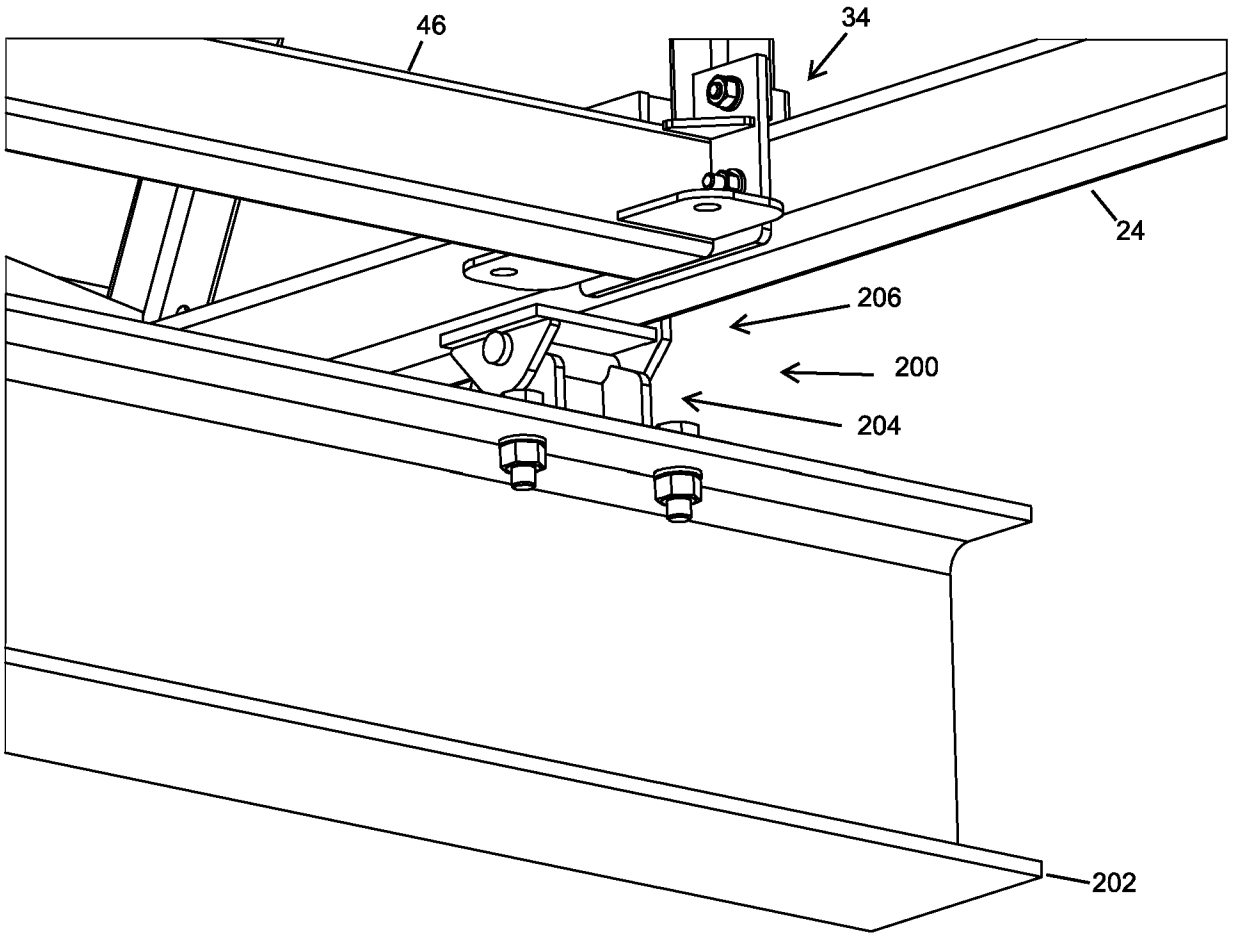
FIG. 51 is a close up bottom perspective view of the end of the support member and the rearward positioned rocker bearing as shown in FIG. 49.
Figure 52:
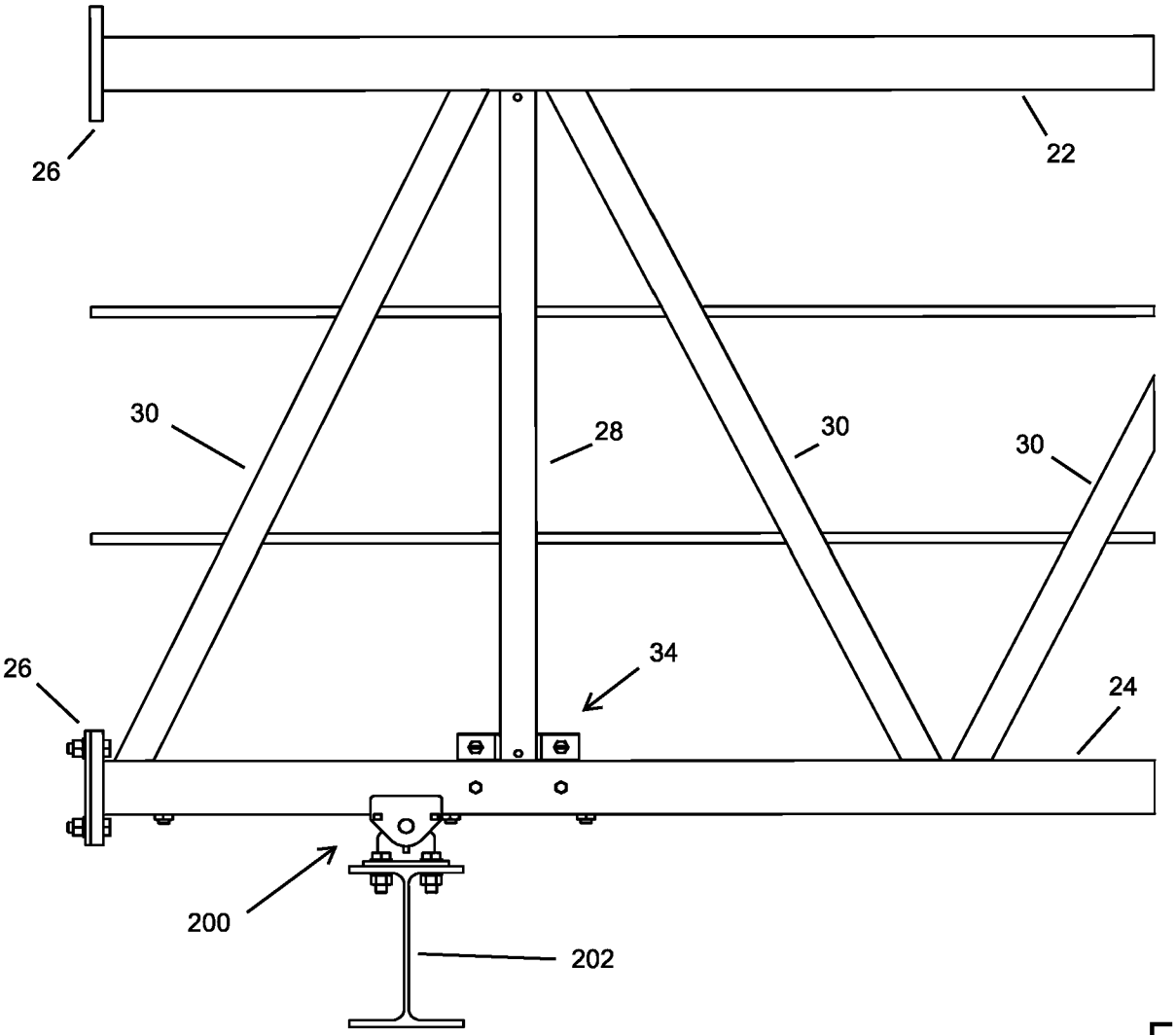
FIG. 52 is a side elevation view of a section of assembled catwalk using a side floorbeam connection system, the view showing a support member, in the form of an I-beam, extending under the bottom cords of the side trusses; the view showing a rocker bearing attached to the upper surface of the support member; the view showing the rocker bearing formed of a bottom section and a top section that rotate with respect to one another; the view showing the bottom surface of the bottom section of the rocker bearings engaging the upper surface of the support member; the view showing the upper surface of the top section of the rocker bearings engaging the lower surface of the bottom cord of the side truss; the view showing the side truss extending in a generally horizontal manner.
Figure 53:
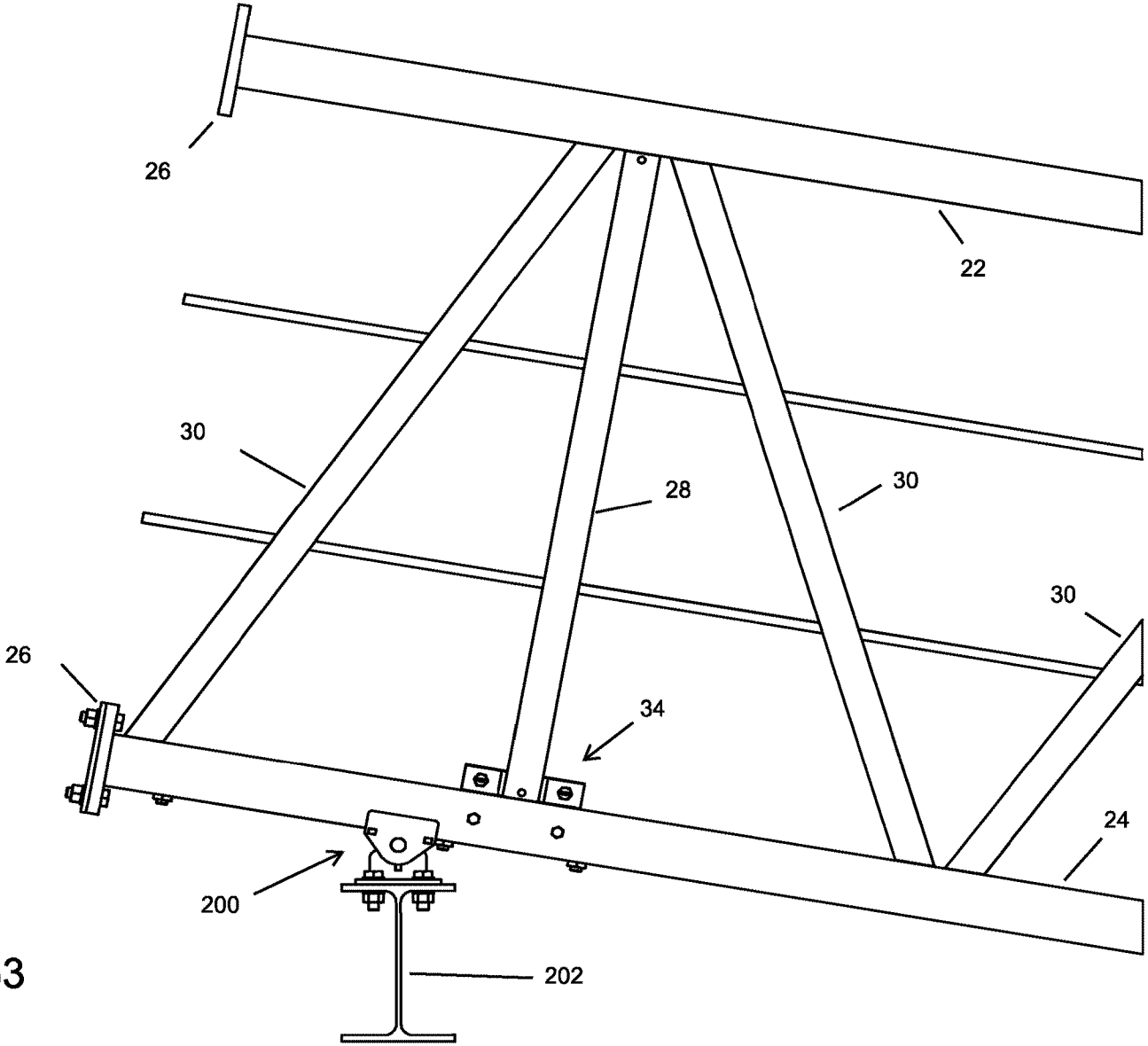
FIG. 53 is a side elevation view of a section of assembled catwalk using a side floorbeam connection system, as is shown in FIG. 52 with the difference being the view showing the catwalk system extending at an angle to horizontal demonstrating the angular variation that the rocker bearing supports.
Figure 54:
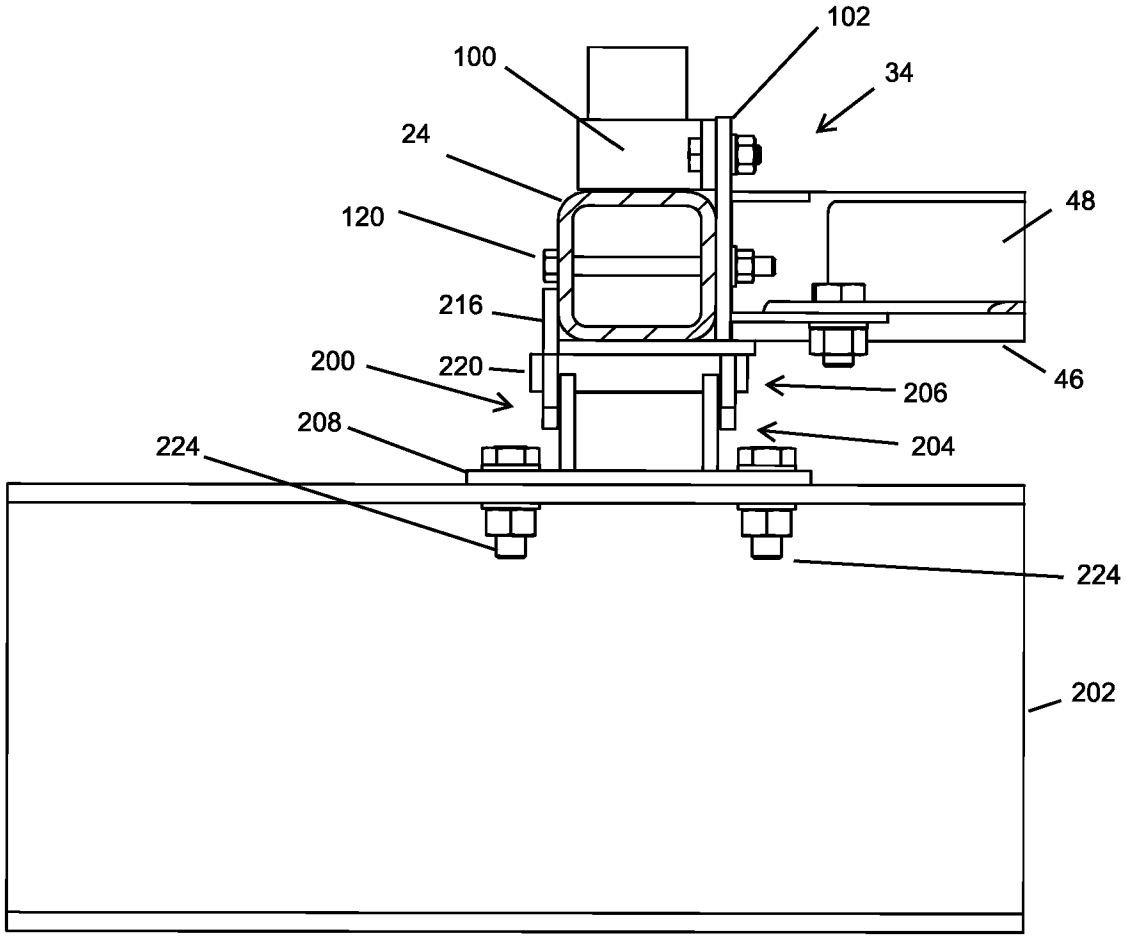
FIG. 54 is a side elevation view of the rocker bearing system shown in FIGS. 47-53; the view along the bottom cord of a side truss; the view showing a rocker bearing attached to the upper surface of the support member; the view showing the rocker bearing formed of a bottom section and a top section that rotate with respect to one another; the view showing the bottom surface of the bottom section of the rocker bearing engaging the upper surface of the support member; the view showing the upper surface of the top section of the rocker bearing engaging the lower surface of the bottom cord of the side truss; the view showing the interior facing surface of the upper end of the forward plate in engagement with the outward facing surface of the bottom cord thereby holding the catwalk system within and upon the upper surface of the rocker bearing.
Figure 55:
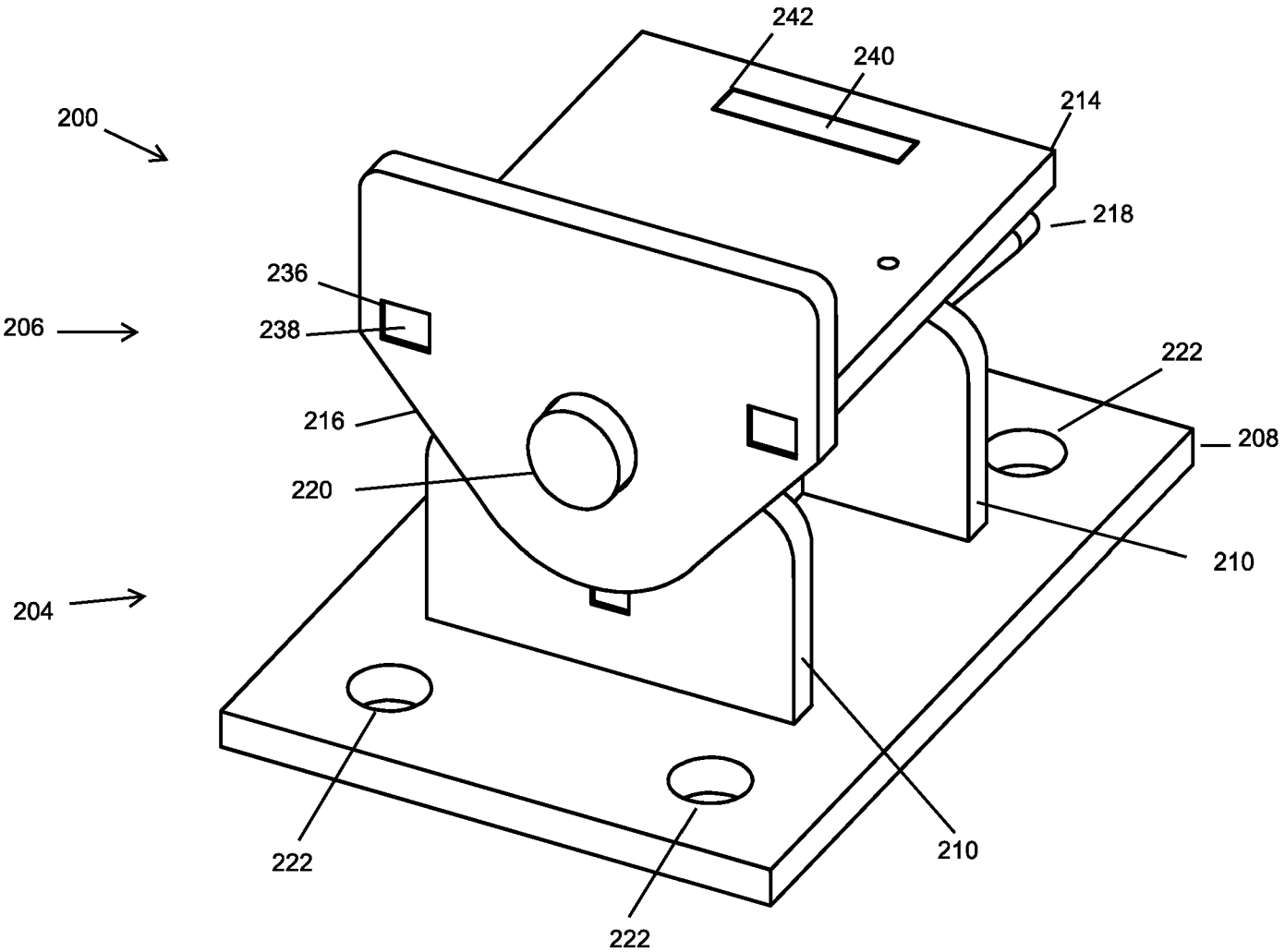
FIG. 55 is a close up top perspective view of a rocker bearing as is shown in FIGS. 47-54, the view showing the rocker bearing formed of a bottom section and a top section that rotate with respect to one another; the view showing the bottom section having a bottom plate and a pair of end plates that extend upwardly from the bottom plate and receive a rocker pin that facilitates rotation of the top section with respect to the bottom section; the view showing the top section having a top plate, and a forward plate and a rearward plate that extend downward from the top plate and receive a rocker pin that engages a recess in the upper surface of the end plates; the view also showing the upper end of the forward plate extending a distance above the top plate to form a lip that engages and retains the bottom cord of a side truss.
Figure 56:
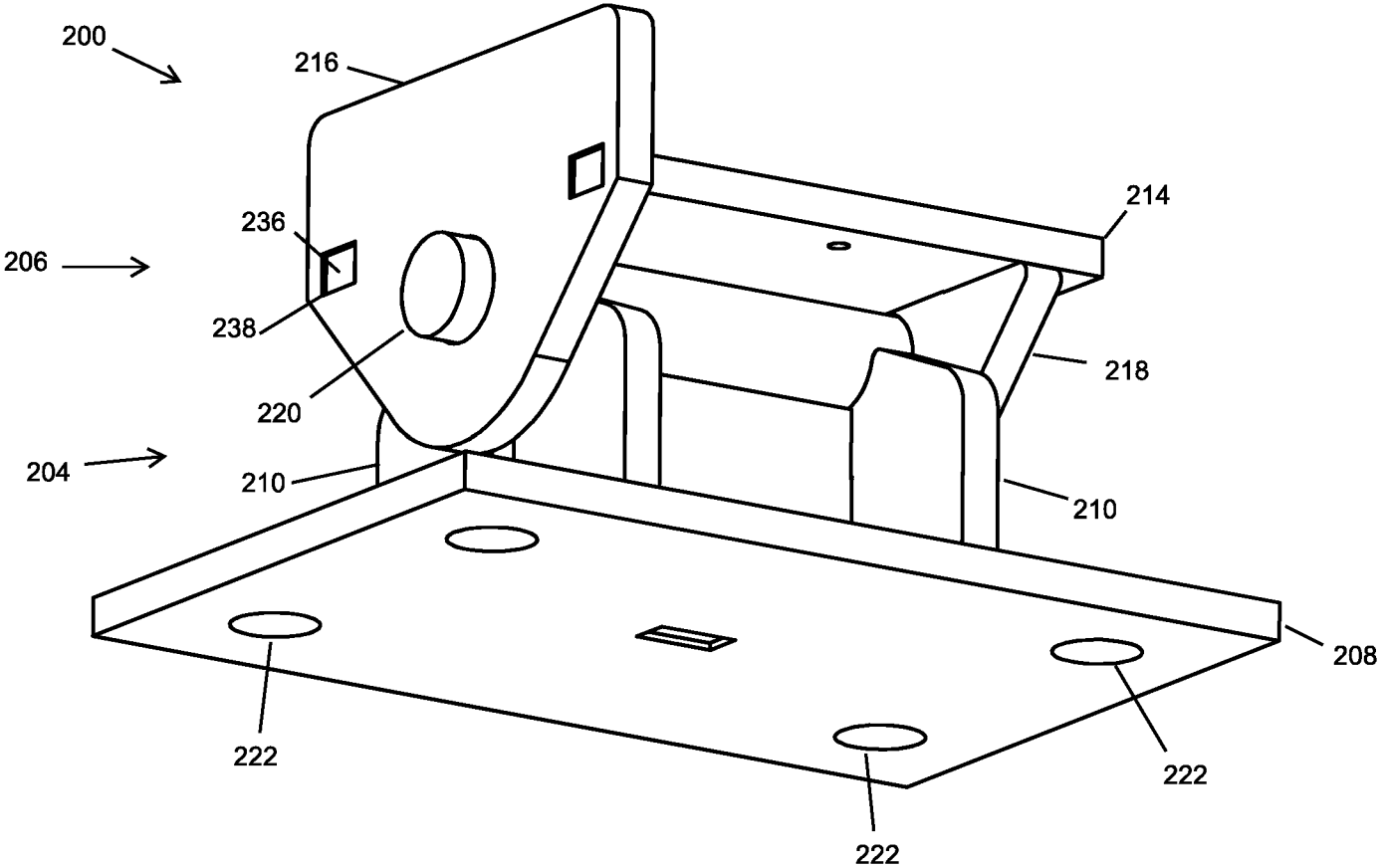
FIG. 56 is a close up bottom perspective view of a rocker bearing as is shown in FIG. 55 the view showing the rocker bearing formed of a bottom section and a top section that rotate with respect to one another; the view showing the bottom section having a bottom plate and a pair of end plates that extend upwardly from the bottom plate and receive a rocker pin that facilitates rotation of the top section with respect to the bottom section; the view showing the top section having a top plate, and a forward plate and a rearward plate that extend downward from the top plate and receive a rocker pin that engages a recess in the upper surface of the end plates; the view also showing the upper end of the forward plate extending a distance above the top plate to form a lip that engages and retains the bottom cord of a side truss.
Figure 57:
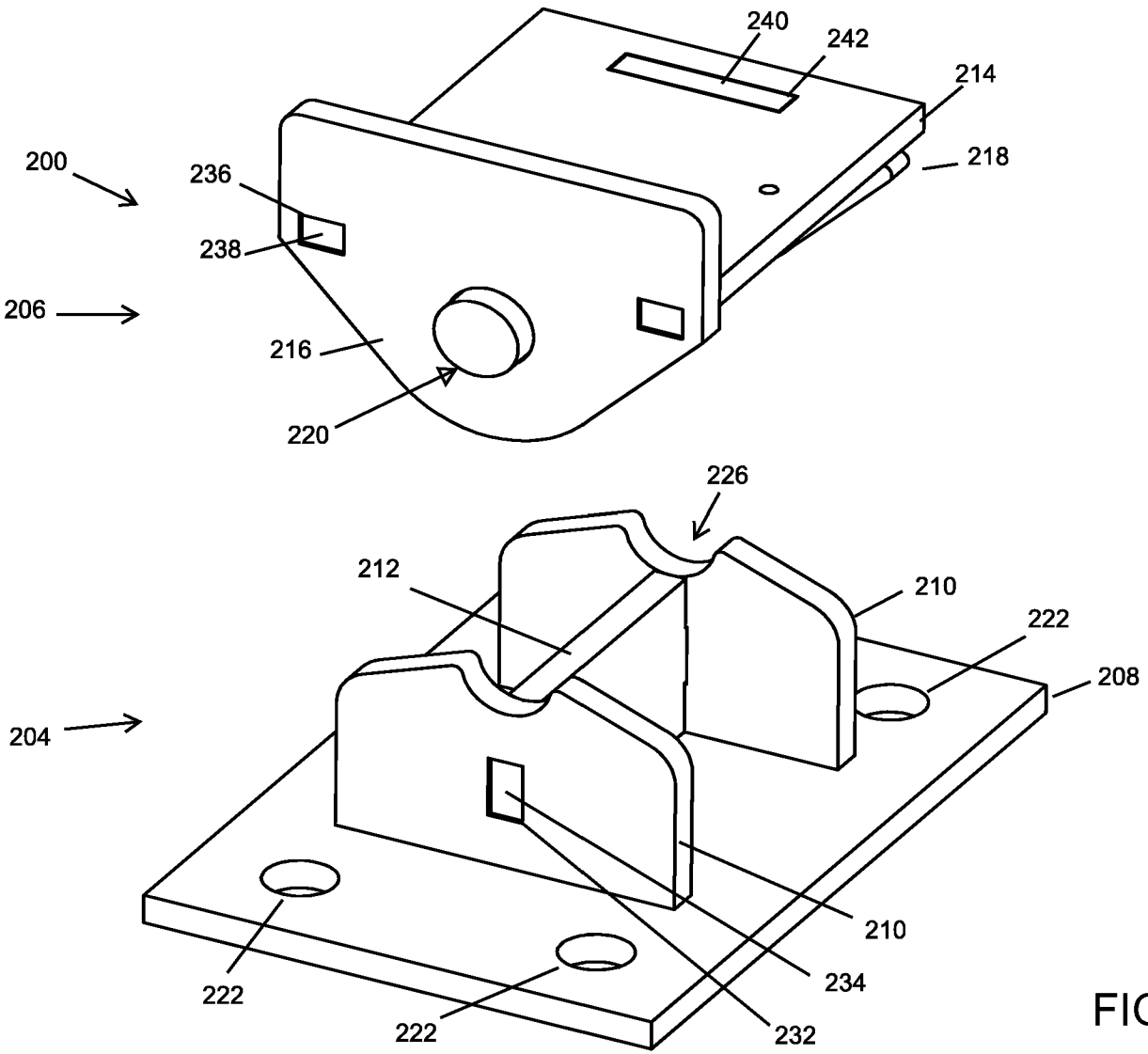
FIG. 57 is an exploded perspective top view of the rocker bearing as is shown in FIGS. 55 and 56, the view showing the top section separated from the bottom section; the view showing the recess in the end plates of the bottom section that is configured to receive the bearing surfaces of the rocker pin of the top plate; the view showing the stiffener that extends between the bottom plate and end plates and terminates at or just before the recess in the end plates.
Figure 58:
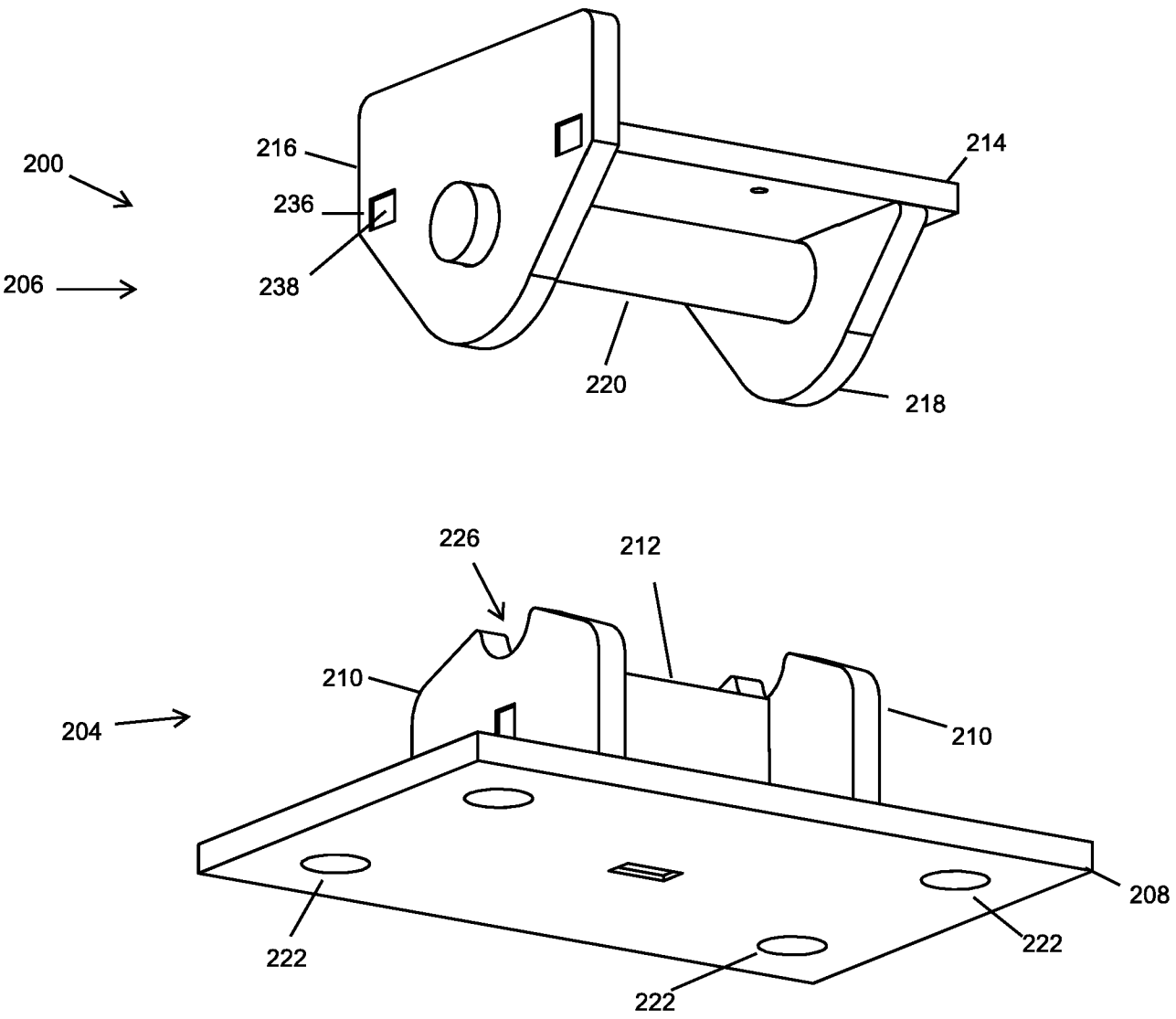
FIG. 58 is an exploded perspective bottom view of the rocker bearing as is shown in FIG. 57, the view showing the top section separated from the bottom section; the view showing the recess in the end plates of the bottom section that is configured to receive the bearing surfaces of the rocker pin of the top plate; the view showing the stiffener that extends between the bottom plate and end plates and terminates at or just before the recess in the end plates.
Figure 59:
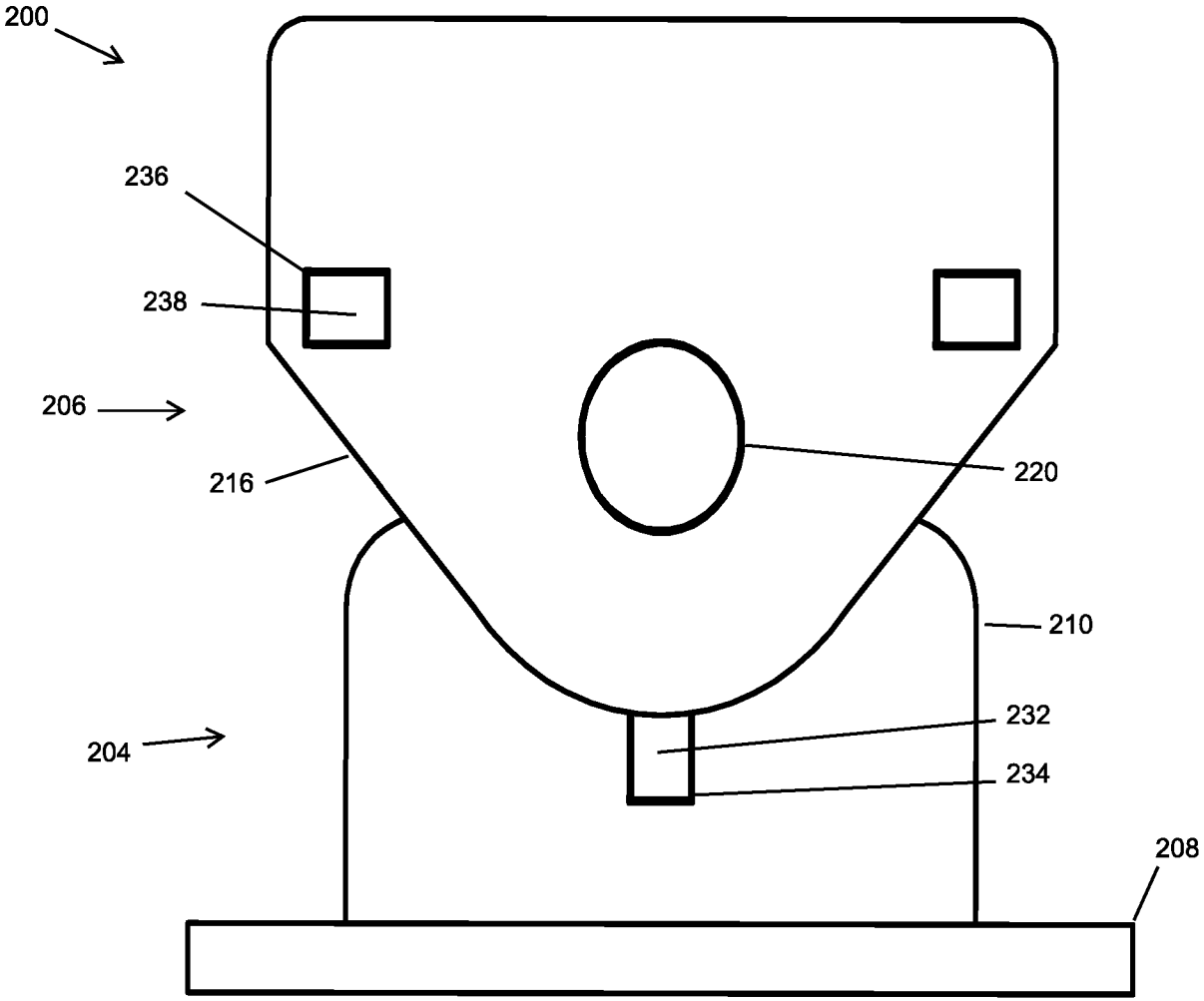
FIG. 59 is a side elevation view of the front side of the rocker bearing as is shown in FIGS. 55-58.
Figure 60:
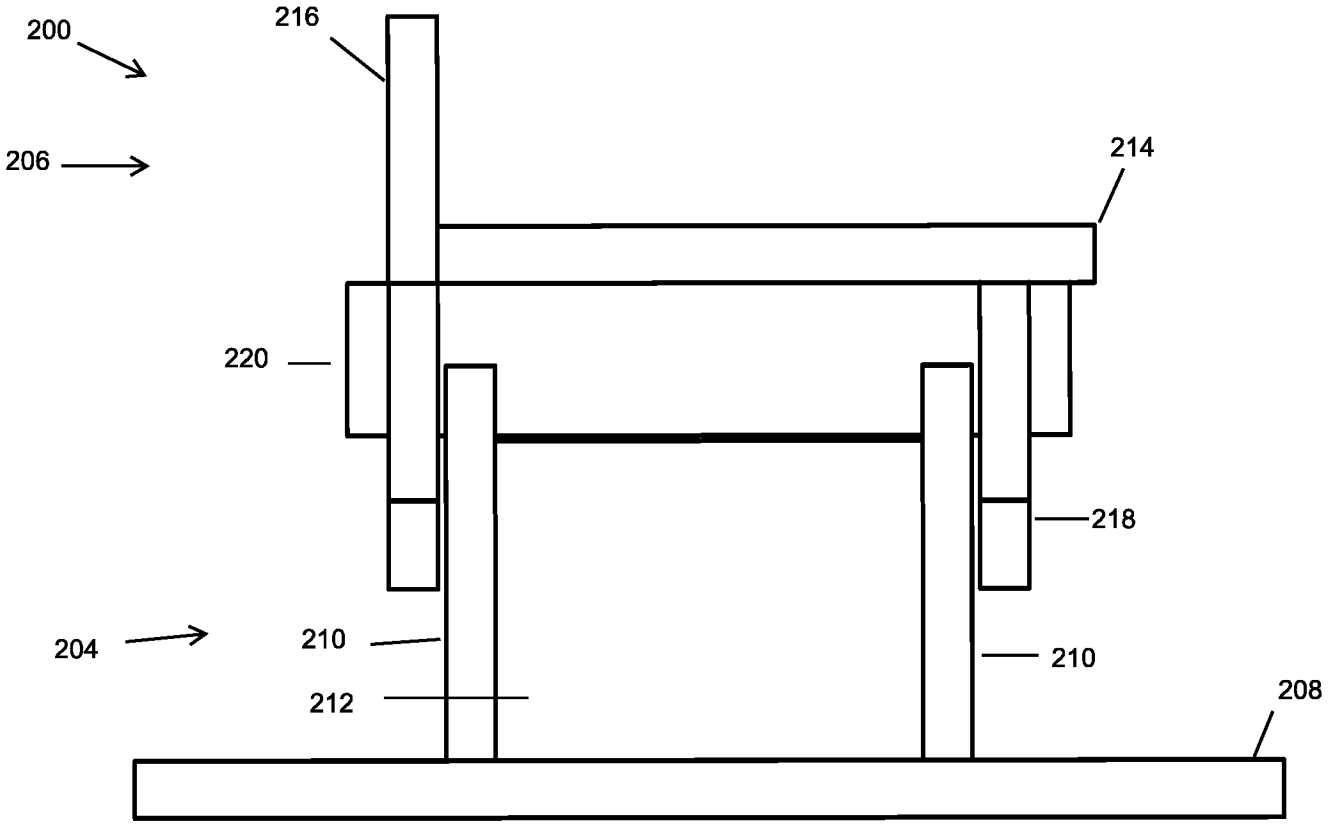
FIG. 60 is a side elevation view of the side of the rocker bearing as is shown in FIGS. 55-59.
Figure 61:
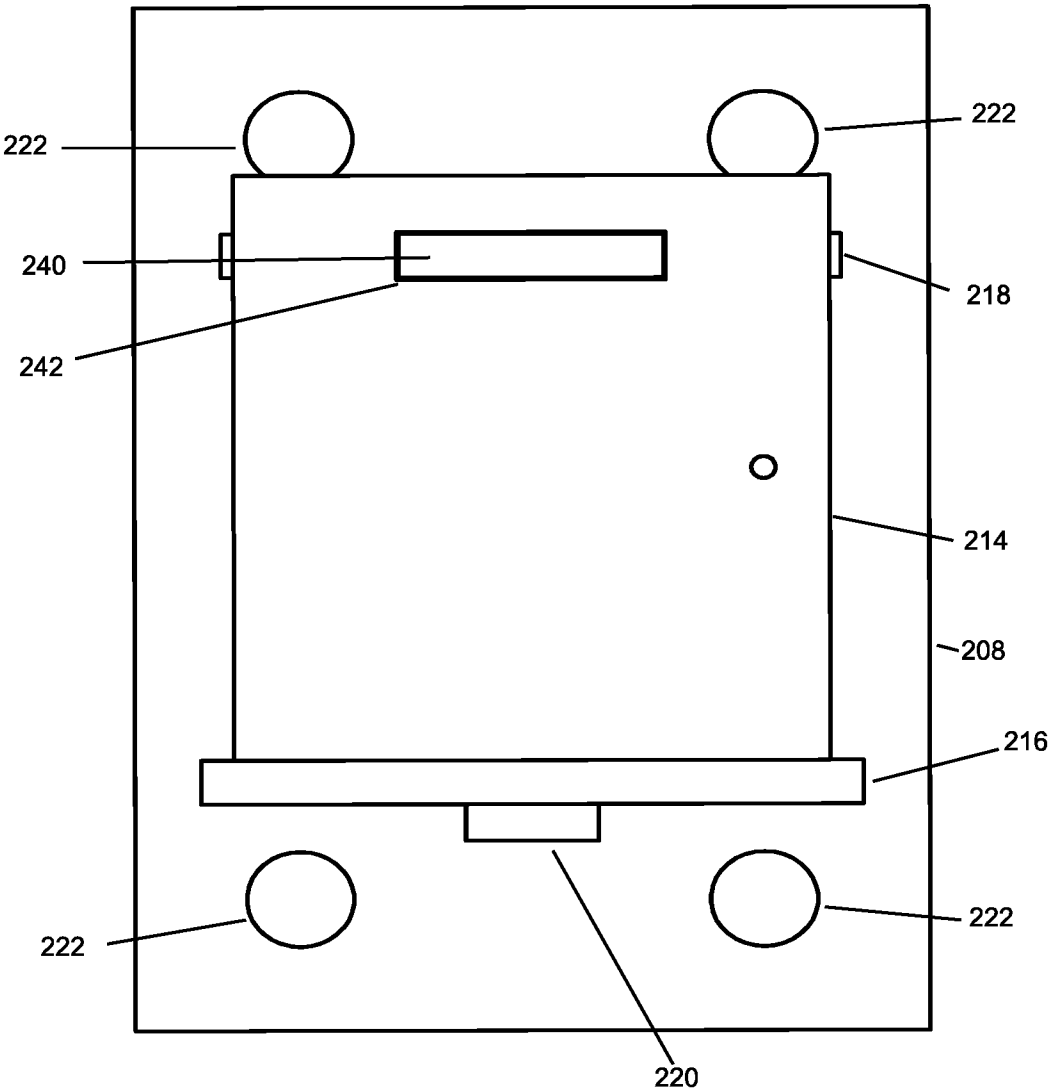
FIG. 61 is a top elevation view of the rocker bearing as is shown in FIGS. 55-60.
Figure 62:
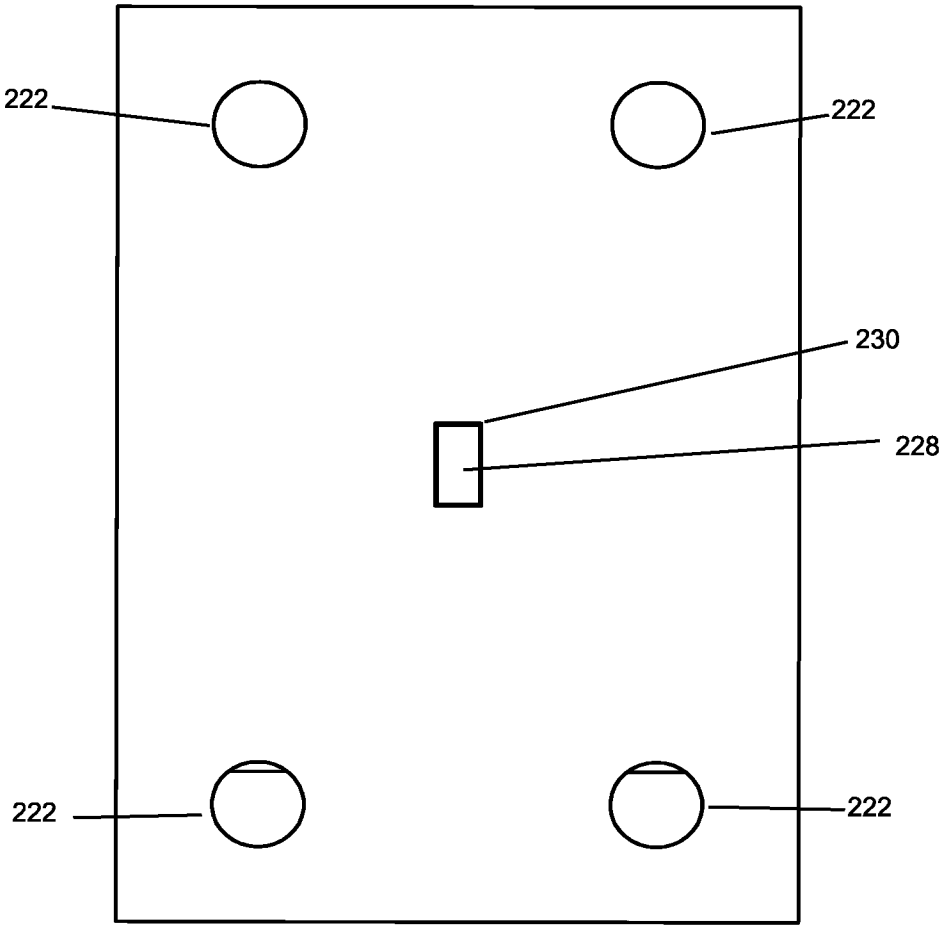
FIG. 62 is a bottom elevation view of the rocker bearing as is shown in FIGS. 55-61.

As is shown in FIGS. 7, 15 and 21, the inward surface of bottom plate 36 is connected to the inward surface 57 of bottom cord 24 in such a manner that the bottom surface 66 of bottom plate 36 is positioned above the bottom surface 68 of bottom cord 24 a distance "D". This distance "D" is equal to or is slightly greater than the height or thickness of the head 70 of bolt 54 that is used to attach diagonal wind braces 48 to bottom plate 36. By spacing bottom plate 36 upward a distance "D" from the bottom surface 68 of bottom cord 24 this provides clearance for the head 70 of fastener 54 and allows for catwalk system 10 to be set directly on top of a transverse support beam, or another structural element, without the need to use fill plates, spacers or other additional components to avoid resting the catwalk system 10 on the fasteners 54 connecting diagonal wind braces 48 to bottom plates 36. In an alternative arrangement, the bottom surface 66 of bottom plate 36 is approximately flush with the bottom surface 68 of bottom cord 24. In yet another alternative arrangement, the bottom surface 66 of bottom plate 36 is positioned any distance above the bottom surface 68 of bottom cord 24.

Side Plates: Side plates 38 are formed of any suitable size, shape and design and are configured to connect to upper surface 55 and inward surface 57 of bottom cord 24, the upper surface 72 of bottom plate 36 as well as a portion of the outward surface 73 of vertical post 28 to facilitate formation of pocket 42 and joint 34 and therefore to facilitate connection of opposing side trusses 20. In the arrangement shown, as one example, side plate 38 is generally planar in shape when viewed from the front (as is shown in FIG. 7) or from above or below. A pair of side plates 38 extend upward from the upper surface 72 of bottom plate 36 a distance in approximate parallel spaced relation to one another. When viewed from the side, the main body of side plate 38 is generally rectangular in shape and includes tabs 74 connected to the upper rearward side of side plates 38 and extend rearward.

In the arrangement shown, as one example, tabs 74 extend upward and over upper surface 55 of bottom cord 24 a distance. As such, the rearward edge of side plates 38 engages the inward surface 57 of bottom cord 24 and the lower surface of tabs 74 engages the upper surface 55 of bottom cord 24. Opposing side plates 38 are spaced from one another a distance approximately equal to, or slightly greater than, the width of vertical posts 28 (as well as floorbeams 46), as such, the inward facing surfaces of opposing tabs 74 are in approximate flat and flush engagement with the outward surfaces 73 of the lower most end of the vertical post 28 that the joint 34 is located on and connected to (as well as floorbeams 46 positioned between opposing side plates 38). The engagement of the rearward edge of side plate 38 to the inward surface 57 of bottom cord 24 and the engagement of the lower surface of tabs 74 to the upper surface 55 of bottom cord 24 provides increased area of contact between the side plate 38 and bottom cord 24 which provides a strong and durable and precise connection. In one arrangement, welding is applied along all or a portion of these engaged surfaces.

In addition, by the extension of tabs 74 extending up and over a portion of bottom cord 24, this ensures proper and precise vertical and lateral alignment of joint 34 on side truss 20 by aligning joint 34 on vertical post 28 and bottom cord 24. That is, by placing the tabs 74 on either side of vertical post 28, this precisely defines the lateral position of joint 34 and by engaging the bottom surface of tabs 74 with the upper surface 55 of bottom cord 24 this precisely defines the vertical position of joint 34. This also ensures precise positioning of the bottom surface 66 of bottom plate 36 with respect to the bottom surface 68 of the bottom cord 24. Also, welding is applied along all or a portion of the rearward edge, the upper edge and/or the inward edge of the tab 74 that engages vertical post 28 thereby increasing the strength of contact between the joint 34 and vertical post 28.

In the arrangement shown, as one example, tab 74 of side plate 38 terminates just short of drain hole 76 positioned in the lower end of the outward surface 73 of vertical post 28. Care is taken during assembly and welding to ensure that drain hole 76 is not plugged so as to prevent drainage of moisture that enters the hollow interior of vertical post 28.

In the arrangement shown, as one example, the bottom surfaces of side plates 38 engage the upper surface 72 of bottom plate 36. Side plates 38 also include a plurality of ears 64 that extend downward from the bottom surface of side plates 38. Ears 64 are configured to be received within locating slots 62 in bottom plate 36 within close and tight tolerances. Ears 64 provide for precise alignment of side plates 38 with bottom plate 36 and ensure that when side plates 38 are installed on bottom plate 36 the side plates 38 are at the precise distance away from one another to receive the end 44 of floorbeams 46 within close and tight tolerances. The use of locating slots 62 in bottom plate 36 and the associated ears 64 in side plates 38 also provides increased strength and rigidity to the connection between bottom plate 36 and side plates 38. In addition, by having the ear 64 of side plate 38 extend into the locating slot 62 of bottom plate 36 this facilitates convenient welding or tack welding of the side plate 38 to bottom plate 36 to hold the two components together prior to other manufacturing steps.

In one arrangement, joint 34 is assembled by first installing side plates 38 on bottom plate 36 and welding them in place. Care is taken during this step to ensure that the side plates 38 are precisely positioned apart from one another and aligned in parallel spaced relation to one another to receive an end 44 of floorbeam 46. In one arrangement, a spacer block is placed between side plates 38 while side plates 38 are welded to bottom plate 36 to maintain this spacing. The combined bottom plate 36 and side plates 38 arrangement is then installed on bottom cord 24 and vertical post 28. This is accomplished by placing the tabs 74 on either side of vertical post 28 and then sliding the combined bottom plate 36 and side plates 38 downward until the bottom edge of tabs 74 engage the upper surface 55 of bottom cord 24 and the inward surface of bottom plate 36 and side plates 38 engage the inward surface 57 of bottom cord 24. Once in this position, bottom plate 36 and side plates 38 are welded onto bottom cord 24 and vertical post 28.

Once the combined bottom plate 36 and side plates 38 arrangement is installed on bottom cord 24 and vertical post 28, next wing plates 40 are installed on bottom cord 24 and side plates 38. To facilitate the connection between side plates 38 and wing plates 40, side plates 38 also include at least one locating slot 78 that receives an ear 80 of wing plate 40. In the arrangement shown, the at least one locating slot 78 is positioned at the rearward edge of side plate 38 at or just prior to the start of tab 74. Ears 80 of wing plate 40 are configured to be received within locating slots 78 in side plate 38 within close and tight tolerances. Ears 80 provide for precise alignment of wing plates 40 with respect to side plates 38 and ensure that when wing plates 40 are installed on side plate 38 the wing plate 40 is positioned at the precise position to engage the inward surface 57 of bottom cord 24. The use of locating slots 78 in side plate 38 and the associated ears 80 in wing plates 40 also provides increased strength and rigidity to the connection between side plate 38, wing plate 40 and bottom cord 24.

In the arrangement shown, as one example, the main body of opposing side plates include a pair of spaced holes 82 therein; however any other number of holes are hereby contemplated for use such as one, three, four, five, six, seven, eight, nine, ten or more. These holes 82 are sized and shaped to match corresponding holes 84 in the ends 44 of floorbeams 46 such that when a floorbeam 46 is placed within pocket 42 the holes 84 in floorbeam 46 align with the holes 82 in side plate 38 and fasteners 54 are passed there through thereby affixing floorbeam 46 to side plates 38. Alternatively, one or more notches, grooves or any other feature is hereby contemplated in side plates 38 for use connecting floorbeam 46 to joint 34.

Figure 9:
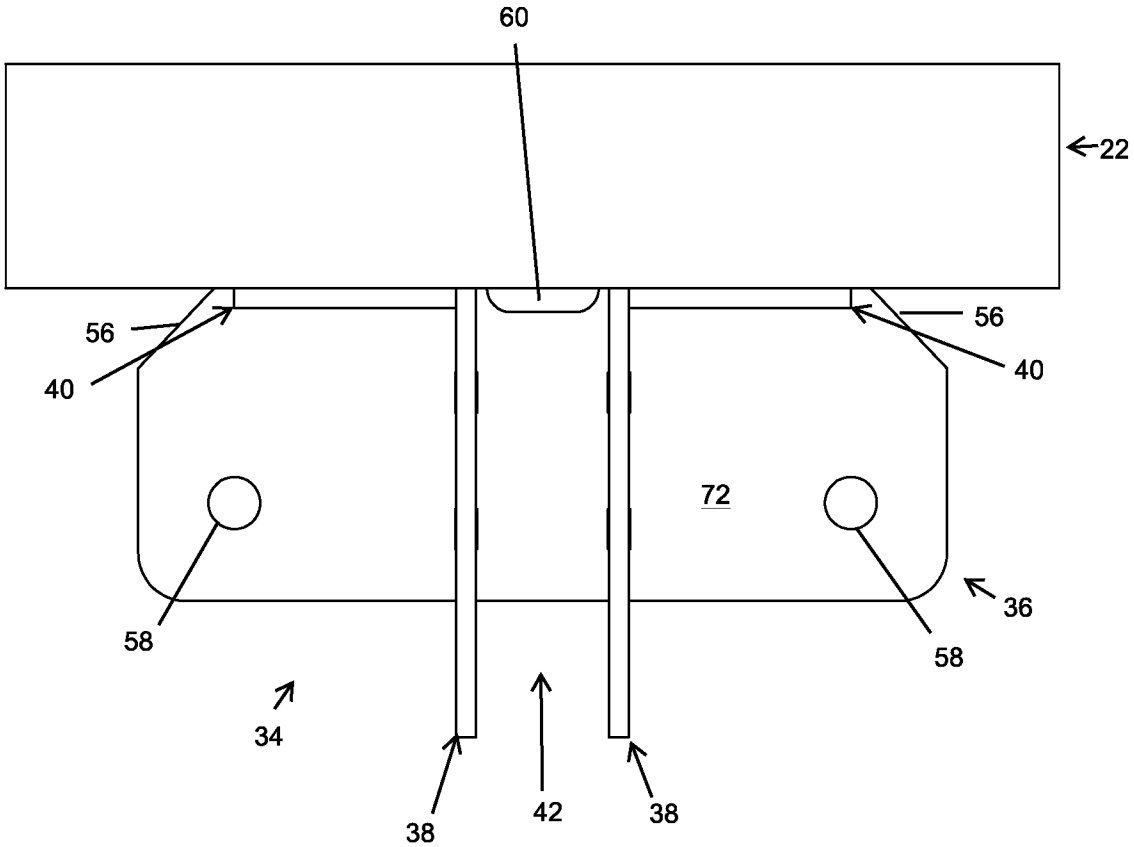
FIG. 9 is a close-up top elevation view of a joint connected to the bottom cord, the view showing the bottom plate connected to the bottom cord, a pair of side plates connected to the bottom plate and the bottom cord; the view showing a pair of wing plates connected to the bottom cord and a side plate.
Figure 10:
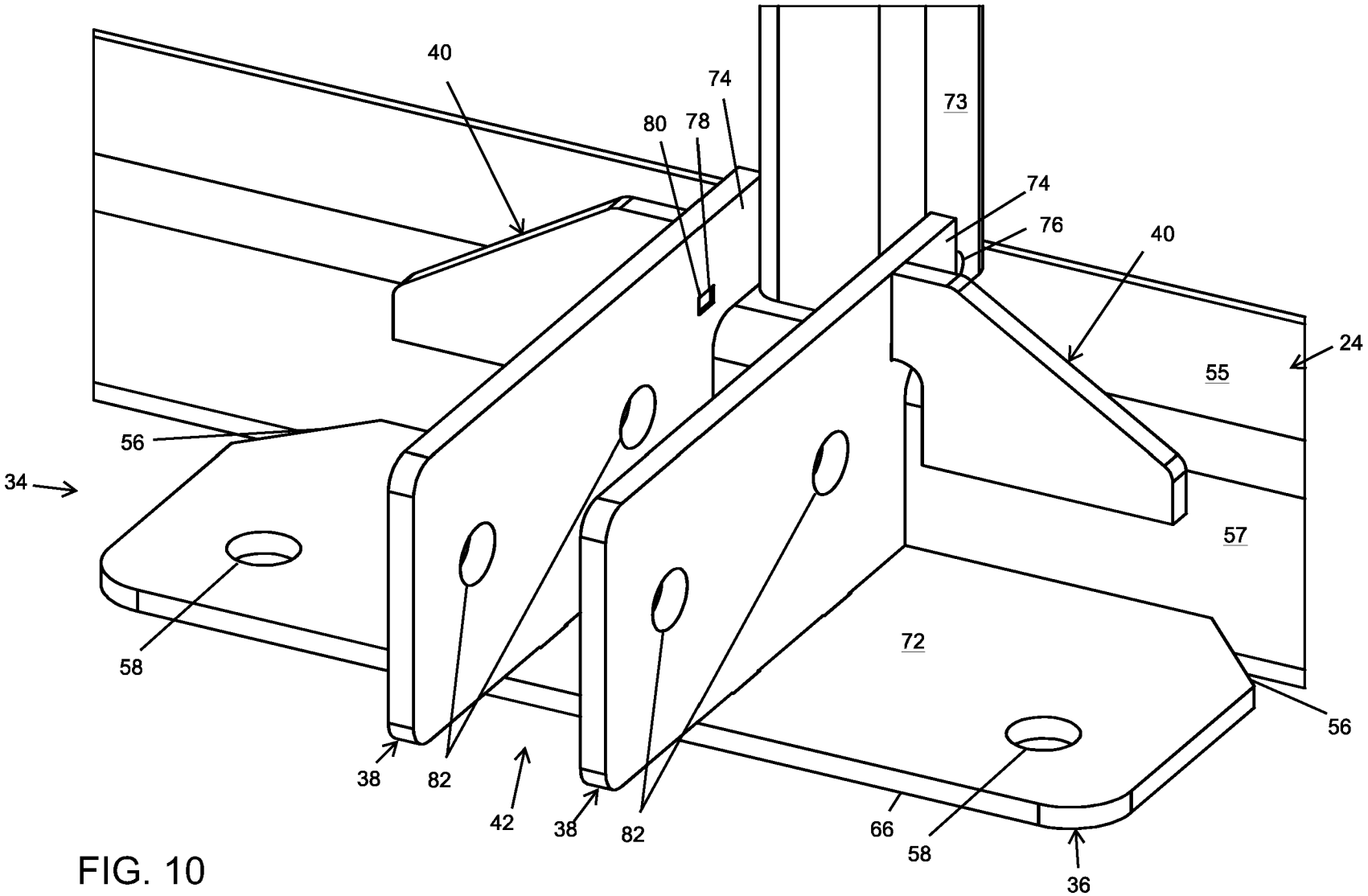
FIG. 10 is a close-up perspective view of a joint connected to the bottom cord, the view showing the bottom plate connected to the bottom cord, a pair of side plates connected to the bottom plate, bottom cord and vertical post; the view showing a pair of wing plates connected to the bottom cord and a side plate, the view also showing the side plates having tabs and the vertical post having a drain hole.
Figure 11:
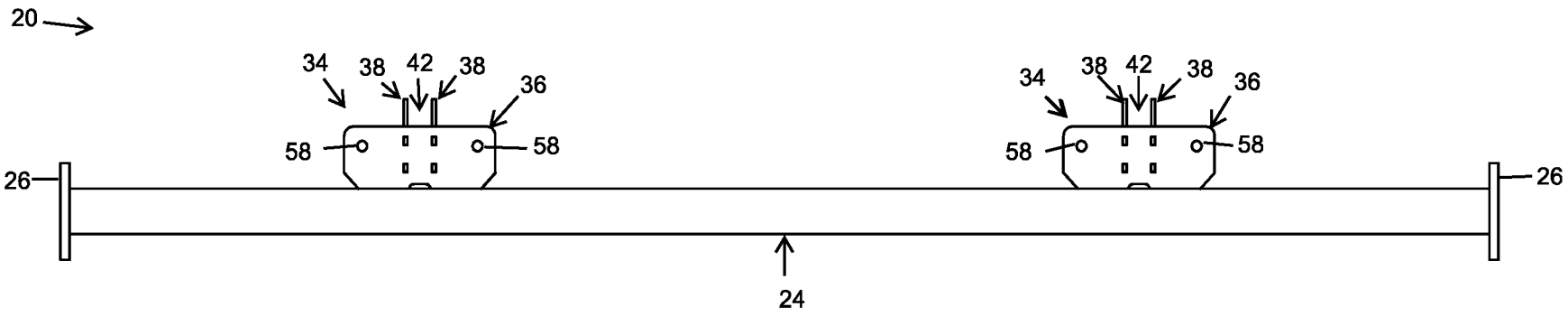
FIG. 11 is a bottom elevation view of single side truss, the view showing a pair of joints connected to the bottom cord that form pockets.
Figure 12:
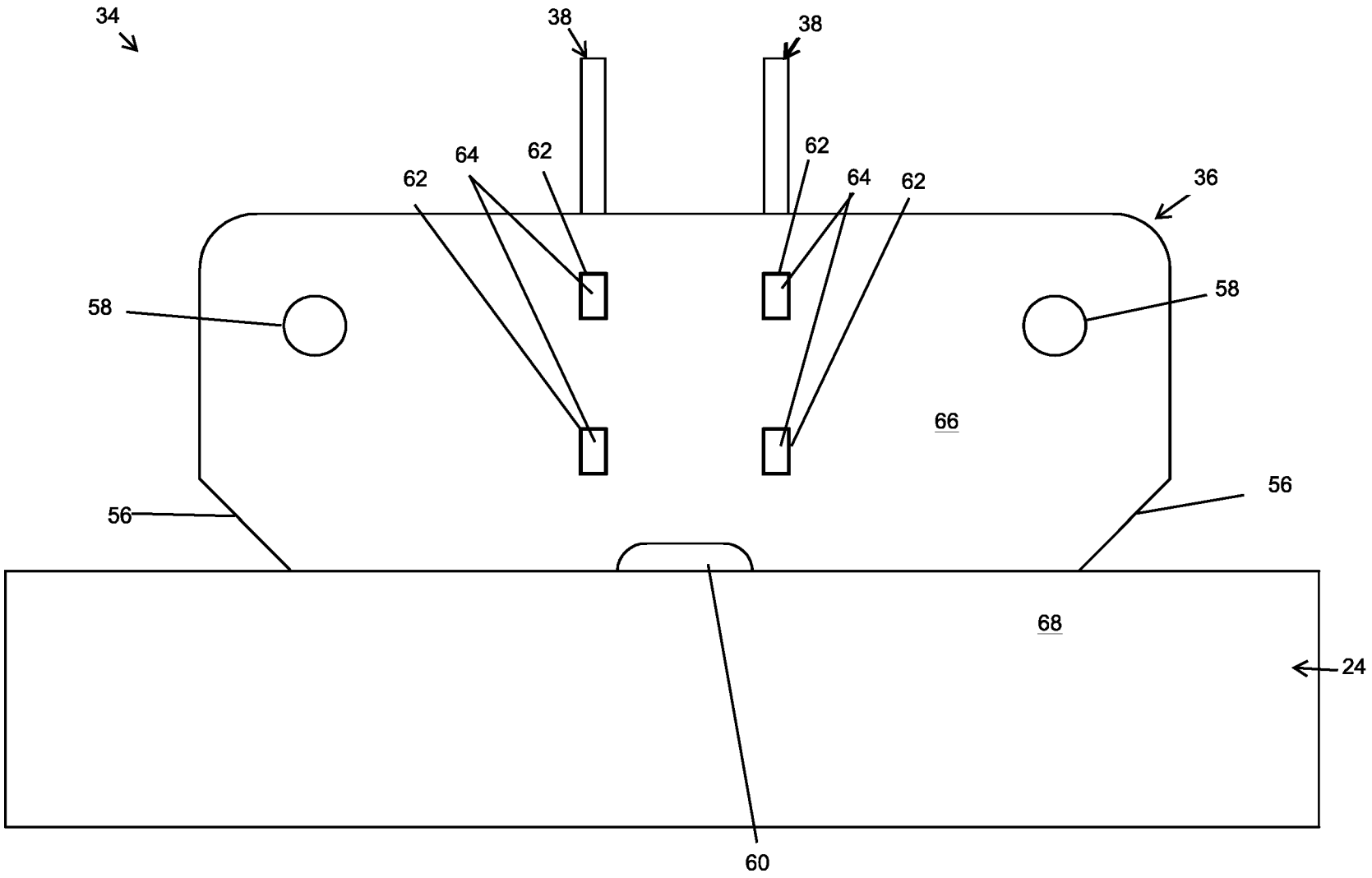
FIG. 12 is a close-up bottom elevation view of a joint connected to the bottom cord, the view showing the bottom plate connected to the bottom cord, a pair of side plates connected to the bottom plate; the view showing a pair of alignment slots in the bottom plate for each side plate, the view also showing ears of side plate 38 positioned within the alignment slots of the bottom plate.
Figure 13:
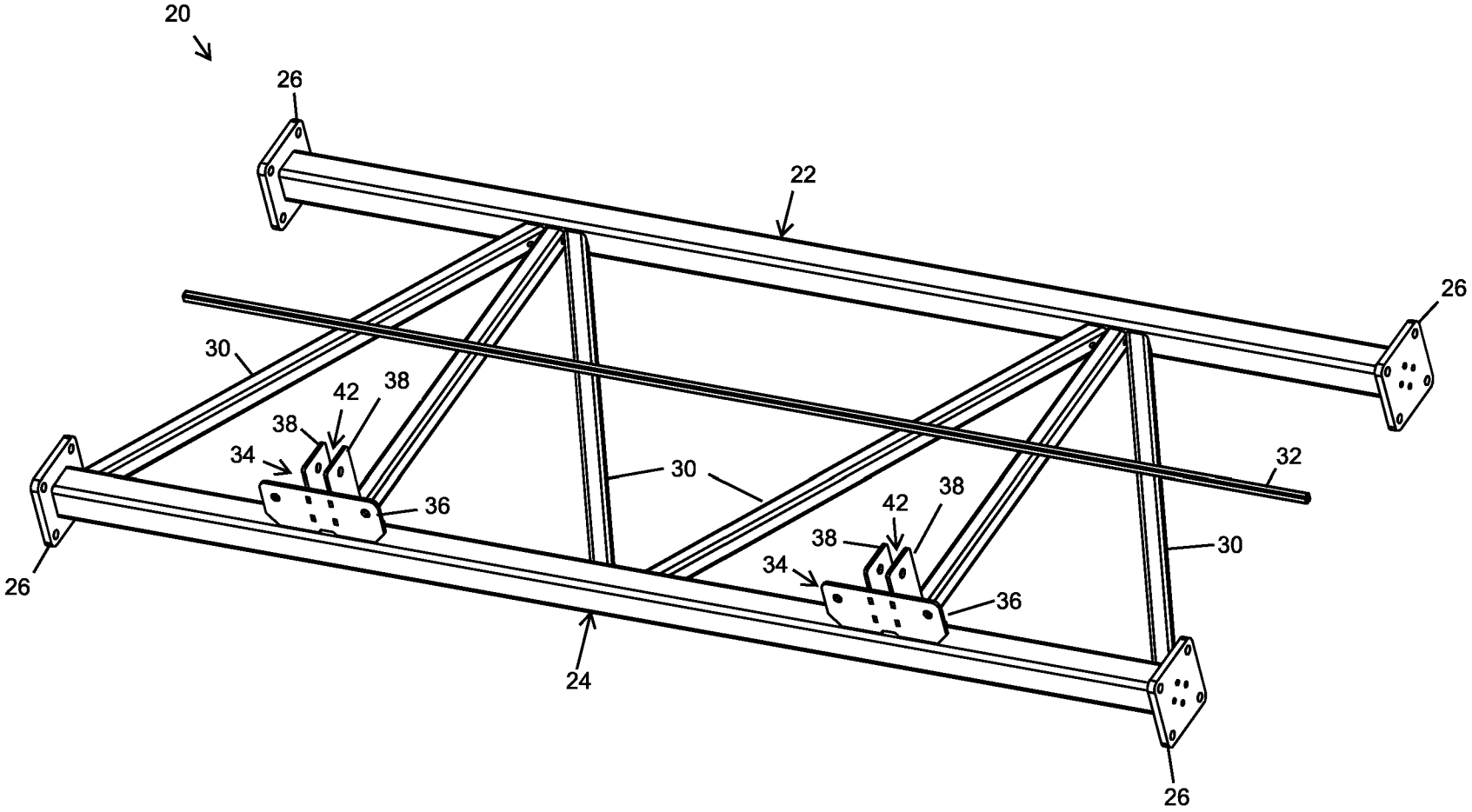
FIG. 13 is a perspective view of single side truss, the view showing a top cord and bottom cord connected together by a plurality of vertical posts and diagonal posts, the view also shows joints connected to the bottom cord that form pockets.
Figure 14:
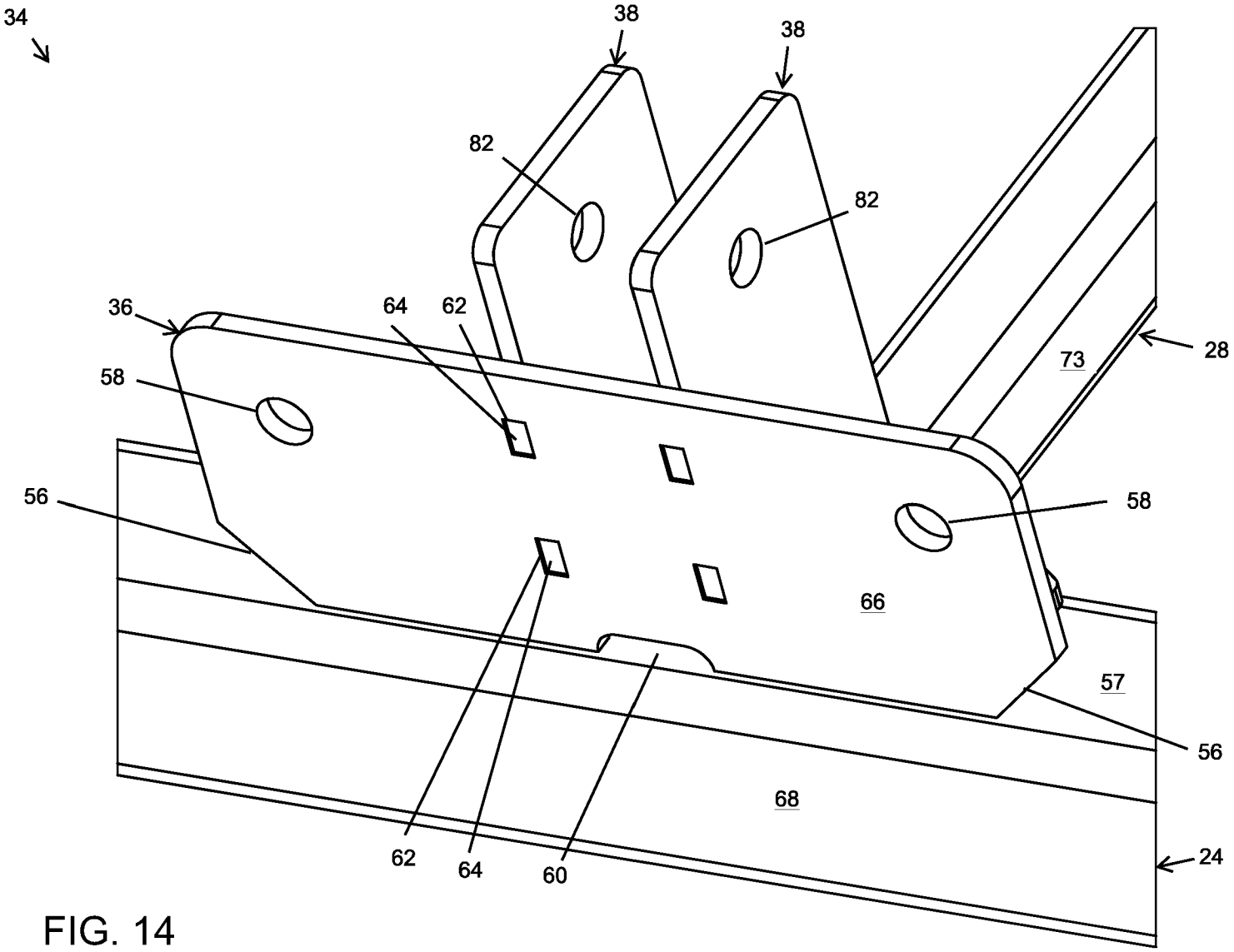
FIG. 14 is a close-up bottom perspective view of a joint connected to the bottom cord, the view showing the bottom plate connected to the bottom cord, a pair of side plates connected to the bottom plate; the view showing a pair of alignment slots in the bottom plate for each side plate, the view also showing ears of side plate 38 positioned within the alignment slots of the bottom plate.

Wing Plates: Wing plates 40 are formed of any suitable size, shape and design and are configured to connect to the exterior surface of side plate 38 and inward surface 57 of bottom cord 24 and to provide increased strength and rigidity to joint 34. In the arrangement shown, as one example, wing plate 40 is generally planar in shape when viewed from above (as is shown in FIG. 9) or below or from the side (as is shown in FIG. 15). When viewed from the front (as is shown in FIG. 7), the main body of wing plate 40 has a generally flat bottom edge 86, a generally flat outward edge 88, a generally flat upper edge 90 and a generally flat inward edge 92. An angled surface 94 connects the upper end of the outward edge 88 to the outward edge of the upper edge 90. In an alternative arrangement, wing plates 40 are formed of any other suitable size, shape and design such as being square or rectangular in shape or any other shape.

In the arrangement shown, as one example, wing plates 40 include relief 96 that provides clearance for the welding that connects side plate 38 to the inward surface 57 of bottom cord 24. Relief 96 extends between the lower edge of inward edge 92 of wing plate 40 and the inward edge of the bottom edge 86 of wing plate 40.

To facilitate the connection between wing plates 40 to side plates 38, the inward edge 92 of wing plates 40 also include at least one ear 80 that is received within a corresponding locating slot 78 of side plate 38. While only one ear 80 and locating slot 78 is shown, any number is hereby contemplated for use including two, three, four, five, six, seven, eight, nine or ten or more. In the arrangement shown, ears 80 of wing plate 40 are configured to be received within locating slots 78 in side plate 38 within close and tight tolerances. Ears 80 provide for precise alignment of wing plates 40 with respect to side plates 38 and ensure that when wing plates 40 are installed on side plate 38 the wing plate 40 is positioned at the precise position to engage the inward surface 57 of bottom cord 24. The use of locating slots 78 in side plate 38 and the associated ears 80 in wing plates 40 also provides increased strength and rigidity to the connection between side plate 38, wing plate 40 and bottom cord 24.

In one arrangement, once the ear 80 of wing plate 40 is inserted within the locating slot 78 of side plate 38, the inward edge 92 of wing plate 40 can be welded against the outward surface of side plate 38. Once the ear 80 of wing plate 40 is inserted within the locating slot 78 of side plate 38, the outward edge 88 of wing plate 40 can be welded against the inward surface 57 of bottom cord 24 and the rearward surface of the wing plate 40 can be welded against the corner and/or upper surface 55 of bottom cord 24.

In this way, joint 34 is assembled and installed on bottom cord 24 and pocket 42 is formed. By assembling the bottom plate 36 and side plates 38 to one another and then installing this combined assembly to bottom cord 24 this speeds the installation process, this also facilitates accurate and repeatable attachment of the joint 34 to the side truss 20. This is because the distance between the opposing side plates 38 precisely matches or mates with the vertical post 28 to which joint 34 is attached. In addition, the combined effects of the flat back surface of bottom plate 36 and side plates 38 (that engage the inward surface 57 of bottom cord 24) coupled with the flat bottom surface of tabs 74 (that engage the upper surface 55 of bottom cord 24) coupled with the precise spacing between side plates 38 (that fit over vertical post 28) facilitates locating joint 34 along multiple planes which produces accurate and repeatable attachment of joint 34 to side truss 20.

While in the arrangement shown and described predominantly above contemplates joint 34 being formed of separate pieces (bottom plate 36 and side plates 38) which are welded to side truss 20 followed by wing plates 40 which are welded in place, it is hereby contemplated that joint 34 may be attached to side truss 20 by any other manner, method or means such as by screwing, bolting or the like or by manufacturing the side truss of a single piece of material having some or all of the features of joint 34 therein.

Pocket: Pockets 42 are formed of any suitable size, shape and design and are configured to receive and hold an end 44 of floorbeam 46 within close and tight tolerances. In the arrangement shown, as one example, pockets 42 include generally square or rectangular recesses in joints 34. In the arrangement shown, pockets 42 are defined on their bottom side by the upper surface 72 of bottom plate 36, on their sides by the opposing inward surfaces of side plates 38, and at its rearward surface by the inward surface 57 of bottom cord 24.

Pockets 42 are sized and shaped such that when opposing side trusses 20 are positioned at the proper spacing from one another, the ends 44 of floorbeams 46 simply drop into pockets 42 from above pockets 42. When the ends 44 of floorbeams 46 are positioned within pockets 42, the holes 84 in floorbeams 46 align with the holes 82 in side plates 38. Once aligned, fasteners 54 are passed through the holes 82 in side plates 38 and the holes 84 in floorbeam 46 thereby affixing the floorbeam 46 to the side plates 38 thereby holding floorbeam 46 within pocket 42. In an alternative arrangement or in addition, one or more fasteners may be passed through the end 44 of floorbeam 46 and the bottom plate 36 thereby affixing the floorbeam 46 to the bottom plate 36.

Floorbeams: Floorbeams 46 are formed of any suitable size, shape and design and are configured to provide structural support and to connect opposing side trusses 20. In the arrangement shown, as one example, floorbeams 46 are generally square or rectangular hollow tubes that extend a length between opposing ends 44. However any other shaped structural member is hereby contemplated for use as floorbeam 46 such as an I-beam, a wide flange beam, a 90 degree angle bar, a Z-bar, a C-channel, an L-bar, a cylindrical pipe, a solid bar, a solid rod, or the like or any combination thereof. The ends 44 of floorbeams 46 are inserted within the pockets 42 of joints 34 and affixed in place using fasteners 54. In the arrangement shown, floorbeams 46 extend in approximate perpendicular alignment to the length of side trusses 20 or more specifically to the length of top cords 22 and bottom cords 24.

Diagonal Wind Braces: Diagonal wind braces 48 are formed of any suitable size, shape and design and are configured to provide structural support and to connect opposing side trusses 20. In the arrangement shown, as one example, diagonal wind braces 48 are formed of a length of angle iron or an L-shaped member. However, any other shaped structural member is hereby contemplated for use as diagonal wind brace 48 such as a square tube, a rectangular tube, an I-beam, a wide flange beam, a 90 degree angle bar, a Z-bar, a C-channel, a cylindrical pipe, a solid bar, a solid rod, or the like or any combination thereof.

Diagonal wind braces 48 extend at an angle between opposing side trusses 20 and connects kitty-corner or diagonally opposite joints 34 on opposing side trusses 20. That is, diagonal wind braces 48 connect a joint 34 on one side truss 20 to the next joint 34 on the other side truss 20. The ends of diagonal wind braces 48 have a hole that is aligned with the hole 58 in the corners of bottom plate 36 positioned just outside of side plates 38. Once the hole in the end of diagonal wind brace 48 is aligned with the opening 58 in the corner of bottom plate 36 a fastener 54 is passed through the bottom plate 36 and diagonal wind brace 48 is tightened in place. To provide optimum strength and rigidity, diagonal wind braces 48 are connected in a zig-zag pattern along catwalk system 10 connecting each kitty-corner or diagonally opposite joint 34.

Walkway: Walkway 50 is formed of any suitable size, shape and design that provides a surface for a user to comfortably walk upon. In the arrangement shown, as one example, walkway 50 is an elongated member that defines a generally flat elongated surface that is configured to be walked upon by a user and/or provide support for other objects and components.

In Operation: In operation, disassembled parts including side trusses 20, floorbeams 46, diagonal wind braces 48 and fasteners 54 are shipped to the jobsite. The catwalk system 10 is assembled on site by placing a first side truss 20 and a second side truss 20 in opposing spaced relation. The pockets 42 of joints 34 of first side truss 20 and second side truss 20 are aligned with one another and once aligned opposing ends 44 of floorbeams 46 are placed within the pockets 42.

More specifically, floorbeams 46 are inserted into the pockets 42 of opposing side trusses 20 by lowering the ends 44 of floorbeams 46 into pocket 42. As the ends 44 of floorbeams 46 are lowered into pockets 42, the exterior sides of floorbeams 46 pass within close tolerances, and in some cases frictional engagement, between the inward surfaces of opposing side plates 38. Floorbeams 46 are inserted into pockets 42 until the bottom surface of floorbeams 46 engage the upper surface of the bottom plate 36. In this position, floorbeams 46 are fully inserted within pockets 42. In this position, the floorbeams 46 are supported by bottom plates 36 and bounded on their sides by side plates 38. In this position, the floorbeams 46 are also bounded at their ends 44 by the inward surface 57 of bottom cords 24. As such, once placed within pockets 42, floorbeams 46 are prevented from escaping from pockets 42 and instead are removed by lifting floorbeams 46 out of pockets 42.

Once floorbeams 46 are inserted into the pockets 42 the holes 84 in the ends 44 of floorbeams 46 are aligned with the holes 82 in the side plates 38 and fasteners 54 are passed through the opposing side plates 38 and floorbeam 46 and the floorbeam 46 is tightened in place thereby affixing the floorbeam 46 to the pocket 42.

As such, attaching opposing side trusses 20 to one another by installing floorbeams 46 in pockets 42 is a quick, easy and efficient process. There are no tools required to insert floorbeams 46 within pockets 42, and only a wrench is needed to tighten fasteners 54, as such, there is no special equipment needed. In addition, there are no sophisticated manufacturing steps or processes.

The diagonal wind braces 48 are installed by extending the diagonal wind braces 48 in a zig-zag pattern that extends from side truss 20 to side truss 20. The ends of diagonal wind braces 48 are placed on the wind brace sections of bottom plate 36 just outside of side plate 38. Holes in the ends of diagonal wind braces 48 are aligned with hole 58 in the bottom plate 36 of joint 34. Once the hole in the end of diagonal wind brace 48 is aligned with the hole 58 in the bottom plate 36, a fastener 54 is passed through the bottom plate 36 and diagonal wind brace 48 and tightened in place thereby affixing the diagonal wind brace 48 to the bottom plate 36.

Once sections 19 of catwalk system 10 are formed, adjacent sections 19 of catwalk system 10 are connected to one another by aligning the holes 52 in end plates 26 of adjacent sections 19 with one another. Once the holes 52 in opposing end plates 26 are aligned with one another fasteners 54 are passed through the opposing end plates 26 and tightened in place thereby affixing the opposing end plates 26 to one another thereby forming an elongated catwalk. This process is repeated until the desired length of the catwalk system 10 is achieved.

As diagonal wind braces 48 form a zig-zag pattern and extend from one side truss 20 to the other side truss 20 at an angle, two diagonal wind braces 48 connect to every other joint 34 along each side of catwalk system 10. That is, two diagonal wind braces 48 connect to one joint 34 whereas the immediately adjacent joints 34 are not connected by diagonal wind braces 48. This pattern of two diagonal wind braces 48 connecting every other joint 34 continues for the length of the catwalk system 10.

Once the length of the catwalk system 10 is formed, walkway 50 is placed on top of floorbeams 46 and diagonal wind braces 48. Once in place, walkway 50 is screwed or bolted to the floorbeams 46.

In this way, a catwalk is quickly and easily assembled at a jobsite.

Side Connection:

With reference to FIGS. 25-46 an alternative arrangement of a joint 34 is presented that facilitates side connection of floorbeams 46 to side trusses 20. In this arrangement, joints 34 are formed of any suitable size, shape and design and are configured to facilitate connection of opposing side trusses 20 to one another in a fast and efficient manner while also being strong, durable and rigid. In the arrangement shown, as one example, joints 34 are formed of a pair of clip angles 100 that are connected to bottom cord 24 and vertical posts 28, and an end plate 102 and a pair of bottom plates 104 and a pair of side supports 106 that are connected to floorbeams 46, among other components as is described herein.

Clip Angles: Clip angles 100 are formed of any suitable size, shape and design and are configured to facilitate connection of floorbeam 46 to opposing side trusses 20, as well as to be connected to bottom cord 24 and vertical posts 28. In the arrangement shown, as one example, clip angles 100, when viewed from above or below are formed of a pair of planar members that connected in approximate perpendicular planar alignment to one another at a corner 108. Clip angles 100 may be formed of a single generally flat member that is bent or pressed into an angled piece at corner 108; clip angles 100 may be formed of a cast, molded or machined piece, clip angles 100 may be formed of a pair of planar members that are connected together at corner 108, or clip angles 100 may be formed by any other manner, method or means. In the arrangement shown, clip angles 100 form a pair of outwardly facing planar exterior surfaces 110 that are positioned in approximate perpendicular planar alignment to one another that connect to one another at an exterior side of corner 108. In the arrangement shown, clip angles 100 form a pair of inwardly facing planar interior surfaces 112 that are positioned in approximate perpendicular planar alignment to one another that connect to one another at an interior side of corner 108. Clip angles 100 extend a vertical distance between opposing upper and lower ends 114 and terminate at outward ends 116. In the arrangement shown, one side of clip angles 100 include hole 118 therein that is configured to receive a fastener 120 therein that facilitates connection of floorbeam 46 as is further described herein.

In the arrangement shown, as one example, clip angles 100 are positioned at the intersection of bottom cord 24 and vertical post 28. In one arrangement, a clip angle 100 is positioned on both opposing sides of vertical post 28. In this arrangement, the lower end 114 of clip angle 100 is placed in flat and flush planar engagement with the upper surface of bottom cord 24 and the exterior surface 110 of clip angle 100 is placed in flat and flush planar engagement with the side of vertical post 28.

In the arrangement shown, as one example, because vertical post 28 is narrower than bottom cord 24, the clip angle 100 is slid forward a distance such that the forward positioned exterior surface 110 having hole 118 therein is positioned in approximate planar alignment with the plane formed by the forward surface of bottom cord 24. This planar alignment facilitates planar engagement of between the forward surface of bottom cord 24 and the exterior surfaces 110 of clip angles 100 with the planar exterior surface of end plate 102 connected to floorbeam 46, as is further described herein.

Once clip angles 100 are positioned in the desired arrangement, all or a portion of the intersections between clip angles 100 and bottom cord 24 and vertical posts 28 are welded together. That is, in one arrangement, all or a portion of the intersection between the lower end 114 of clip angle 100 and upper surface of bottom cord 24 are welded together; all or a portion of the intersection between the upper end 114 of clip angle 100 and side of vertical post 28 are welded together; all or a portion of the intersection between the exterior surface 110 of clip angle 100 and forward surface of vertical post 28, and in the arrangement wherein the length of clip angle 100 extends rearward of vertical post 28 a distance, all or a portion of the intersection between the exterior surface 110 of clip angle 100 and the rearward surface of vertical post 28, as well as any other intersection. Connecting clip angle 100 by welding in this manner provides a strong connection that is dimensionally accurate due to the engagement and planar alignment of the components. In addition, connecting clip angle 100 in this manner is relatively quick and easy as well and welding provides a strong, durable and long lasting connection. In an alternative arrangement, clip angle 100 may be bolted to vertical post 28 by passing a fastener 120 through clip angle 100 and vertical post 28.

When clip angles 100 are installed on side trusses 20 in one arrangement, holes 118 in clip angles 100 are positioned in vertical alignment with holes 122 in bottom cord 24, although it is also contemplated that holes 118 and 122 are positioned in an unaligned manner. In addition, it is contemplated that any number of holes may be used in clip angles 100 and bottom cord 24 to facilitate connection of floorbeams 46. As is also shown, in one arrangement, a hole is placed at the lower forward edge of vertical post 28 that facilitates the drainage of water that may enter the inside of vertical post 28.

Floorbeams: In the side connection arrangement shown in FIGS. 25-46 floorbeams 46 are formed of any suitable size, shape and design and are configured to facilitate connection of opposing side trusses 20. In the arrangement shown, as one example, floorbeams 46 include an end plate 102 that is connected to opposing ends of floorbeam 46. In the arrangement shown, as one example, end plate 102 is generally flat and planar in shape, when viewed from the side, and generally square or rectangular in shape when viewed along the length of floorbeam 46. In the arrangement shown, as one example, end plate 102 closes or seals the end of floorbeam 46. In one arrangement, floorbeam 46 and end plate 102 are welded together, however it is hereby contemplated that floorbeam 46 and end plate 102 are connected by any other manner, method or means.

In one arrangement, as is shown, end plate 102 is generally square or rectangular in shape, when viewed along the length of floorbeam 46. When connected to floorbeam 46, the plane formed by end plate 102 is positioned in approximate perpendicular alignment to the length of floorbeam 46. When end plate 102 is connected to floorbeam 46, end plate 102 extends well beyond the exterior periphery of floorbeam 46.

In one arrangement, end plate 102 includes a plurality of holes 124 that are configured to align with the holes 118 in clip angles 100 and the holes 122 in bottom cord 24. Once aligned, fasteners 120 connect floorbeams 46 to side trusses 20 by passing fasteners 120 through end plate 102 and clip angles 100 as well as by passing fasteners 120 through end plate 102 and bottom cord 24. In one arrangement, additional holes 124 may be placed in end plate 102 to facilitate drainage of water from floorbeam 46 or from other portions of the joint 34.

In one arrangement, end plate 102 includes a recess 126. In the arrangement shown, as one example, recess 126 extends downward from the upper edge of end plate 102 and is roughly the width of vertical post 28. In the arrangement shown, as one example, the lower end of recess 126 terminates just above the upper surface of floorbeam 46 and includes a notch 128 therein that extends downward and terminates in approximate alignment with the upper surface of floorbeam 46. The combination of recess 126 and notch 128 facilitates the drainage of water and debris that may be captured between the outward facing surface of end plate 102 and the inward facing surfaces of vertical post 28, which is caused, in-part, by vertical post 28 being smaller than bottom cord 24. The addition of recess 126 and notch 128 to end plate 102 and joint 34 help to prevent water and debris build up that can cause rusting and deterioration of the components of joint 34 thereby and in this way the addition of recess 126 and notch 128 extends the life of joint 34.

In one arrangement, as is shown, a bottom plate 104 is positioned on opposing sides of floorbeam 46 and extends between the inward facing surface of end plate 102 and the exterior surface of floorbeam 46. In the arrangement shown, as one example, bottom plate 104 is formed of a generally flat and planar member, that when viewed from above or below is generally rectangular in shape. In the arrangement shown, as one example, one edge of bottom plate 104 is positioned in flat and planar engagement with the exterior surface of floorbeam 46, near the lower side of floorbeam 46, and another edge of bottom plate 104 is positioned in flat and planar engagement with the interior surface of end plate 102. In one arrangement, all or a portion of the engaging surfaces between end plate 102 and bottom plate 104, as well as all or a portion of the engaging surfaces between bottom plate 104 and the exterior surface of floorbeam 46 are welded together, thereby forming a strong and durable connection. The connection of bottom plate 104 to end plate 102 and floorbeam 46 strengthens the connection between these components.

In the arrangement shown, as one example, the outward corners of bottom plate 104 are rounded, so as to reduce the potential to catch on other components or cause injury. The upper surface of bottom plate 104 forms a generally flat and planar surface that is configured to receive and support an end of a diagonal wind brace 48 thereon. Bottom plate 104 includes a hole 130 therein that facilitates fastening of diagonal wind brace 48 to bottom plate 104 by receiving a fastener 54.

In the arrangement shown, as one example, while bottom plate 104 is positioned at the lower end of floorbeam 46, the lower surface of bottom plate 104 is positioned a distance "D" above the bottom surface of floorbeam 46. This distance "D" is equal to or is slightly greater than the height or thickness of the head 70 or length of the shaft of fastener 54 that is used to attach diagonal wind braces 48 to bottom plate 104. By spacing bottom plate 104 upward a distance "D" from the lower surface of floorbeam 46 this provides clearance for the head 70 of fastener 54 and allows for catwalk system 10 to be set directly on top of a transverse support beam, or another structural element, without the need to use fill plates, spacers or other additional components to avoid resting the catwalk system 10 on the fasteners 54 connecting diagonal wind braces 48 to bottom plates 104.

In one arrangement, as is shown, a side support 106 is positioned on opposing sides of floorbeam 46 and extends between the inward facing surface of end plate 102 and the exterior surface of floorbeam 46. In the arrangement shown, as one example, side supports 106 are positioned a distance above bottom plate 104. To facilitate access to bottom plate 104 by diagonal wind brace 48, side support 106 is smaller than bottom plate 104. In one arrangement, side support 106 is formed of a generally flat and planar member, that when viewed from above or below is generally triangular in shape. In the arrangement shown, as one example, one edge of side support 106 is positioned in flat and planar engagement with the exterior surface of floorbeam 46, near the upper side of floorbeam 46, and another edge of side support 106 is positioned in flat and planar engagement with the interior surface of end plate 102. In one arrangement, all or a portion of the engaging surfaces between end plate 102 and side support 106, as well as all or a portion of the engaging surfaces between side support 106 and the exterior surface of floorbeam 46 are welded together, thereby forming a strong and durable connection. The connection of side support 106 to end plate 102 and floorbeam 46 strengthens the connection between these components.

In one arrangement, as one example, end plate 102 also includes a plurality of locating slots 132. Locating slots 132 are configured to receive locating ears 134 that extend outward from the outward facing edge of side supports 106 that engage end plate 102. Locating slots 132 provide for precise alignment of side supports 106 and ensure that when side supports 106 are installed in the precise desired position on end plate 102. The use of locating slots 132 in end plate 102 and the associated ears 134 in side supports 106 also provides increased strength and rigidity to the connection between end plate 102 and side supports 106. In addition, by having the locating ear 134 of side support 106 extend into the locating slot 132 of end plate 102 this facilities convenient welding or tack welding of the side support 106 to end plate 102 and helps to hold the two components together prior to other manufacturing steps.

In Operation: In operation, disassembled parts including side trusses 20, floorbeams 46, diagonal wind braces 48, fasteners 54 and fasteners 120 (and the appropriate nuts) are shipped to the jobsite. The catwalk system 10 is assembled on site by placing a first side truss 20 and a second side truss 20 in opposing spaced relation. The holes 118 in clip angles 100 and the holes 122 in bottom cord 24 of first side truss 20 and second side truss 20 are aligned with one another and once aligned opposing end plates 102 of floorbeams 46 are placed in engagement with the inward facing surfaces of bottom cord 24 and clip angles 100.

More specifically, the exterior facing surface of end plates 102 are placed in planar engagement with the inward facing surfaces of bottom cord 24 and clip angles 100. Once in this planar engagement, the upper positioned holes 124 in end plates 102 are aligned with the holes 118 in clip angles 100. Similarly, once in this planar engagement, the lower positioned holes 124 in end plates 102 are aligned with the holes 122 in bottom cord 24. Once end plate 102 is aligned in this manner, fasteners 120 are passed through clip angles 100 and end plate 102, as well as through bottom cord 24 and end plate 102, and tightened in place. In this way, floorbeams 46 are quickly, easily, securely and precisely attached to side trusses 20. There are no tools required to attach floorbeams 46 to side trusses 20 other than a wrench that is needed to tighten fasteners 120, as such, there is no special equipment needed. In addition, there are no sophisticated manufacturing steps or processes.

The diagonal wind braces 48 are then installed by extending the diagonal wind braces 48 in a zig-zag pattern that extends from side truss 20 to side truss 20. The ends of diagonal wind braces 48 are placed on the wind brace sections of bottom plate 104. Holes in the ends of diagonal wind braces 48 are aligned with hole 130 in the bottom plate 104 of joint 34. Once the hole in the end of diagonal wind brace 48 is aligned with the hole 130 in the bottom plate 104, a fastener 54 is passed through the bottom plate 104 and diagonal wind brace 48 and tightened in place thereby affixing the diagonal wind brace 48 to the bottom plate 104.

Once sections 19 of catwalk system 10 are formed, adjacent sections 19 of catwalk system 10 are connected to one another by aligning the holes 52 in end plates 26 of adjacent sections 19 with one another. Once the holes 52 in opposing end plates 26 are aligned with one another fasteners 54 are passed through the opposing end plates 26 and tightened in place thereby affixing the opposing end plates 26 to one another thereby forming an elongated catwalk. This process is repeated until the desired length of the catwalk system 10 is achieved.

As diagonal wind braces 48 form a zig-zag pattern and extend from one side truss 20 to the other side truss 20 at an angle, two diagonal wind braces 48 connect to every other joint 34 along each side of catwalk system 10. That is, two diagonal wind braces 48 connect to one joint 34 whereas the immediately adjacent joints 34 are not connected by diagonal wind braces 48. This pattern of two diagonal wind braces 48 connecting every other joint 34 continues for the length of the catwalk system 10.

Once the length of the catwalk system 10 is formed, walkway 50 is placed on top of floorbeams 46 and diagonal wind braces 48. Once in place, walkway 50 is screwed or bolted to the floorbeams 46.

In this way, a catwalk is quickly and easily assembled at a jobsite. This system provides an arrangement where there are no lose plates or pieces or intricate parts that must be assembled at the job site. In addition, the use of clip angles 100 eliminates the need to weld a plate to the side of the bottom cord 24 thereby eliminating the potential for pack rust between the bottom cord 24 and the welded plate. In addition, the use of clip angles 100 with a hole 118 in the clip angle 100 allows for floorbeams 46 of varying size to be used by simply moving the position of holes 118 in clip angle 100 and holes 122 in bottom cord 24 and holes 124 in end plate 102. In addition, by positioning the bottom plate 104 a distance above the lower surface of floorbeam 46 this provides room or relief for fasteners 54 which allows the catwalk to be placed directly on top of a transverse support beam without the need to use fill plates to avoid resting on the fasteners connecting the diagonal wind braces 48 the joints 34.

Rocker Bearing System:

Due to the immense size of many grain bin storage facilities 12, coupled with the extreme size and height of modern commercial grain bins 14 relative movement of catwalk system 10 with respect to other components often occurs and should be accounted for. The source of relative movement of catwalk system 10 may be due to high winds, sagging over time, thermal expansion or thermal contraction due to temperature fluctuations, seismic events, shifting or settling of components, compression due to filling or loading or by any number of other events. If this relative movement is constrained, additional stresses may be placed upon catwalk system 10 that could lead to premature failure of the catwalk system. In these applications, care must be taken to facilitate and account for the relative movement of catwalk system 10.

In addition, in many applications the catwalk system 10 does not extend in a horizontal plane and instead the catwalk system 10 extends at an angle to the horizontal plane. In these applications, care must be taken to facilitate and account for the angular extension of catwalk system 10.

In one arrangement, with reference to FIGS. 47-62, a rocker bearing system 200 is presented that facilitates the angular extension of catwalk system 10, as well as facilitates the relative movement of catwalk system 10, while facilitating support to be provided to catwalk system 10. Rocker bearing system 200 may be formed of any suitable size, shape and design. The use of a rocker bearing system 200 allows for support to be provided to catwalk system 10, such as at any portion of the catwalk system 10, such as at mid-span, while also allowing catwalk system 10 to extend at an angle. The use of a rocker bearing system 200 allows for support to be provided to an angularly extending catwalk system 10 using a horizontally positioned support member 202 without further accommodation. The use of a rocker bearing system 200 eliminates the need to position support members 202 at the precise angle at which the catwalk system 10 extends. The use of a rocker bearing system 200 allows for support to be provided to catwalk system 10 despite variations in the angle of extension of catwalk system 10 due to temperature fluctuations, high winds, seismic events, loading or unloading stresses, or the like. The use of a rocker bearing system 200 allows for support to be provided to catwalk system 10 despite movement of catwalk system 10 relative to a support member 202 or other components of the system 10 due to temperature fluctuations, high winds, seismic events or the like. The use of a rocker bearing system 200 is also self-adjusting, that is, as the angle of catwalk system 10 changes the rocker bearing system 200 self-adjusts.

In the arrangement shown, as one example, a rocker bearing system 200 is positioned between the upper surface of a support member 202 and the lower surface of catwalk system 10. More specifically, in the arrangement shown, as one example, a rocker bearing system 200 is positioned between the upper surface of a support member 202 and below the lower surface of both opposing bottom cords 24 of a section 19 of catwalk system 10. In this position, rocker bearing system 200 allows support to be provided by support member 202 to catwalk system 10 while also allowing for varying angles of catwalk system 10, outside of horizontal as well as allowing for some relative movement of catwalk system 10 relative to support member 202.

Support member 202 may be formed of any suitable size, shape and design and is configured to provide support to catwalk system 10. In one arrangement, as is shown, support member 202 is formed of a length of an I-beam that extends in a generally horizontal manner between, and past, opposing bottom cords 24 of catwalk system 10, however any other shaped structural member, or members, is hereby contemplated for use as support member 202 such as a square tube, a rectangular tube, a wide flange beam, a 90 degree angle bar, a Z-bar, a C-channel, an L-bar, a cylindrical pipe, a solid bar, a solid rod, a plurality of frame members, or the like or any combination thereof.

Rocker bearing system 200 is formed of any suitable size, shape and design. In the arrangement presented, as one example, rocker bearing system 200 includes a bottom section 204 and a top section 206, the bottom section 204 having a bottom plate 208, a pair of end plates 210, and a stiffener 212 that extends between the end plates 210, the top section 206 having a top plate 214, a forward plate 216, a rearward plate 218 and a rocker pin 220, among other components and features as is described herein.

Bottom plate 208 is formed of any suitable size, shape and design and is configured to facilitate connection of rocker bearing system 200 to the upper surface of a horizontally extending support member 202. In one arrangement, as is shown, bottom plate 208 is formed of a generally flat and planar member that when viewed from above or below is formed in a generally square or rectangular shape, however any other shape is hereby contemplated for use. In one arrangement, as is shown, the generally flat and planar shape of bottom plate 208 facilitates flat and flush planar engagement with the upper surface of support member 202. In this way, the generally planar bottom surface of bottom plate 208 provides a stable and broad support area for rocker bearing system 200 to rest upon support member 202. In one arrangement, a hole 222 is positioned adjacent each corner of bottom plate 208. These holes 222 are configured to receive fasteners 224 therein that facilitate a strong and rigid connection to support member 202.

In the arrangement shown, as one example, a pair of end plates 210 connect to, and extend upward from, the upper surface of bottom plate 208 in approximate parallel spaced relation to one another. End plates 210 are formed of any suitable size, shape and design and are configured to facilitate connection to bottom plate 208 as well as receive and provide support for rocker pin 220. In one arrangement, as is shown, end plates 210 are formed of a generally flat and planar member that when viewed from the front or back (which is perpendicular to the length of catwalk system 10), have a generally flat bottom surface that connects at its outward edges to generally vertically extending side surfaces. These side surfaces of end plates 210 begin to taper toward one another at corners as they extend upward, however any other shape is hereby contemplated for use. A recess 226 is generally centrally positioned in the upper end of end plates 210. When viewed from the front or back (which is perpendicular to the length of catwalk system 10) recess 226 is generally semi-circular in shape, or curved, and is configured to receive rocker pin 220 therein. Recess 226 is configured to receive and hold rocker pin 220 while allowing rocker pin 220 to rotate. In this way, the rotation of rocker pin 220 within recess 226 facilitates infinite angular adjustment and accommodation.

In the arrangement shown, as one example, a stiffener 212 connects to the upper surface of bottom plate 208 as well as connects to the opposing inward facing surfaces of end plates 210. Stiffener 212 is formed of any suitable size, shape and design and is configured to connect opposing end plates 210 as well as connect to bottom plate 208. In one arrangement, as is shown, stiffener 212 is formed of a generally flat and planar member that when viewed from the side (which is along the length of catwalk system 10) is generally square or rectangular in shape. In this arrangement, the lower edge of stiffener 212 engages the upper surface of bottom plate 208 and its outward edges engages the inward facing surfaces of end plates 210 in generally flat and flush planar alignment and engagement.

In one arrangement, the bottom edge of stiffener 212 includes an ear 228 that is received within a locating slot 230 in bottom plate 208. Also, in one arrangement, the outward edges of stiffener 212 include an ear 232 that is received within a locating slot 234 in end plates 210. The use of locating slots 230 and 234, provide for precise alignment of stiffener 212, end plates 210 and bottom plate 208 with respect to one another within close and tight tolerances. The use of locating slots 230 and 234 in bottom plate 208 and end plates 210 and the associated ears 228 and 232 in stiffener 212 provides increased strength and rigidity to the connection between bottom plate 208, stiffener 212 and end plates 210. In addition, by having the ear 228 and 232 extend into locating slots 230 and 234 this facilitates convenient welding or tack welding of the stiffener 212 to bottom plate 208 and to end plates 210 to hold the components together prior to other manufacturing steps.

In the arrangement shown, as one example, the upper end of stiffener 212 terminates just below the lower edge of recess 226 in end plates 210 so as not to interfere with the rotatable engagement between recess 226 of end plates 210 and rocker pin 220. In another arrangement shown, the upper end of stiffener 212 terminates in a continuous manner with the lower edge of recess 226 in end plates 210 and in this arrangement, the upper surface of stiffener 212 serves as part of the bearing surface that facilitates rotatable engagement between recess 226 of end plates 210 and rocker pin 220.

Top plate 214 is formed of any suitable size, shape and design and is configured to facilitate connection of rocker bearing system 200 to the lower surface of a catwalk system 10, or more specifically the lower surface of a bottom cord 24. In one arrangement, as is shown, top plate 214 is formed of a generally flat and planar member that when viewed from above or below is formed in a generally square or rectangular shape, however any other shape is hereby contemplated for use. In one arrangement, as is shown, the generally flat and planar shape of top plate 214 facilitates flat and flush planar engagement with the lower surface of bottom cord 24 of catwalk system 10. In this way, the generally planar upper surface of top plate 214 provides a stable support area for engaging bottom cord 24 of catwalk system 10.

In the arrangement shown, as one example, forward plate 216 connects to the forward end of top plate 214. Forward plate 216 is formed of any suitable size, shape and design and is configured to facilitate connection to top plate 214 as well as receive and provide support for rocker pin 220.

In one arrangement, as is shown, forward plate 216 is formed of a generally flat and planar member that when viewed from the front or back (which is perpendicular to the length of catwalk system 10), has a generally flat upper surface that is positioned a distance above the plane formed by the upper surface of top plate 214. This upper surface of forward plate 216 connects at its outward edges to generally vertically extending side surfaces, that extend downward a distance before they begin to taper toward one another at corners before connecting to one another at a rounded lower end. However any other shape is hereby contemplated for use.

In one arrangement, top plate 214 includes a pair of ears 236 that are each received within a locating slot 238 in forward plate 216 on opposing sides of rocker pin 220. The use of locating slots 238 in forward plate 216 and the associated ears 236 in top plate 214 provides increased strength and rigidity to the connection between top plate 214 and forward plate 216. In addition, by having the ears 236 extend into locating slots 238 this facilitates convenient welding or tack welding of the forward plate 216 and top plate 214 to hold these components together prior to other manufacturing steps.

In the arrangement shown, as one example, rearward plate 218 connects to the rearward portion of top plate 214. Rearward plate 218 is formed of any suitable size, shape and design and is configured to facilitate connection to top plate 214 as well as receive and provide support for rocker pin 220.

In one arrangement, as is shown, rearward plate 218 is formed of a generally flat and planar member that when viewed from the front or back (which is perpendicular to the length of catwalk system 10), has a generally flat upper surface that is in flat and flush planar engagement with the lower surface of top plate 214. This upper surface of rearward plate 218 connects at its outward edges to side surfaces that extend downward as they extend inward toward one another before connecting to one another at a rounded lower end. However any other shape is hereby contemplated for use.

In one arrangement, rearward plate 218 includes at least one ear 240 that is received within a locating slot 242 in top plate 214. The use of locating slot 242 in top plate 214 and the associated ear 240 in rearward plate 218 provides increased strength and rigidity to the connection between top plate 214 and rearward plate 218. In addition, by having the ear 240 extend into locating slots 242 this facilitates convenient welding or tack welding of the rearward plate 218 and top plate 214 to hold these components together prior to other manufacturing steps.

In the arrangement shown, as one example, when forward plate 216 and rearward plate 218 are connected to top plate 214, forward plate 216 and rearward plate 218 extend in approximate parallel spaced relation to one another. In this arrangement, rocker pin 220 is received in and extends through forward plate 216 and rearward plate 218 at or a distance below the lower surface of top plate 214. In the arrangement shown, rocker pin 220 extends through forward plate 216 and rearward plate 218 in a generally perpendicular alignment to the planes established by forward plate 216 and rearward plate 218. In the arrangement shown, rocker pin 220 extends in a generally parallel manner to the plane established by top plate.

The upper surface of forward plate 216 extends upward a distance above the upper surface of top plate 214. This upward extension forms a lip such that when two rocker bearings 200 are placed on a support member 202, the forward plates 216 are positioned on the outward sides of bottom cords 24. In this way, the extension of forward plate 216 above top plate 214 forms a lip or channel that helps to retain catwalk system 10 therein. Other than the lip formed by top plate 214, the upper surface of top plate 214 is generally flat and allows for catwalk system 10 to slide on or over the upper surface of top plate 214.

Rocker pin 220 is formed of any suitable size, shape and design and is configured to facilitate angular rotation of rocker bearing system 200. In one arrangement, rocker pin 220 is a generally cylindrically shaped member that extends through forward plate 216 and rearward plate 218 in a generally perpendicular manner at or a distance just below the lower surface of top plate 214.

In Operation: Rocker bearing system 200 is used in association with catwalk system 10 to accommodate angular and relative movement of catwalk system 10. In one arrangement, bottom section 204 is attached to the upper surface of support member 202 in the desired position by passing fasteners 224 through holes 222 in bottom plate 208 and tightening the two components together. In this way, rocker bearing system 200 is rigidly attached to support member 202. Top section 206 of rocker bearing system 200 is placed on bottom section 204 such that the rocker pin 220 is received within the recess 226 in the upper ends of end plates 210. In this positon, the forward plate 216 of top section 206 is positioned just outside of the forward positioned end plate 210 of bottom section 204, and the reward plate 218 is positioned just outside of the rearward positioned end plate 210, which maintains the proper positioning and alignment of top section 206 with respect to bottom section 204. Once top section 206 is engaged with bottom section 204, top section 206 may rotate upon the engagement between the bearing surface of bottom section 204, namely recess 226, and the curved exterior surface of rocker pin 220.

Care is taken to install a pair of rocker bearings 200 on the upper surface of support member 202 a distance away from one another such that opposing bottom cords 24 are received upon the upper surface of top plate 214 and between opposing upwardly extending portions of forward plate 216. That is, care is taken to ensure that the upwardly extending flange formed by the upper end of forward plate 216 that extends above top plate 214 of opposing rocker bearings 200 are positioned facing away from one another such that the catwalk system 10 is received between the opposing flanges of forward plates 216. In this way, catwalk system 10 is captured between forward plates 216, while allowing relative movement of catwalk system 10. Said another way, when assembled in this manner, bottom cords 24 of section 19 of catwalk system 10 rest upon the upper surface of top plates 214 between forward plates 216, thereby holding the catwalk system 10 between and upon opposed rocker bearings 200.

During use, as the wind blows, as the grain bins 14 are loaded and unloaded, as temperatures change, as stresses change, catwalk system 10 bends and flexes, contracts and expands. As the length of catwalk system 10 extends or contracts, the lower surface of bottom cords 24 slide over the upper surface of top plate 214. In this way, support is provided to catwalk system 10 by rocker bearing system 200 while allowing for expansion and contraction of catwalk system 10. As the angle of catwalk system 10 varies, the top section 206 rotates relative to the bottom section 204 as the bearing surface of rocker pin 220 rotates within the bearing surface of the cradle formed by recess 226. In this way, support is provided to catwalk system 10 by rocker bearing system 200 while allowing for angular variation of catwalk system 10.

Spreader Beam Kit:

Due to the immense size of many grain bin storage facilities 12, some catwalk systems 10 extend great lengths. In these applications it may be necessary to spread the support provided to catwalk system 10 over more than just a single point of contact. Instead, in these cases, the support must be spread across a greater area than just a single point of contact.

With reference to FIGS. 63-78 a spreader beam kit 300 is presented. Spreader beam kit 300 is formed of any suitable size, shape and design and is configured to provide support to catwalk system 10 while spreading the support across a greater area and/or across multiple points of contact. This is as opposed to providing all the support to single focused area of catwalk system 10. As such, the use of spreader beam kit 300 facilitates providing a greater amount of support to catwalk system 10, which may be useful and/or needed in longer spans and heavier applications.

In the arrangement shown, as one example, spreader beam kit 300 includes a pair of spreader beams 302 and a pair of cross braces 304. In the arrangement shown, as one example, spreader beams 302 are formed of a length of an I-beam, however any other shaped structural member is hereby contemplated for use as spreader beam 302 such as a square tube, a wide flange beam, a 90 degree angle bar, a Z-bar, a C-channel, an L-bar, a cylindrical pipe, a solid bar, a solid rod, a plurality of frame members, or the like or any combination thereof. Similarly, in the arrangement shown, as one example, cross braces 304 are formed of a length of a C-channel beam, however any other shaped structural member is hereby contemplated for use as cross brace 304 such as an I-beam, a square tube, a wide flange beam, a 90 degree angle bar, a Z-bar, an L-bar, a cylindrical pipe, a solid bar, a solid rod, a plurality of frame members, or the like or any combination thereof.

In the arrangement shown, as one example, spreader beams 302 are positioned in approximate parallel spaced relation to one another. Cross braces 304 are connected to the inward facing surfaces of opposing spreader beams 302 adjacent their outward ends. Cross braces 304 extend in approximate parallel spaced relation to one another, and cross braces 304 extend in approximate perpendicular relation to spreader beams 302. In this way, the connection of opposed spreader beams 302 by opposing cross braces 304 forms a generally square or rectangular member, when viewed from above or below.

In the arrangement shown, spreader beams 302 are formed of a length of an I-beam, however any other configuration of a beam or support member is hereby contemplated for use. In the arrangement where spreader beam 302 is formed of an I-beam, spreader beam 302 forms a pair of channels along the sides of the spreader beam 302. These opposing channels are defined by the inward facing surfaces of the upper and lower flanges of the spreader beam 302 and the center wall of the spreader beam 302. In this arrangement, wherein spreader beam 302 is an I-beam, cross braces 304 are formed of a length of a C-channel which is sized and shaped to fit within the channel formed in the side of spreader beam 302. When the ends of a cross brace 304 are positioned within the channel of a spreader beam 302 the exterior surface of the upper and lower flanges of the cross brace 304 are positioned in approximate planar alignment and/or engagement with the interior surfaces of the upper and lower flanges of spreader beam 302. In this positon, the end of the cross brace 304 is positioned in alignment and/or engagement with the center wall of spreader beam 302.

In one arrangement, flanges 306 are positioned within the channels of spreader beam 302 and facilitate connection of cross braces 304 to spreader beams 302. In the arrangement shown, as one example, flanges 306 are formed of a generally flat and planar member that connects at its upper and lower edges to the interior surface of the upper and lower flanges of spreader beam 302, and connect at its inward edge to the center wall of spreader beam 302. In one arrangement, flanges 306 are welded into spreader beams 302, however any other manner, method or means of connecting flanges 306 to spreader beam 302 is hereby contemplated for use. Once attached, flanges 306 enclose the channels of spreader beam 302.

In the arrangement shown, flanges 306 include one or more holes 308 therein that are configured to receive fasteners 310 that extend through and connect cross braces 304 to spreader beams 302. In this way, cross braces 304 connect to spreader beams 302 in a precise, strong and durable manner with close and tight tolerances. When spreader beams 302 and cross braces 304 are connected together a strong, rigid and durable square or rectangular member is formed.

Figure 63:
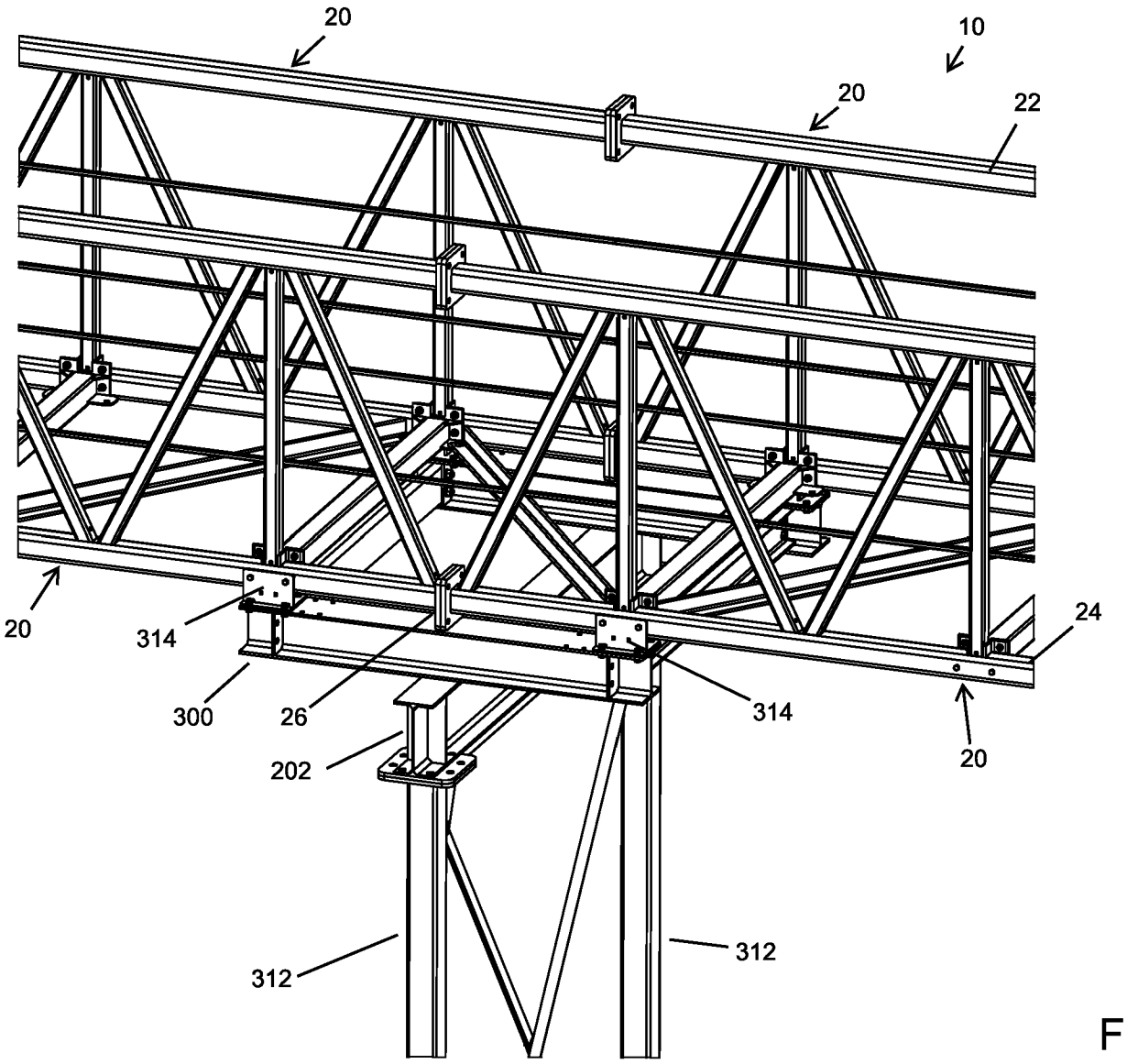
FIG. 63 is a perspective view of a spreader beam kit formed of a pair of opposing spreader beams and a pair of opposing cross braces that connect to one another, the view showing the spreader beams resting upon a support member that is itself supported by a pair of legs; the view showing the spreader beams connected to the bottom cord of side trusses at joints by mounting brackets that are positioned below vertical posts that extend between top cords and bottom cords of side trusses.
Figure 64:
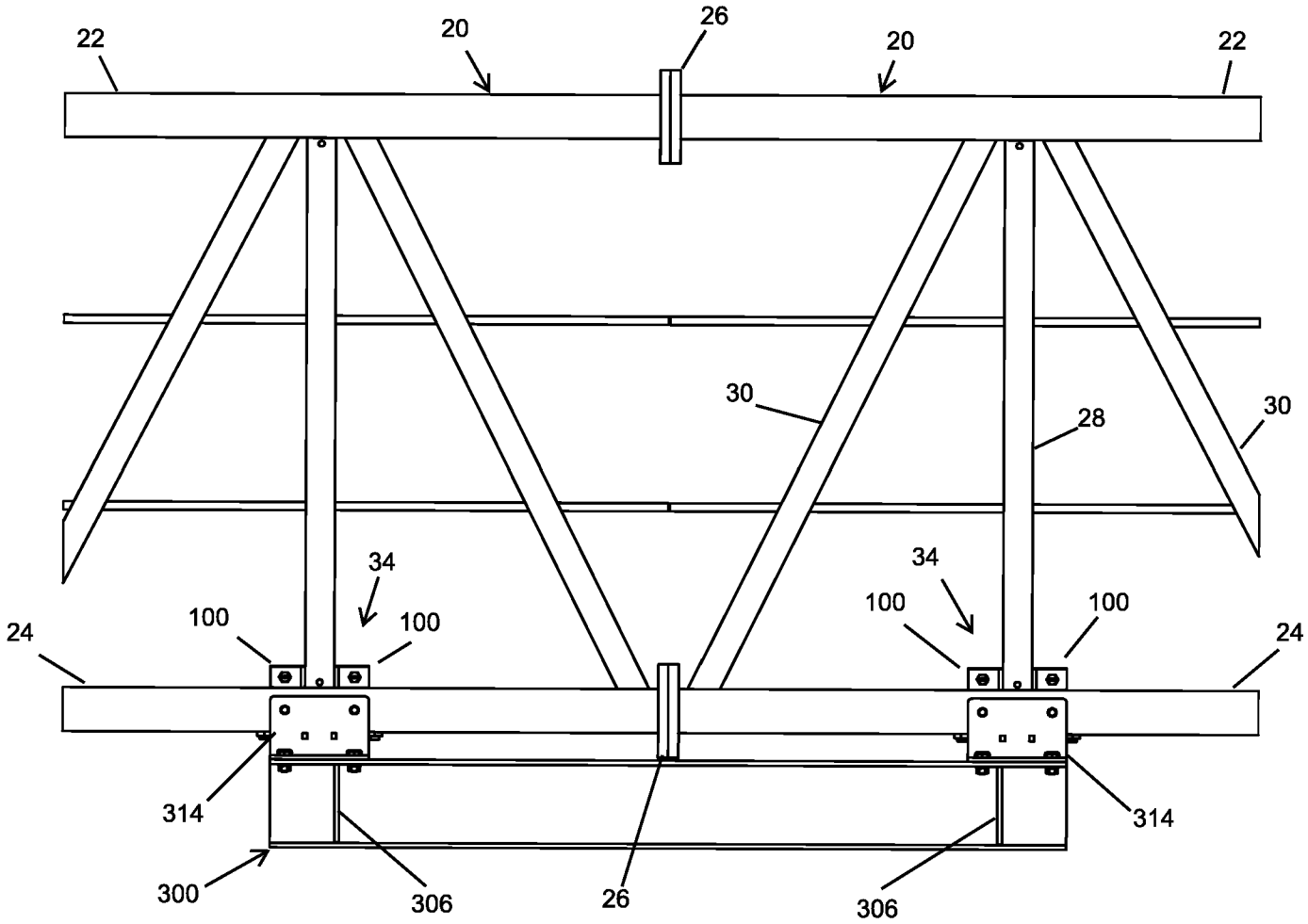
FIG. 64 is a side elevation view of a spreader beam kit formed of a pair of opposing spreader beams and a pair of opposing cross braces that connect to one another, the view showing the spreader beam connected to a bottom cord of a side trusses at a pair of joints by a mounting bracket that are positioned below a vertical post that extends between top cords and bottom cords of the side truss.
Figure 65:
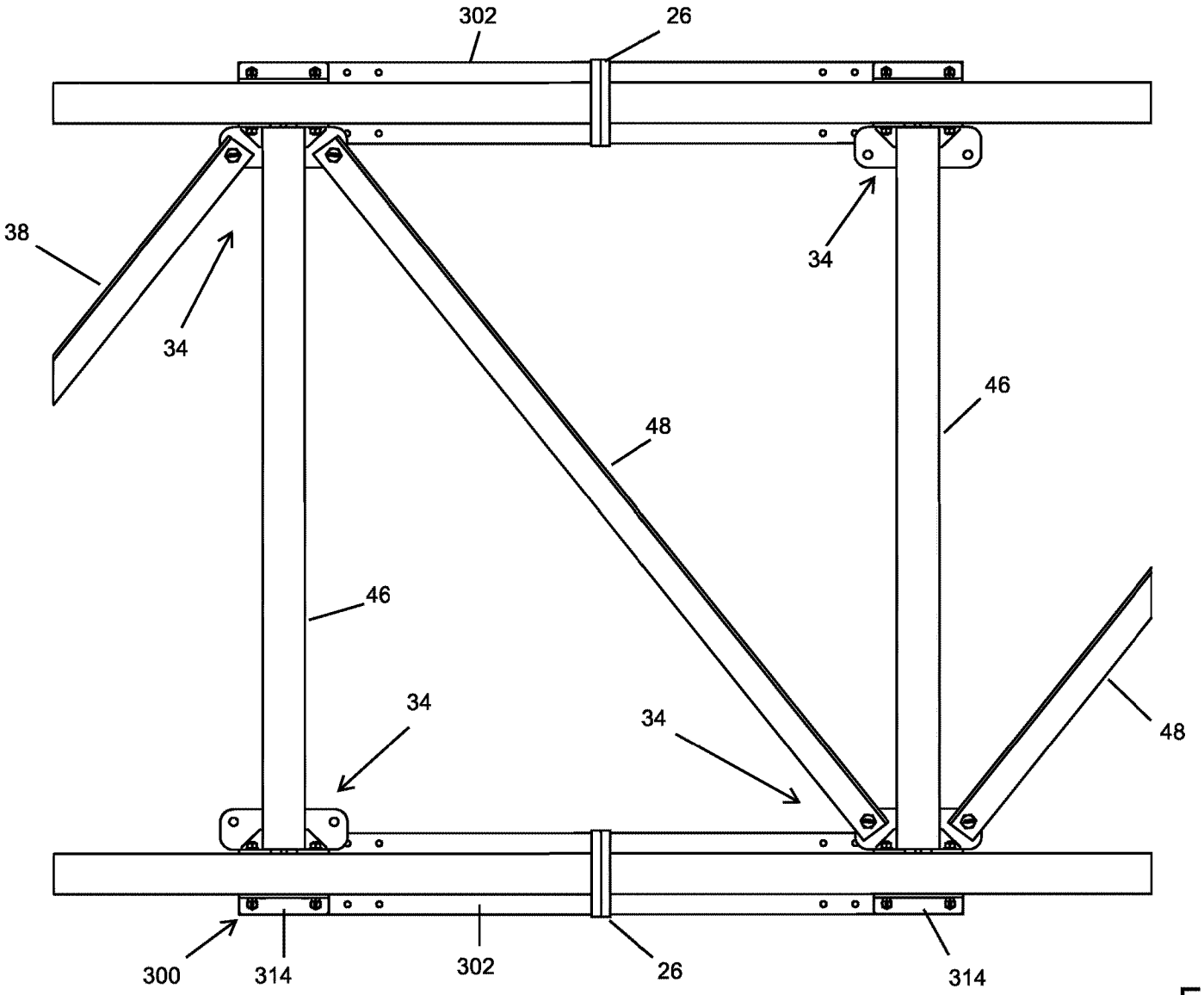
FIG. 65 is a top elevation view of a spreader beam kit formed of a pair of opposing spreader beams and a pair of opposing cross braces that connect to one another, the view showing the spreader beams connected to a bottom cord of a side trusses at a pair of joints by a mounting bracket; the view showing floorbeams extending between opposing side trusses at joints; the view also showing diagonal wind braces 48 extending at an angle between opposing side trusses between opposing joints.
Figure 66:
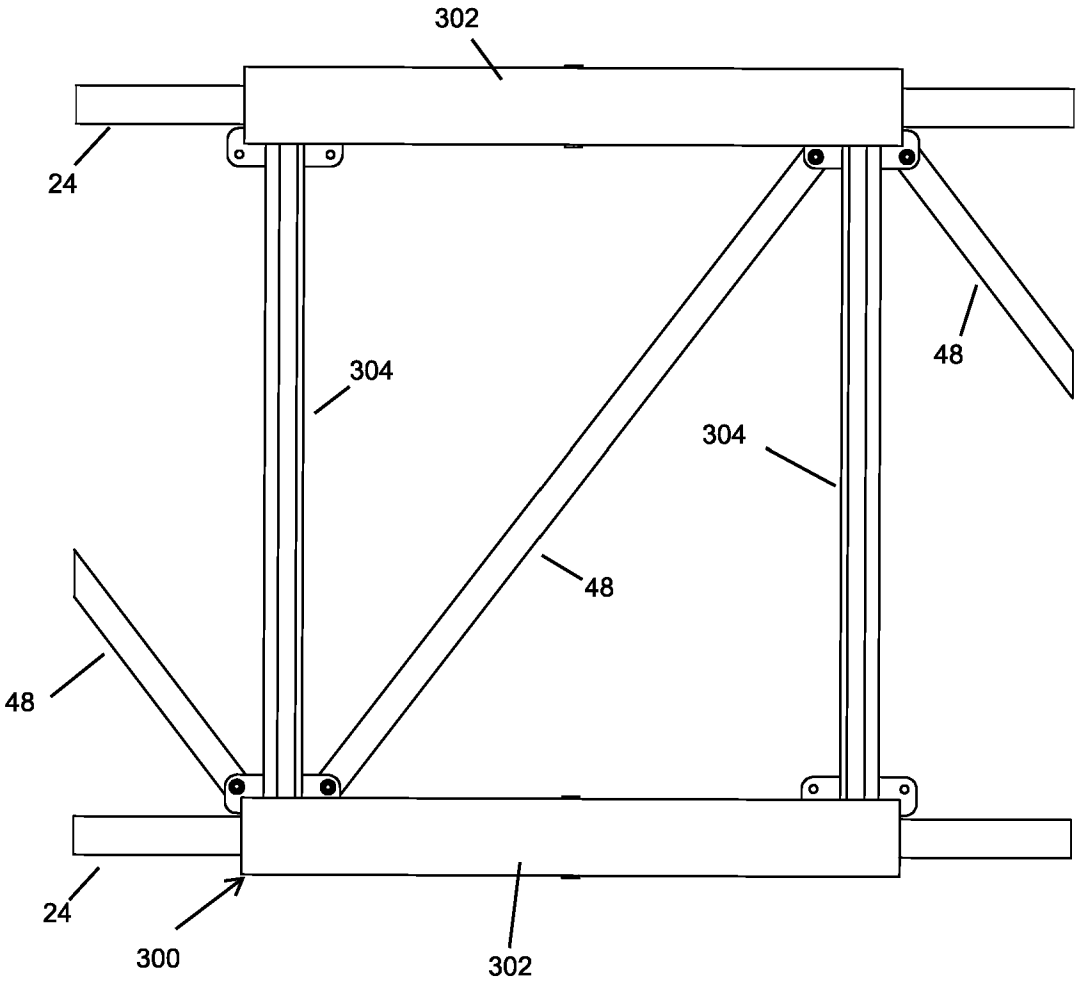
FIG. 66 is a bottom elevation view of what is shown in FIG. 65.
Figure 67:
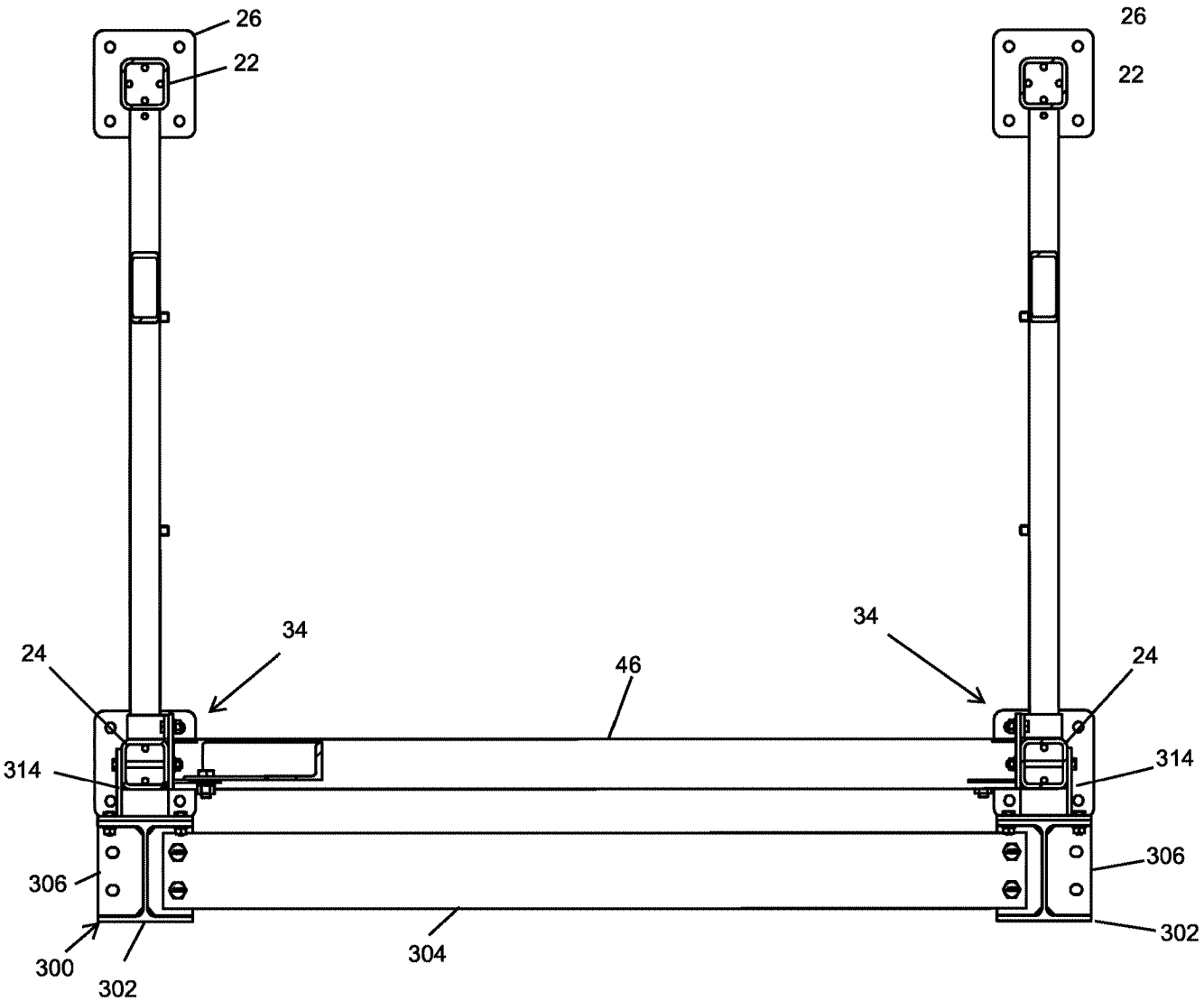
FIG. 67 is an elevation view along the length of the catwalk, the view showing a spreader beam kit formed of a pair of opposing spreader beams and a pair of opposing cross braces that connect to one another; the view showing the spreader beams connected to a bottom cord of opposing side trusses at a pair of joints by a mounting bracket; the view showing floorbeams extending between opposing side trusses at joints.
Figure 68:
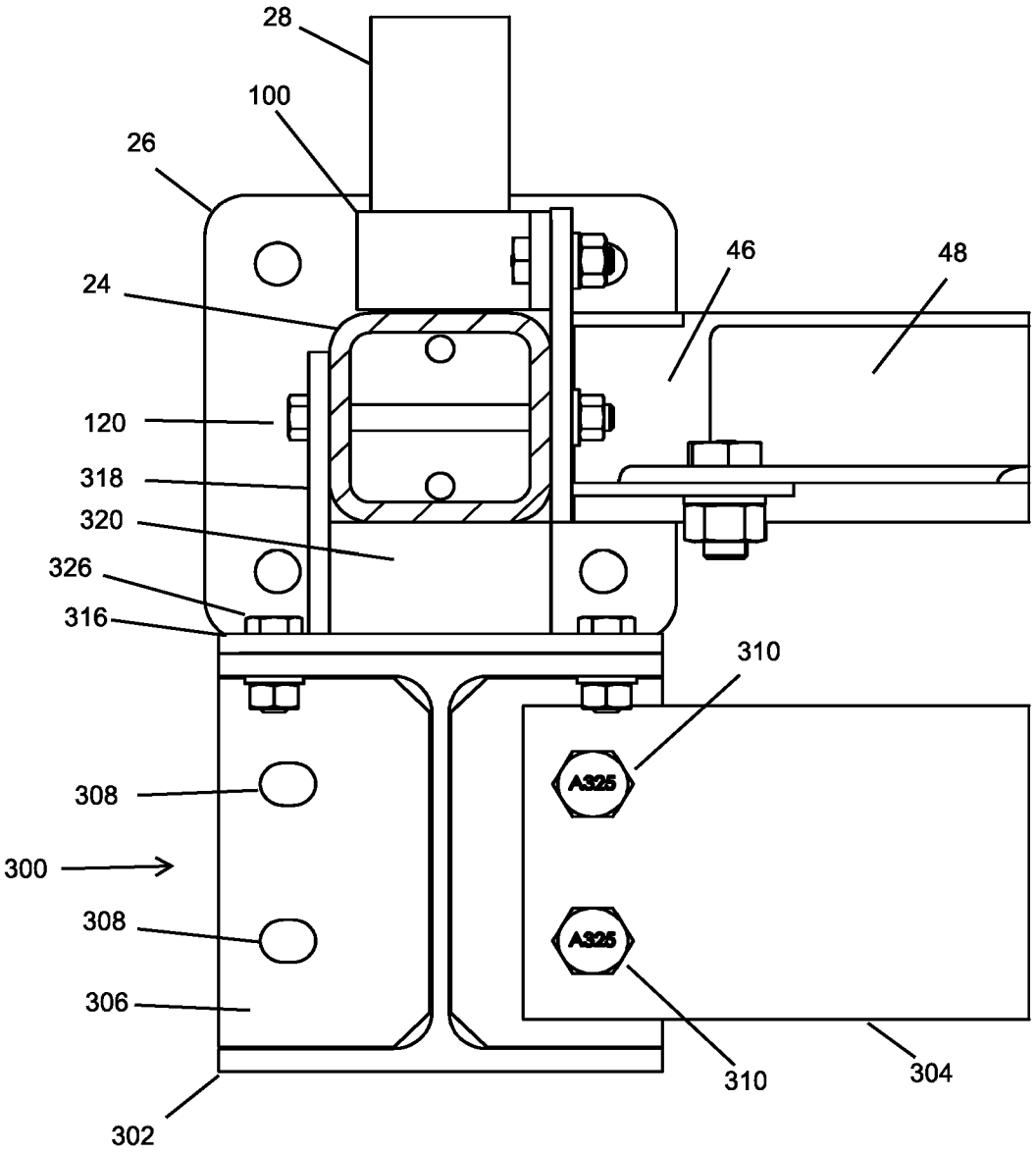
FIG. 68 is a close up elevation view along the length of the catwalk, the view showing the connection between a spreader beam and a bottom cord of a side truss, the view showing a spreader beam formed of an I-beam having a generally flat upper and lower surface separated by a center wall that forms a channel along each side of the center wall; the view showing a flange positioned within the channel between the inward facing surfaces of the upper and lower walls and the center wall; the view showing a cross brace connected to the inward position flange; the view showing a mounting bracket connected to the upper surface of the spreader beam; the view showing the mounting bracket having a bottom plate, a side plate and a center plate; the view showing a bottom cord of a side truss connected to the mounting bracket with the bottom surface of the bottom cord in engagement with the upper surface of the center wall, and the outer surface of the bottom cord in engagement with the interior surface of the upper end of the side plate; the view showing the lower edge of the end plate connected to bottom cord in flat and flush engagement or spaced alignment with the upper surface of the spreader beam.
Figure 69:
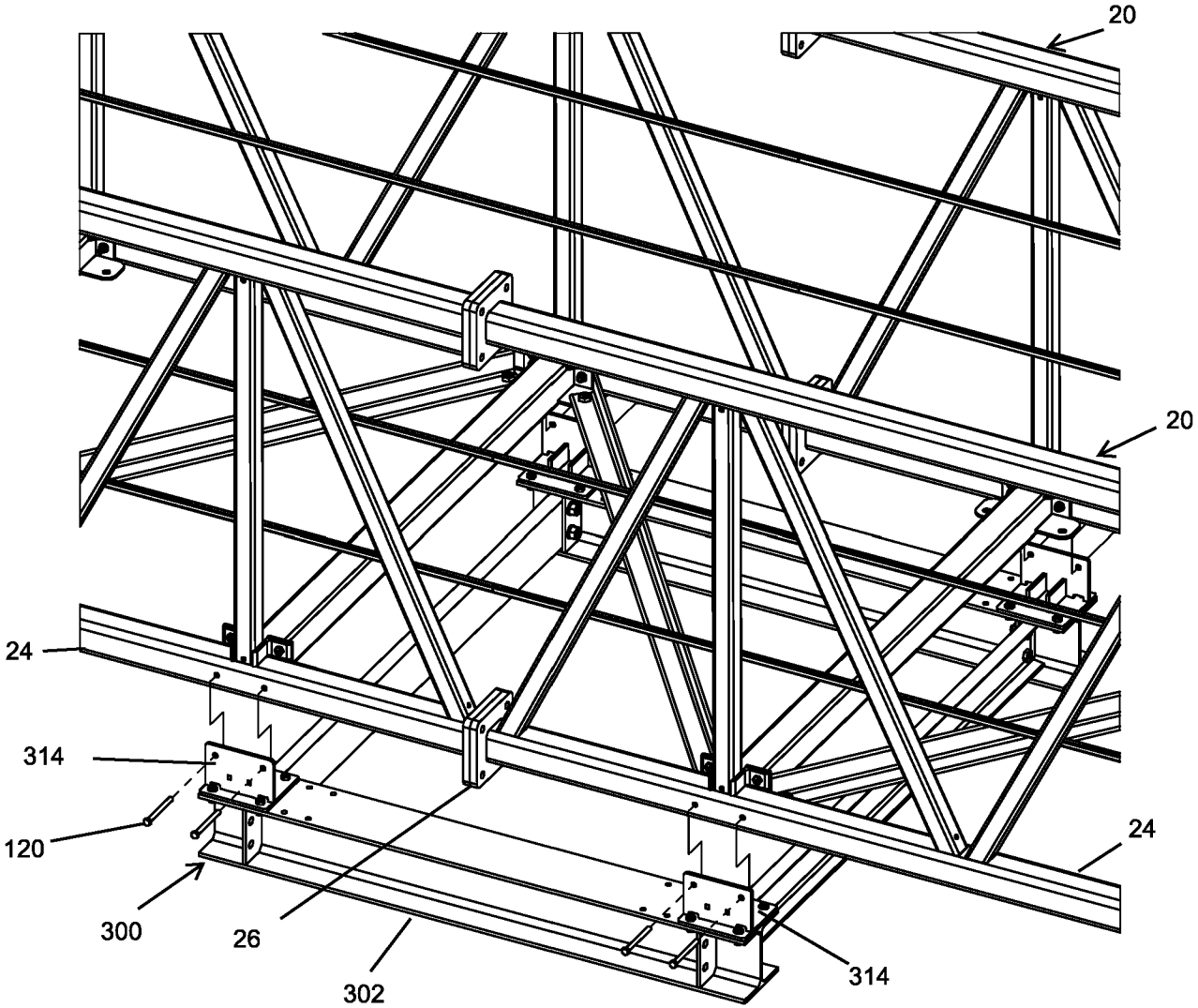
FIG. 69 is a perspective exploded view of a spreader beam kit formed of a pair of opposing spreader beams and a pair of opposing cross braces that connect to one another, the view showing the mounting brackets and spreader beams exploded from the bottom cord of the catwalk.
Figure 70:
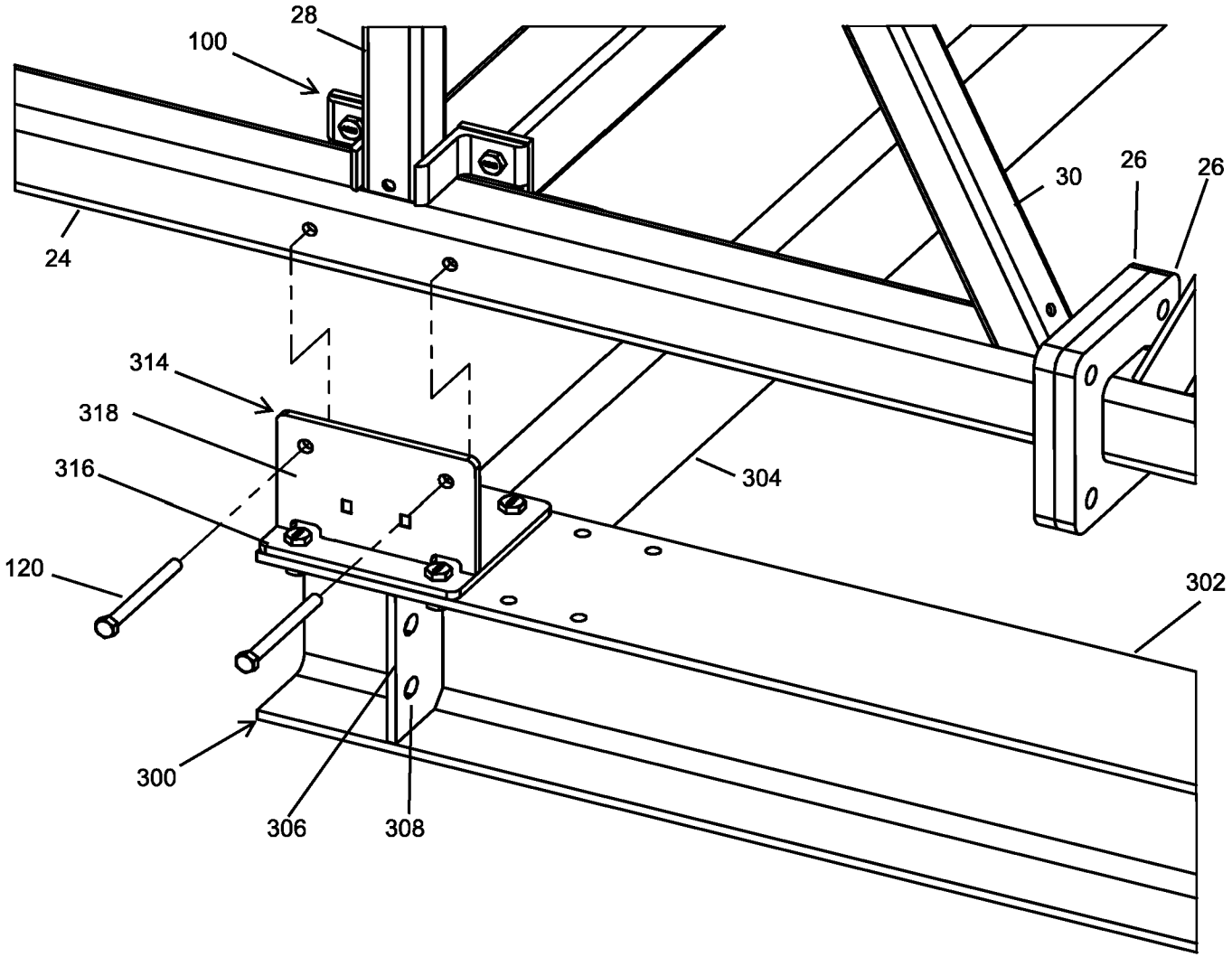
FIG. 70 is a close up perspective exploded view of a spreader beam kit formed of a pair of opposing spreader beams and a pair of opposing cross braces that connect to one another, the view showing the mounting brackets and spreader beams exploded from the bottom cord of the catwalk.
Figure 71:
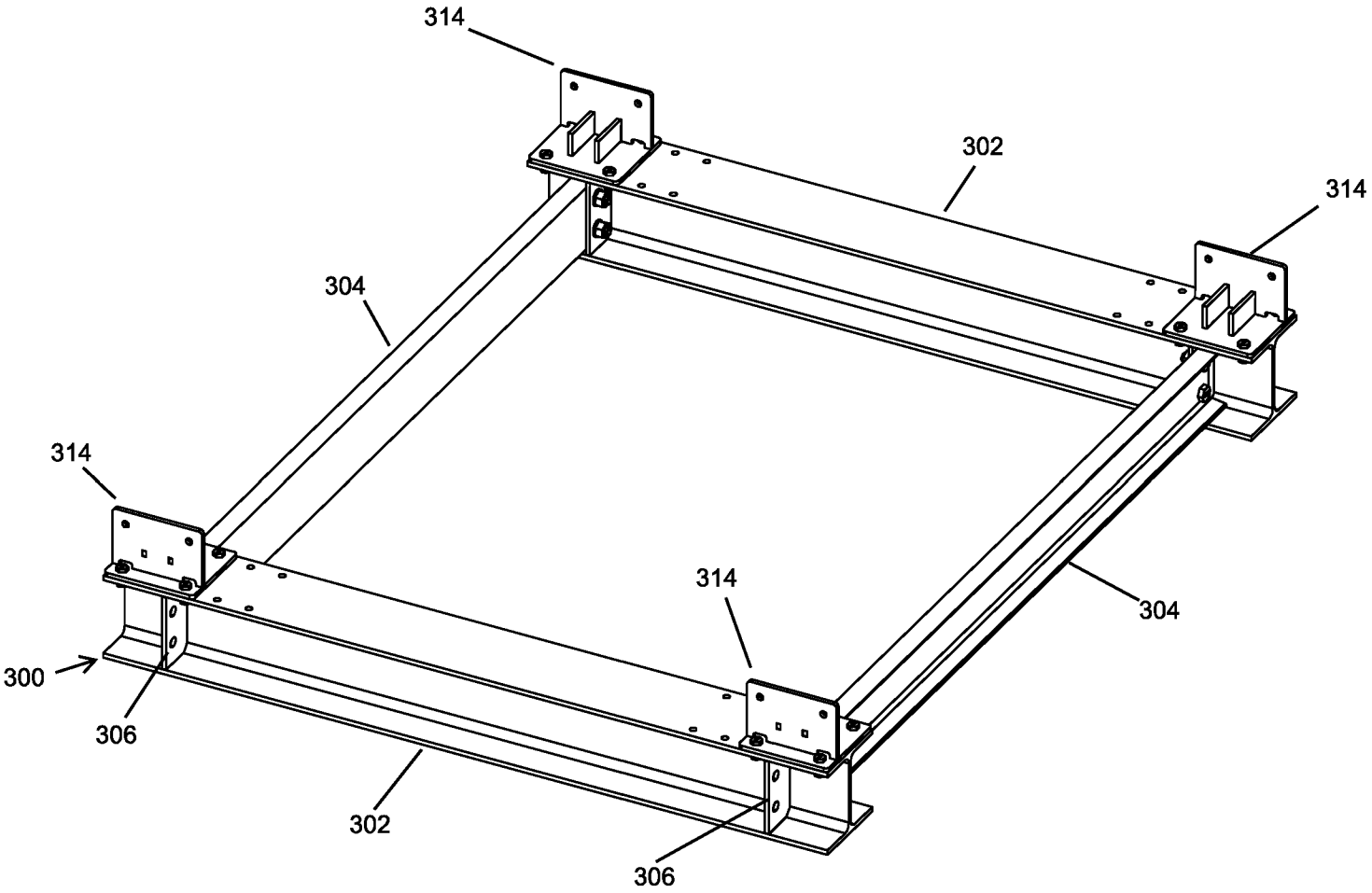
FIG. 71 is a perspective view of the top side of a spreader beam kit formed of a pair of opposing spreader beams and a pair of opposing cross braces that connect to one another, the view showing the mounting brackets connected to the upper surface of the spreader beams.
Figure 72:
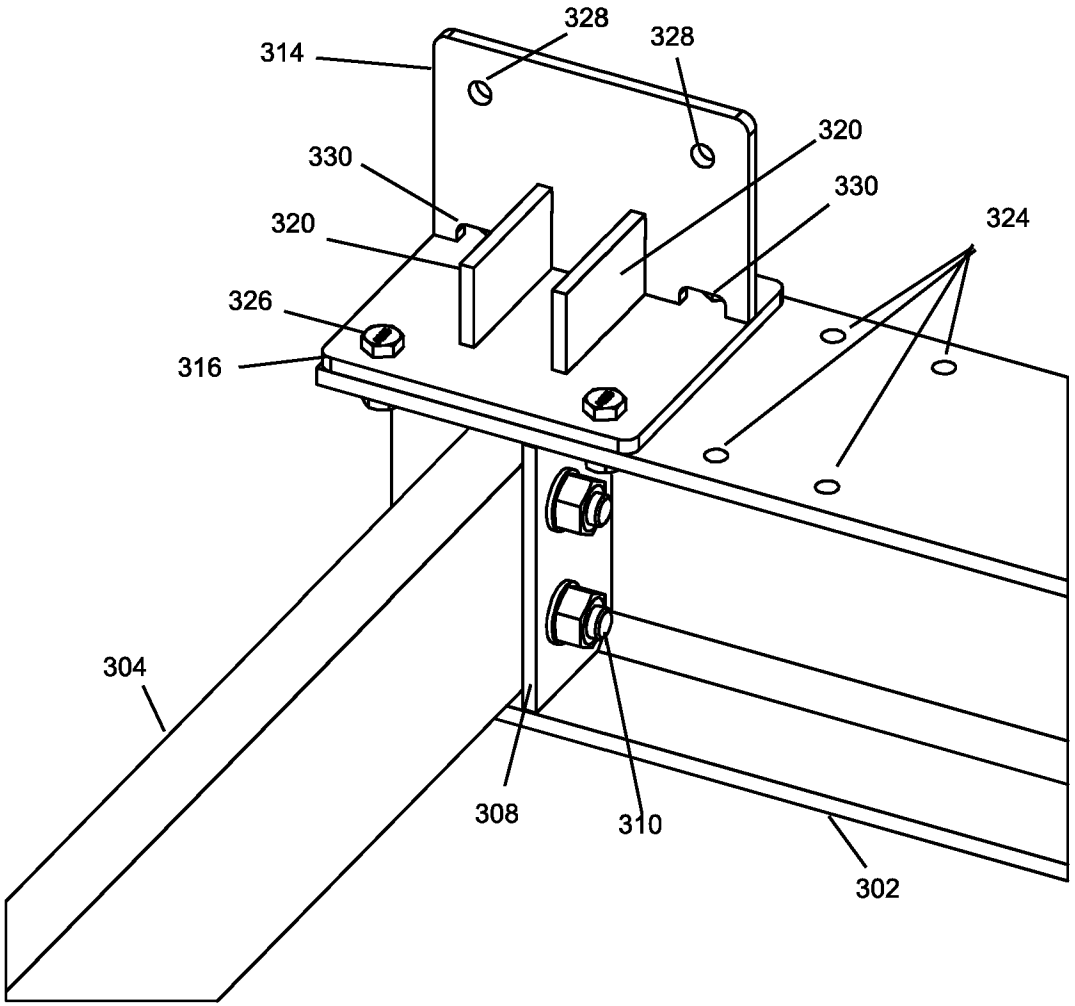
FIG. 72 is a close up perspective view of the top side of a spreader beam kit formed of a pair of opposing spreader beams and a pair of opposing cross braces that connect to one another, the view showing the intersection between a spreader beam and a cross brace; the view showing the end of the cross brace bolted to a flange positioned within the channel of the spreader beam; the view showing a mounting bracket connected to the upper surface of the spreader beam; the view showing the mounting bracket having a bottom plate, a side plate and a pair of center plates plate.
Figure 73:
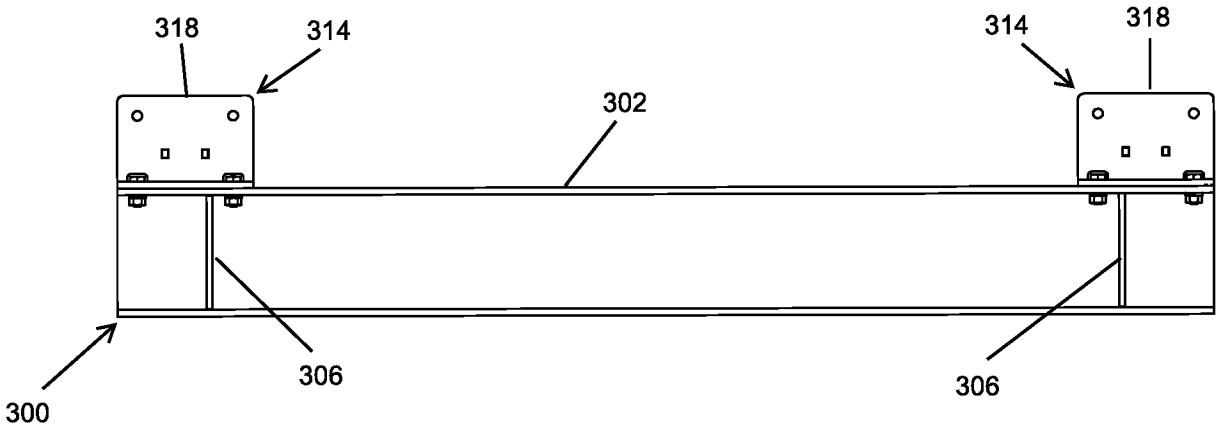
FIG. 73 is a side elevation view of a spreader beam kit formed of a pair of opposing spreader beams and a pair of opposing cross braces that connect to one another, the view showing the side of a spreader beam; the view showing a mounting bracket connected to the upper surface of the spreader beam.
Figure 74:
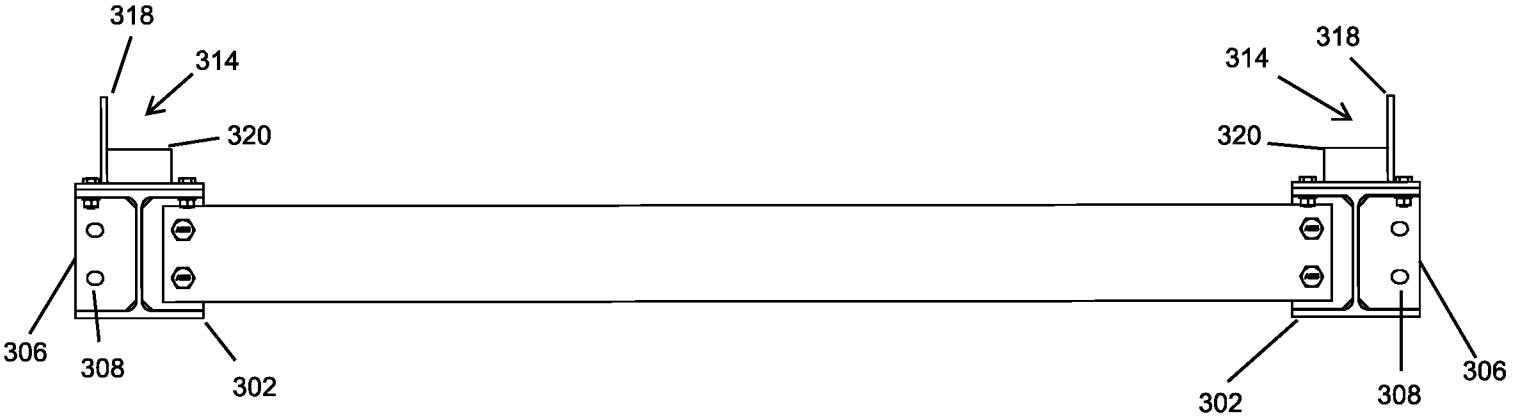
FIG. 74 is a side elevation view of a spreader beam kit formed of a pair of opposing spreader beams and a pair of opposing cross braces that connect to one another, the view showing the side of a cross brace connected at its ends to a pair of opposing spreader beams; the view showing a mounting bracket connected to the upper surface of the spreader beams.
Figure 75:
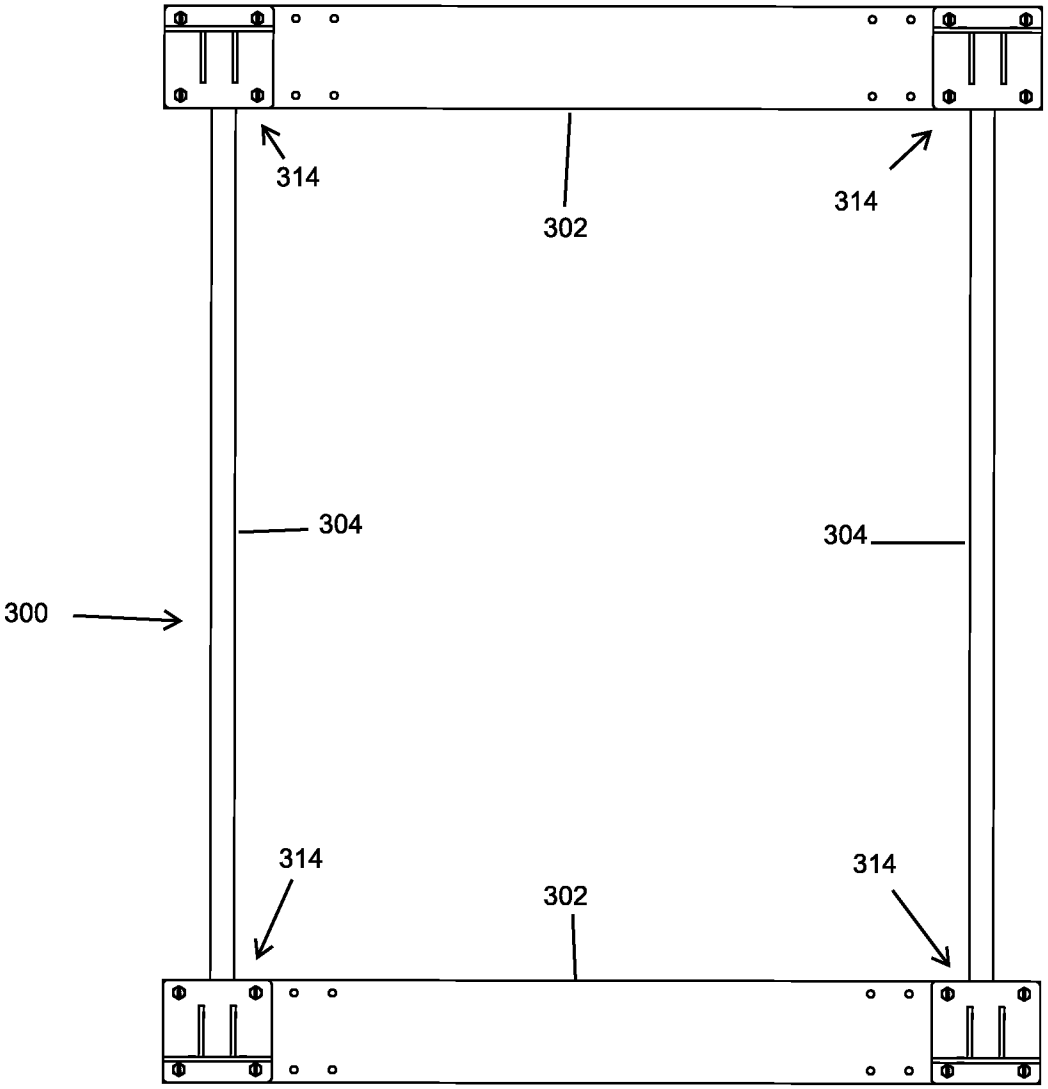
FIG. 75 is a top elevation view of a spreader beam kit formed of a pair of opposing spreader beams and a pair of opposing cross braces that connect to one another, the view showing a mounting bracket connected to the upper surface of the spreader beams at their outward ends.
Figure 76:
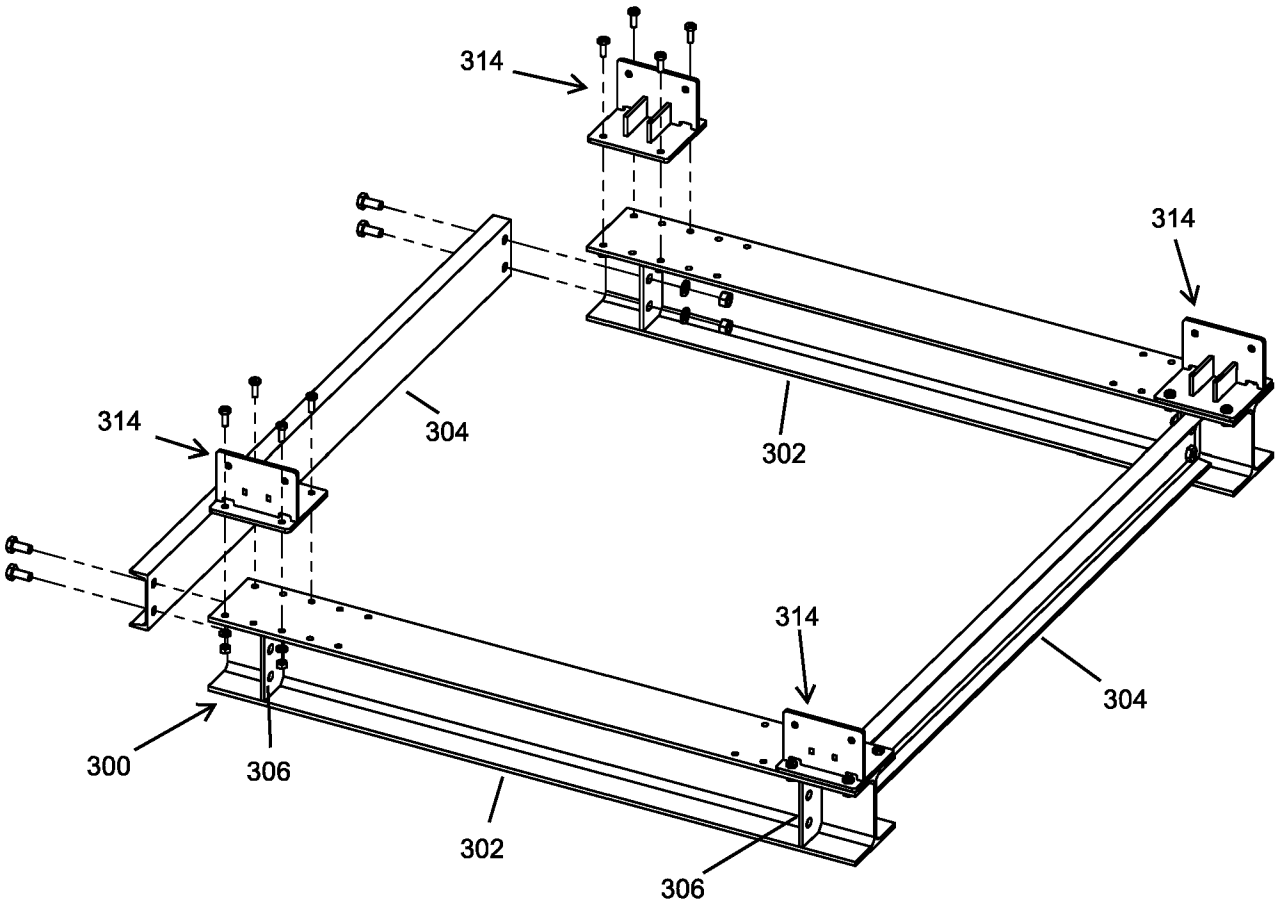
FIG. 76 is a perspective exploded view of a spreader beam kit formed of a pair of opposing spreader beams and a pair of opposing cross braces that connect to one another, the view showing a mounting bracket connected to the upper surface of the spreader beams at their outward ends; the view showing a pair of brackets and a cross brace in exploded form with related mounting hardware also in exploded form.
Figure 77:
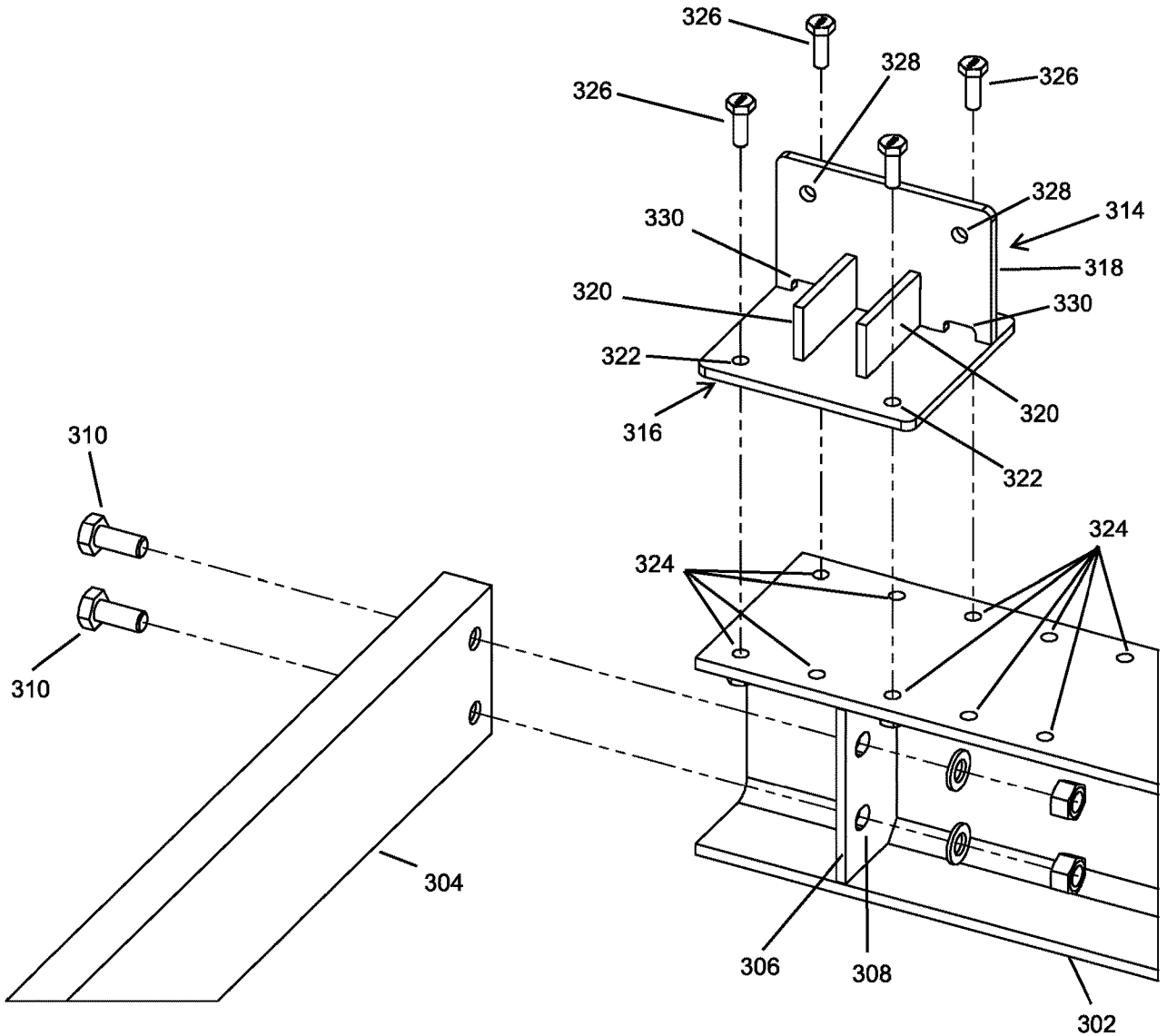
FIG. 77 is a close up perspective exploded view of a spreader beam kit formed of a pair of opposing spreader beams and a pair of opposing cross braces that connect to one another, the view showing a brackets and a cross brace in exploded form with related mounting hardware also in exploded form; the view showing the end of the cross brace about to be bolted to a flange positioned within the channel of the spreader beam; the view showing a mounting bracket about to be bolted to the upper surface of the spreader beam; the view showing the mounting bracket having a bottom plate, a side plate and a pair of center plates plate; the view showing the upper surface of the end of the spreader beam having a plurality of sets of holes that allow for adjustability as to where the mounting bracket is installed on the spreader beam.
Figure 78:
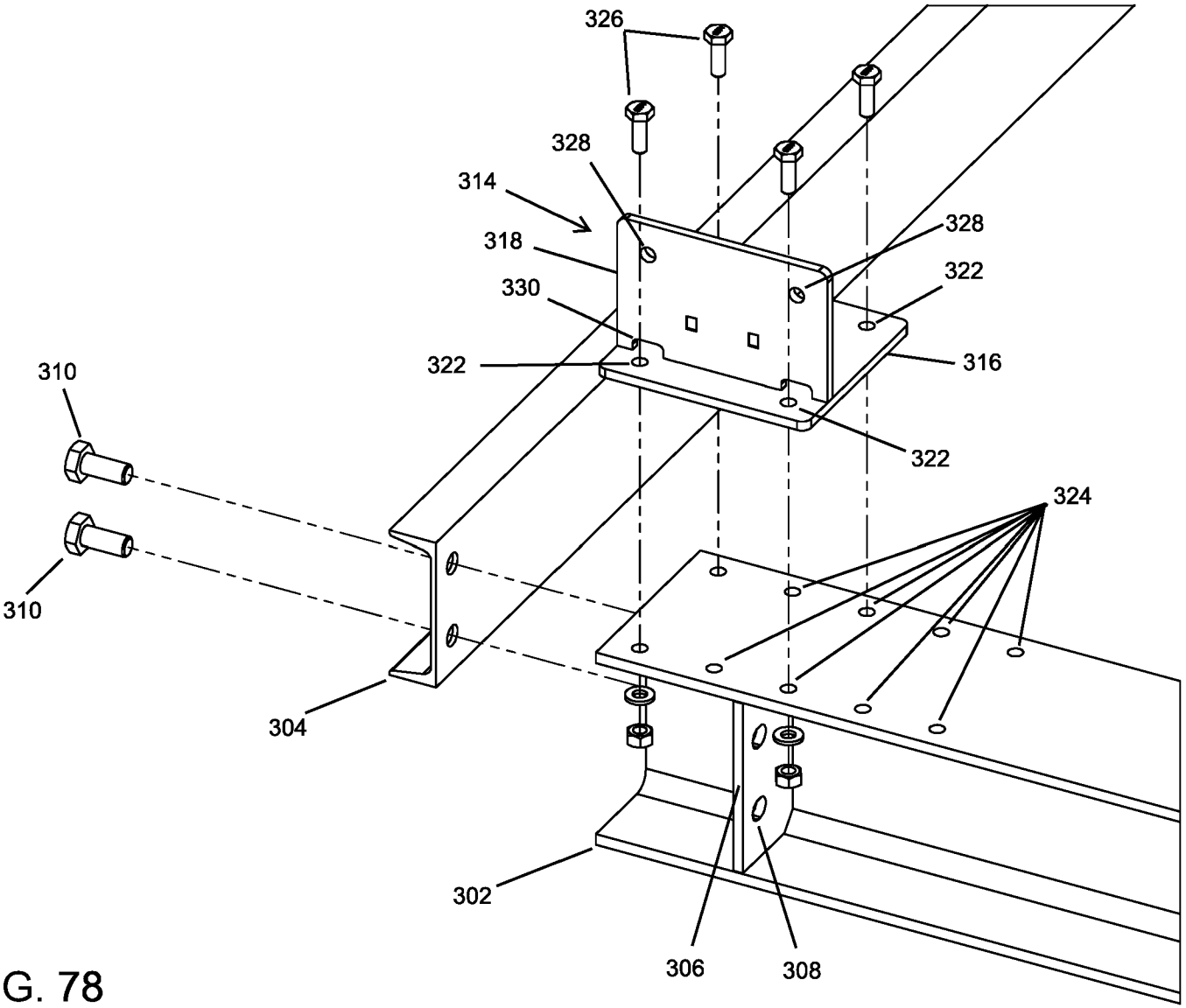
FIG. 78 is another close up perspective exploded view of a spreader beam kit formed of a pair of opposing spreader beams and a pair of opposing cross braces that connect to one another, the view showing a brackets and a cross brace in exploded form with related mounting hardware also in exploded form; the view showing the end of the cross brace about to be bolted to a flange positioned within the channel of the spreader beam; the view showing a mounting bracket about to be bolted to the upper surface of the spreader beam; the view showing the mounting bracket having a bottom plate and a side plate; the view showing the upper surface of the end of the spreader beam having a plurality of sets of holes that allow for adjustability as to where the mounting bracket is installed on the spreader beam.

In the arrangement shown, the upper surface and lower surface of spreader beams 302 are generally flat and flush and extend in approximate parallel planar alignment to one another. Once assembled, the generally flat and planar lower surface of opposing spreader beams 302 are placed in generally flat and flush engagement with the generally flat and planar upper surface of support member 202, which, as is shown in FIG. 63, is itself an I-beam, however any other size, shape or design is hereby contemplated for support member 202. In the arrangement shown, support member 202 is supported by legs 312 or another support member. As such, when spreader beams 302 are placed on support member 202, support member 202 provides support to spreader beams 302. Support member 202 may be placed at any position under spreader beams 302 and spreader beams 302 transfer and spread that support to catwalk system 10.

In the arrangement shown, catwalk system 10 is connected to and supported by spreader beams 302. More specifically, in the arrangement shown, as one example, mounting brackets 314 are connected to the upper surface of spreader beams 302 that are configured to receive and engage and mount to side trusses 20 of catwalk system 10.

Mounting brackets 314 are formed of any suitable size, shape and design and are configured to receive and engage and mount to bottom cords 24 of side trusses 20 of catwalk system 10. In some arrangements, it is desirable to connect to and support side trusses 20 at joint 34 at and/or under a vertical post 28, due to the rigidity of the side truss 20 at this point as well as due to the ability of vertical post 28 to transfer support to top cord 22. In one arrangement, as one example, mounting brackets 314 include a bottom plate 316, a side plate 318 and a pair of center plates 320, however any other configuration is hereby contemplated for use.

Bottom plate 316 is formed of any suitable size, shape and design and is configured to facilitate connection of mounting bracket 314 to the upper surface of spreader beam 302. In one arrangement, as is shown, bottom plate 316 is formed of a generally flat and planar member that when viewed from above or below is formed in a generally square or rectangular shape, however any other shape is hereby contemplated for use. In one arrangement, as is shown, the generally flat and planar shape of bottom plate 316 facilitates flat and flush planar engagement with the upper surface of spreader beam 302. In this way, the generally planar lower surface of bottom plate 316 provides a stable support area for mounting bracket 314. Bottom plate 316 includes a plurality of holes 322 therein that are configured to align with and connect to holes 324 in the upper surface of spreader beam 302 through fasteners 326. Side plate 318 and center plates 320 connect to bottom plate 316.

Side plate 318 is formed of any suitable size, shape and design and is configured to facilitate connection of mounting bracket 314 to the exterior surface of bottom cord 24 of a side truss 20 just below a vertical post 28 at joint 34. In one arrangement, as is shown, side plate 318 is formed of a generally flat and planar member that when viewed from the side is formed in a generally square or rectangular shape, however any other shape is hereby contemplated for use. In one arrangement, as is shown, the generally flat and planar shape of side plate 318 facilitates flat and flush planar engagement with the exterior surface of bottom cord 24 of a side truss 20 just below a vertical post 28 at joint 34. In this way, the generally planar interior surface of side plate 318 provides a stable support area engaging bottom cord 24 of a side truss 20. Side plate 318 includes a plurality of holes 328 therein that are configured to align with and connect to holes 122 in bottom cord 24 of a side truss 20 just below a vertical post 28 at joint 34. Side plate 318 and center plates 320 connect to bottom plate 316.

In the arrangement shown, the plane formed by side plate 318 extends in approximate perpendicular planar alignment to the plane formed by bottom plate 316. The lower end of side plate 318 connects to the upper surface of bottom plate 316. In one arrangement, one or more reliefs 330 are positioned in the lower edge of side plate 318 at the intersection of bottom plate 316 and side plate 318 that allow moisture and debris to pass there through preventing buildup of moisture and debris that can cause rust and deterioration. Center plates 320 are connected to and extend between bottom plate 316 and side plate 318.

Center plates 320 are formed of any suitable size, shape and design and are configured to engage and support the bottom surface of bottom cord 24 of a side truss 20 when side plate 318 is connected to bottom cord 24. Center plates 320 elevate the bottom cord 24 so as to make room for the downward extension of end plates 26 at the intersection of adjacent side trusses 20. That is, in the arrangement shown, as one example, center plates 320 raise above bottom plate 316 a distance such that when mounting brackets 314 are connected to side trusses 20 the lower edge of end plates 26 of adjacent side trusses 20 is positioned in engagement with or just above the upper surface of spreader beam 302.

In one arrangement, as is shown, center plates 320 are formed of a generally flat and planar member that when viewed from the side is formed in a generally square or rectangular shape, however any other shape is hereby contemplated for use. In one arrangement, as is shown, the generally flat and planar shape of center plates 320 facilitate engagement of the bottom surface of bottom cord 24 of a side truss 20 when end plates 26 is positioned between a pair of mounting brackets 314.

In the arrangement shown, the plane formed by center plates 320 extends in approximate perpendicular planar alignment to the plane formed by bottom plate 316. In the arrangement shown, the plane formed by center plates 320 also extends in approximate perpendicular planar alignment to the plane formed by side plate 318. The lower end of center plates 320 connects to the upper surface of bottom plate 316, and the outward facing end of center plates 320 connects to the interior surface of side plate 318. In one arrangement, the outward facing end of center plates 320 includes an ear that is received within a locating slot in side plate 318 which facilitates precise alignment of center plate 320 with respect to side plate 318. In one arrangement, the lower facing end of center plates 320 includes an ear that is received within a locating slot in bottom plate 316 which facilitates precise alignment of center plate 320 with respect to bottom plate 316. The extension of center plates 320 between bottom plate 316 and side plate 318 provides strength and rigidity to mounting bracket 314. In one arrangement, some or all of the engaging surfaces of bottom plate 316, side plate 318 and center plate 320 are connected to one another by welding, however any other manner of connecting bottom plate 316, side plate 318 and center plate 320 is hereby contemplated for use such as bolting, screwing or the like, as is forming these components out of a single piece of material such as by machining, molding, casting or the like.

Mounting brackets 314 are installed on the upper surface of spreader beams 302 by passing fasteners 326 thorough the holes 322 in bottom plate 316 as well as through holes 324 in the upper surface of spreader beam 302. In the arrangement shown, as one example, a plurality of sets of holes 324 are positioned along the upper surface of spreader beam 302 so as to facilitate installation of mounting brackets 314 along the length of spreader beams 302. The ability to install mounting brackets 314 along the length of spreader beam 302 accommodates variability between the location of the support member 202 and the joints 34 of the catwalk system 10.

In Operation: Spreader beams 302 are positioned in approximate parallel spaced alignment to one another and the ends of cross braces 304 are inserted in the channels adjacent the end of spreader beams 302. The ends of cross braces 304 are inserted into the channels of spreader beams 302 and the center wall of the cross braces 304 is positioned in alignment and/or engagement with the flanges 306 positioned within the channel of the spreader beams 302. When the center wall of cross braces 304 are aligned with the flanges 306 in the channel of spreader beams 302, the end of cross braces 304 are tightened against flange 306. In this way, a generally square or rectangular shaped member is formed that is generally strong and rigid.

Once spreader beams 302 and cross braces 304 are assembled, the lower surface of spreader beams 302 is placed on top of the upper surface of support member 202. Arrangement shown, spreader beams 302 extend in approximate perpendicular alignment to the length of support member 202. Spreader beams 302 are slid along the upper surface of support member 202 until the desired position is located and mounting brackets 314 are installed on the upper surface of spreader beams 302 by aligning holes 322 in bottom plate 316 with the desired holes 324 in the upper surface of spreader beams 302.

Mounting brackets 314 are connected to catwalk system 10 by placing the lower surface of bottom cord 24 upon the upper ends of opposing center plates 320. In this way, mounting brackets 314 engage and support catwalk system 10. The interior surface of the upper end of side plate 318 is positioned in flat and flush engagement with the exterior surface of bottom cord 24. The holes 328 in side plate 318 are aligned with the holes 122 in bottom cord 24 and fasteners 120 are inserted through the holes 328 in side plate 318, the holes 122 in bottom cord 24 and the holes 124 in end plate 102. In this way, mounting bracket 314 is attached to catwalk system 10.

When mounting brackets 314 are installed on bottom cords 24 of catwalk system 10, end plates 26 of adjacent side trusses 20 are positioned between adjacent mounting brackets 314. However, due to the elevation of center plates 320 above bottom plate 316 of mounting bracket 314, the lower edge of end plates 26 is in engagement with or is positioned slightly above the upper surface of spreader beam 302. As such, in this way, the use of mounting brackets 314 allows installation of spreader beams 302 along the length of catwalk system 10 despite the presence of end plates 26 that extend downward from the bottom cord 24. In addition, the use of mounting brackets 314 and spreader beams 302 facilitates placement of mounting bracket 314 directly below a vertical post 28, which provides a rigid transfer of support from the bottom cord 24 to the top cord 22. In addition, the use of mounting brackets 314 and spreader beams 302 facilitates strengthening of joint 34 by allowing the passage of fasteners 120 through side plate 318 of mounting bracket 314 as well as through bottom cord 24 as well as through end plate 102.

Once installed, spreader beams 302 distribute support across a span or section of catwalk system 10 thereby ensuring proper support is provided to catwalk system 10. As such a spreader beam system is presented that resolves many of the problems in the art. Namely, the spreader beam system is easy to install, provides adequate support, is easy to assemble, is adjustable, can be installed along any portion of the catwalk system, among countless other improvements and advantages.

From the above discussion it will be appreciated that the catwalk floorbeam connection system presented herein improves upon the state of the art.

Specifically, the catwalk floorbeam connection system presented herein: is easy to assemble; reduces the labor required to assemble; reduces assembly errors; speeds the assembly process over prior art systems; is difficult to misassemble; is durable; has a long useful life; is rigid; can be used in a great number of applications; can be used with a wide variety of equipment; is relatively inexpensive; is easy to manufacture; has a robust design; is high quality; can be used with any grain bin; is dimensionally accurate; eliminates the need to weld in the field; has tight dimensional tolerances; allows catwalks to be shipped in a disassembled state and assembled on site; that reduces shipping costs; that provides a pocket that receives an end of the floorbeams therein, among countless other advantages and improvements.

It will be appreciated by those skilled in the art that other various modifications could be made to the device without parting from the spirit and scope of this disclosure. All such modifications and changes fall within the scope of the claims and are intended to be covered thereby.

What is claimed:

1. A catwalk system, comprising:

a first floorbeam;

the first floorbeam extending a length between a first end and a second end;

a first side truss;

the first side truss extending a length between opposing ends;

the first side truss having a first bottom cord;

the first side truss having a first pocket formed by a first bottom plate and a first side plate and a second side plate;

wherein a portion of the first side plate and a portion of the second side plate extends outward past the first bottom plate and engages with a top side of the first bottom cord of the first side truss;

wherein the first side plate and the portion thereof has a planar surface facing toward an interior of the first pocket;

wherein the second side plate and the portion thereof has a planar surface facing toward the interior of the first pocket;

a second side truss;

the second side truss extending a length between opposing ends;

the second side truss having a second bottom cord;

the second side truss having a second pocket formed by a second bottom plate and a third side plate and a fourth side plate;

wherein a portion of the third side plate and a portion of the fourth side plate extends outward past the second bottom plate and engages with a top side of the second bottom cord of the second side truss;

wherein the third side plate and the portion thereof has a planar surface facing toward an interior of the second pocket;

wherein the fourth side plate and the portion thereof has a planar surface facing toward the interior of the second pocket;

wherein the first end of the first floorbeam is inserted in the first pocket of the first side truss and the second end of the first floorbeam is inserted in the second pocket of the second side truss thereby connecting the first side truss to the second side truss.

2. The system of claim 1, wherein the first pocket has an open upper end configured to permit the first end of the first floorbeam to be lowered into and removed from the open upper end of the first pocket.

3. The system of claim 1, wherein the first pocket has an open upper end configured to permit the first end of the first floorbeam to be lowered into and removed from the open upper end of the first pocket; and wherein the second pocket has an open upper end configured to permit the second end of the first floorbeam to be lowered into and removed from the open upper end of the second pocket.

4. The system of claim 1, wherein the first pocket includes a first wing extending outward from the first side plate and includes a second wing extending outward from the second side plate;

wherein the second pocket includes a third wing extending outward from the third side plate and includes a fourth wing extending outward from the fourth side plate;

wherein the first wing and the second wing engage with a side of the first bottom cord of the first side truss; and wherein the third wing and the fourth wing engage with a side of the second bottom cord of the second side truss.

5. The system of claim 1, wherein when the first end of the first floorbeam is positioned within the first pocket the first end of the first floorbeam is bolted to the first side plate and the second side plate of the first pocket.

6. The system of claim 1, wherein the first side truss is positioned parallel to the second side truss.

7. The system of claim 1, wherein the first side truss has a first top cord and a first plurality of connecting posts operatively connecting the first top cord and the first bottom cord; and wherein the second side truss has a second top cord and a second plurality of connecting posts operatively connecting the second top cord and the second bottom cord.

8. The system of claim 1, wherein the first side truss has a first top cord and a first plurality of connecting posts operatively connecting the first top cord and the first bottom cord; and wherein a first side plate extends outward past the first bottom plate on a first side of a first connecting post of the first plurality of connecting posts;

wherein a second side plate extends outward past the first bottom plate on a second side of the first connecting post; and wherein the first side of the first connecting post is opposite the second side of the first connecting post.

9. The system of claim 1, wherein the first side truss has a first top cord and a first plurality of connecting posts operatively connecting the first top cord and the first bottom cord;

wherein a first subset of the first plurality of connecting posts extend vertically between the first top cord and the first bottom cord; and wherein a second subset of the first plurality of connecting posts extend at an angle between the first top cord and the first bottom cord.

10. The system of claim 1, further comprising:

a second floorbeam;

the second floorbeam extending a length between a first end and a second end;

wherein the first side truss has a third pocket formed by a third bottom plate and a fifth side plate and a sixth side plate;

wherein the second side truss has a fourth pocket formed by a seventh side plate and a eighth side plate;

wherein the first end of the second floorbeam is inserted in the third pocket of the first side truss and the second end of the second floorbeam is inserted in the fourth pocket of the second side truss thereby connecting the first side truss to the second side truss;

a first wind truss;

the first wind truss extending between a first end and a second end;

wherein the first end of the first wind truss is connected to the first bottom plate of the first pocket of the first side truss; and wherein the second end of the first wind truss is connected to the fourth bottom plate of the fourth pocket of the second side truss.

11. A catwalk system, comprising:

a first floorbeam;

the first floorbeam extending between a first end and a second end;

a first side truss;

the first side truss extending a length between opposing ends;

wherein the first side truss has a first top cord, a first bottom cord, and a first plurality of connecting posts operatively connecting the first top cord and the first bottom cord;

the first side truss having a first pocket formed by a first bottom plate and a first pair of side plates;

wherein a planar portion of the first pair of side plates extends outward past the first bottom plate and engages with a top side of the first bottom cord of the first side truss;

a second side truss;

wherein the second side truss has a second top cord, a second bottom cord, and a second plurality of connecting posts operatively connecting the second top cord and the second bottom cord;

the second side truss extending a length between opposing ends;

the second side truss having a second pocket formed by a second bottom plate and a second pair of side plates;

wherein a planar portion of the second pair of side plates extends outward past the second bottom plate and engages with a top side of the second bottom cord of the second side truss;

wherein the first end of the first floorbeam is inserted in the first pocket of the first side truss and the second end of the first floorbeam is inserted in the second pocket of the second side truss thereby connecting the first side truss to the second side truss.

12. The system of claim 11, wherein the first pocket has an open upper end configured to permit the first end of the first floorbeam to be lowered into and removed from the open upper end of the first pocket.

13. The system of claim 11, wherein the first pocket has an open upper end configured to permit the first end of the first floorbeam to be lowered into and removed from the open upper end of the first pocket; and wherein the second pocket has an open upper end configured to permit the second end of the first floorbeam to be lowered into and removed from the open upper end of the second pocket.

14. The system of claim 11, wherein the first pocket includes a first pair of wings extending outward from the first pair of side plates;

wherein the second pocket includes a second pair of wings extending outward from the second pair of side plates;

wherein the first pair of wings engage with a side of the first bottom cord of the first side truss; and wherein the second pair of wings engage with a side of the second bottom cord of the second side truss.

15. The system of claim 11, wherein when the first end of the first floorbeam is positioned within the first pocket the first end of the first floorbeam is bolted to first pair of side plates of the first pocket.

16. The system of claim 11, wherein the first side truss is positioned parallel to the second side truss.

17. The system of claim 11, wherein a first side plate of the first pair of side plates extends outward past the first bottom plate on a first side of a first connecting post of the first plurality of connecting posts;

wherein a second side plate of the first pair of side plates extends outward past the first bottom plate on a second side of the first connecting post; and wherein the first side of the first connecting post is opposite the second side of the first connecting post.

18. The system of claim 11, wherein a first subset of the first plurality of connecting posts extend vertically between the first top cord and the first bottom cord; and wherein a second subset of the first plurality of connecting posts extend at an angle between the first top cord and the first bottom cord.

19. The system of claim 11, further comprising:

a second floorbeam;

the second floorbeam extending a length between a first end and a second end;

wherein the first side truss has a third pocket formed by a third bottom plate and a third pair of side plates;

wherein the second side truss has a fourth pocket formed by a fourth bottom plate and a fourth pair of side plates;

wherein the first end of the second floorbeam is inserted in the third pocket of the first side truss and the second end of the second floorbeam is inserted in the fourth pocket of the second side truss thereby connecting the first side truss to the second side truss;

a first wind truss;

the first wind truss extending between a first end and a second end;

wherein the first end of the first wind truss is connected to the first bottom plate of the first pocket of the first side truss; and wherein the second end of the first wind truss is connected to the fourth bottom plate of the fourth pocket of the second side truss.

20. A catwalk system, comprising:

a first floorbeam;

the first floorbeam extending a length between a first end and a second end;

a first side truss;

the first side truss extending a length between opposing ends;

the first side truss having a first bottom cord;

the first side truss having a first pocket with an open upper end and formed by a first bottom plate and a first pair of side plates;

wherein a portion of the first pair of side plates extends over a top side of the first bottom cord of the first side truss and engages the top side of the first bottom cord of the first side truss; a second side truss;

the second side truss extending a length between opposing ends;

the second side truss having a second bottom cord;

the second side truss having a second pocket with an open upper end and formed by a second bottom plate and a second pair of side plates;

wherein a portion of the second pair of side plates extends over a top side of the second bottom cord of the second side truss and engages the top side of the second bottom cord of the second side truss;

wherein the first end of the first floorbeam is inserted in the first pocket of the first side truss and the second end of the first floorbeam is inserted in the second pocket of the second side truss thereby connecting the first side truss to the second side truss.

21. A catwalk system, comprising:

a first floorbeam;

the first floorbeam extending a length between a first end and a second end;

a first side truss;

the first side truss extending a length between opposing ends;

the first side truss having a first bottom cord, a first top cord and a first connecting post;

the first side truss having a first pocket formed by a first bottom plate and a first pair of planar side plates;

wherein a portion of the first pair of planar side plates extends over a top side of the first bottom cord of the first side truss;

wherein a first side plate of the first pair of side plates is positioned on a first side of the first connecting post and a second side plate of the first pair of planar side plates is positioned on a second side of the first connecting post wherein the first side of the first connecting post is opposite the second side of the first connecting post;

a second side truss;

the second side truss extending a length between opposing ends;

the second side truss having a second bottom cord, a second top cord and a second connecting post;

the second side truss having a second pocket formed by a second bottom plate and a second pair of planar side plates;

wherein a portion of the second pair of planar side plates extends over a top side of the second bottom cord of the second side truss;

wherein a first side plate of the second pair of planar side plates is positioned on a first side of the second connecting post and a second side plate of the second pair of planar side plates is positioned on a second side of the second connecting post wherein the first side of the second connecting post is opposite the second side of the second connecting post;

wherein the first end of the first floorbeam is inserted in the first pocket of the first side truss and the second end of the first floorbeam is inserted in the second pocket of the second side truss thereby connecting the first side truss to the second side truss.

* * * * *